US008678513B2

(12) United States Patent
Hughes et al.

(10) Patent No.: US 8,678,513 B2
(45) Date of Patent: Mar. 25, 2014

(54) TRAVELING UNDERCUT SOLUTION MINING SYSTEMS AND METHODS

(75) Inventors: Ronald O. Hughes, Green River, WY (US); Jean-Paul Detournay, Brussels (BE); Alain Vandendoren, Green River, WY (US); Larry C. Refsdal, Green River, WY (US); Joseph A. Vendetti, Green River, WY (US); Michael C. Montoya, Green River, WY (US)

(73) Assignee: Solvay Chemicals, Inc., Houston, TX (US)

( * ) Notice: Subject to any disclaimer, the term of this patent is extended or adjusted under 35 U.S.C. 154(b) by 370 days.

(21) Appl. No.: 13/056,081

(22) PCT Filed: Jul. 29, 2009

(86) PCT No.: PCT/EP2009/059808

§ 371 (c)(1),
(2), (4) Date: Jan. 26, 2011

(87) PCT Pub. No.: WO2010/012771

PCT Pub. Date: Feb. 4, 2010

(65) Prior Publication Data

US 2011/0127825 A1 Jun. 2, 2011

Related U.S. Application Data

(60) Provisional application No. 61/085,735, filed on Aug. 1, 2008, provisional application No. 61/172,538, filed on Apr. 24, 2009.

(51) Int. Cl.
*E21B 43/28* (2006.01)

(52) U.S. Cl.
CPC ..... *E21B 43/283* (2013.01)
USPC ..... 299/5; 299/4

(58) Field of Classification Search
USPC ..... 299/2–6; 166/308.1, 308.2
See application file for complete search history.

(56) References Cited

U.S. PATENT DOCUMENTS 2,251,916 A 8/1941 Cross
2,822,158 A 2/1958 Brinton (Continued)

FOREIGN PATENT DOCUMENTS

GB 897566 A 5/1962
SU 876968 B 10/1981
WO WO 2009/087145 A1 7/2009

OTHER PUBLICATIONS

U.S. Appl. No. 12/811,643, filed Jul. 2, 2010, Jean-Paul Detournay et al.

*Primary Examiner* — David Bagnell
*Assistant Examiner* — Michael Goodwin
(74) *Attorney, Agent, or Firm* — Beatrice C. Ortego

(57) ABSTRACT

In-situ solution mining method of an ore bed, particularly containing trona, which comprises exposing to a solvent an ore region inside a borehole drilled in the ore, and dissolving a desired solute within the exposed region to provide a liquor and create a voided 'undercut', such undercutting making the ore susceptible to gravitational loading and crushing. Unexposed ore falls into the undercut by gravity without breaking the ore roof resulting in exposure of fresh ore to the solvent and in preventing solvent exposure to contaminating material near the roof. The desired solute is eventually dissolved away in the entire bed from its floor up to its roof. Solvent injection may be delivered through a conduit positioned inside the borehole, and may be moved by retracting or perforating the conduit. The method may employ an advancing undercut initiated up-dip and traveling down-dip, or a retreating undercut initiated down-dip and traveling up-dip.

32 Claims, 23 Drawing Sheets

(56) References Cited

U.S. PATENT DOCUMENTS

| | | | | | |
|---|---|---|---|---|---|
| 2,979,317 | A | | 4/1961 | Bays | |
| 3,184,287 | A | | 5/1965 | Gancy | |
| 3,347,595 | A | | 10/1967 | Dahms et al. | |
| 3,759,574 | A | * | 9/1973 | Beard | 299/4 |
| 3,779,602 | A | * | 12/1973 | Beard et al. | 299/5 |
| 3,873,156 | A | | 3/1975 | Jacoby | |
| 3,953,073 | A | | 4/1976 | Kube | |
| 4,163,580 | A | | 8/1979 | Pearson et al. | |
| 4,234,231 | A | * | 11/1980 | Yan | 299/4 |
| 4,264,104 | A | | 4/1981 | Helvenston et al. | |
| 4,344,650 | A | * | 8/1982 | Pinsky et al. | 299/4 |
| 4,398,769 | A | | 8/1983 | Jacoby | |
| 4,498,706 | A | | 2/1985 | Ilardi et al. | |
| 4,652,054 | A | | 3/1987 | Copenhafer et al. | |
| 4,815,790 | A | | 3/1989 | Rosar et al. | |
| 5,246,273 | A | | 9/1993 | Rosar | |
| 5,283,054 | A | * | 2/1994 | Copenhafer et al. | 423/206.2 |
| 5,690,390 | A | | 11/1997 | Bithell | |
| 6,662,870 | B1 | | 12/2003 | Zupanick et al. | |
| 7,353,877 | B2 | | 4/2008 | Zupanick | |
| 2003/0029617 | A1 | | 2/2003 | Brown et al. | |
| 2004/0031609 | A1 | | 2/2004 | Zupanick | |
| 2005/0231022 | A1 | | 10/2005 | Brown et al. | |
| 2006/0039842 | A1 | | 2/2006 | Day et al. | |
| 2006/0138853 | A1 | | 6/2006 | Brown et al. | |

* cited by examiner

Phases I to II

Phase III

Phase IV

Phase VI down-dip direction

Phase V

Phase VII

TRAVELING UNDERCUT SOLUTION MINING SYSTEMS AND METHODS

CROSS-REFERENCE TO RELATED APPLICATIONS

The present application is a U.S. national stage application under 35 U.S.C. §371 of International Application No. PCT/EP2009/059808 filed Jul. 29, 2009, which claims the benefit of U.S. provisional application No. 61/085,735 filed Aug. 1, 2008 and to U.S. provisional application No. 61/172,538 filed Apr. 24, 2009, the content of each of these applications being herein incorporated by reference for all purposes.

STATEMENT REGARDING FEDERALLY SPONSORED RESEARCH OR DEVELOPMENT

Not applicable.

TECHNICAL FIELD OF THE INVENTION

The present invention relates to systems and methods for in situ solution mining of ore containing a desired solute, in particular for in situ solution mining of trona beds.

BACKGROUND OF THE INVENTION

Large deposits of mineral trona in southwestern Wyoming near Green River Basin have been mechanically mined since the late 1940's and have been exploited by five separate mining operations over the intervening period. The nominal depth below surface of these mining operations ranges between approximately 800 feet to 2000 feet. All operations practiced some form of underground ore extraction using techniques adapted from the coal mining industry.

Trona ore is a mineral that contains about 90-95% sodium sesquicarbonate ($Na_2CO_3.NaHCO_3.2H_2O$). The sodium sesquicarbonate found in trona ore dissolves in water to yield approximately 5 parts by weight sodium carbonate ($Na_2CO_3$) and 4 parts sodium bicarbonate ($NaHCO_3$).

The crude trona is normally purified to remove or reduce impurities, primarily shale and other nonsoluble materials, before its valuable sodium content can be sold commercially as: soda ash ($Na_2CO_3$), sodium bicarbonate ($NaHCO_3$), caustic soda (NaOH), sodium sesquicarbonate ($Na_2CO_3.NaHCO_3.2H_2O$), a sodium phosphate ($Na_5P_3O_{10}$) or other sodium-containing chemicals.

Soda ash is one of the largest volume alkali commodities made in the United States. Soda ash finds major use in the glass-making industry and for the production of baking soda, detergents and paper products.

To recover these valuable alkali products, the so-called 'Monohydrate' commercial process is frequently used to produce soda ash from trona. Crushed trona ore is calcined (i.e., heated) to convert sodium bicarbonate into sodium carbonate, drive off water of crystallization and form crude soda ash. The crude soda ash is then dissolved in water and the insoluble material is separated from the resulting solution. This clear solution of sodium carbonate is fed to an evaporative crystallizer where some of the water is evaporated and some of the sodium carbonate forms into sodium carbonate monohydrate crystals ($Na_2CO_3.H_2O$). The monohydrate crystals are removed from the mother liquor and then dried to convert it to dense soda ash. The mother liquor is recycled back to the evaporator circuit for further processing into sodium carbonate monohydrate crystals.

The ore used in these processes can be dry mined trona obtained by sinking shafts of 800-2000 feet (or about 240-610 meters) or so and utilizing miners and machinery underground to dig out and convey the ore to the surface. Because of the mine depth and the need to have miners and machinery, the cost of mining the ore is a significant part of the cost of producing the final product. Additionally, trona beds, also known as trona seams, often contain thick bands of shale that must be removed as well during mechanical mining. The shale must then be transported along with the ore to the surface refinery, removed from the product stream, and transported back into the mine, or a surface waste pond. These insoluble contaminants not only cost a great deal of money to mine, remove, and handle, they provide very little value back to the operator.

One mining technique being developed to avoid the high cost of having miners and machinery underground is in situ solution mining. In its simplest form, solution mining is carried out by contacting a sodium-containing ore such as trona with a solvent such as water to dissolve the ore and form a liquor (also called 'brine') containing dissolved sodium values. The liquor is then recovered and used as feed material to process it into one or more sodium salts. The difficulty with trona solution mining is that trona is an incongruently dissolving double salt that has a relatively slow dissolving rate and requires high temperatures to achieve maximum solubility and to yield highly concentrated solutions which are required for high efficiency in present processing plants. Further, solution mining may also yield over time liquor solutions of varying strength, which must be accommodated by the processing plant.

Attempts of in situ solution mining of virgin trona in Wyoming were met with less than limited success, and were eventually abandoned in the early 1990's. Current in situ trona solution mining methods under development generally involve the directional drilling of borehole patterns horizontally through a virgin trona bed for some distance, the passage of a solvent (water) through the open borehole, and collecting the resultant trona liquor which is further processed for recovery of products. However, it is believed that these methods have an intrinsic limited productivity, since the maximum surface area available for dissolution is reached at the point where the trona seam around the borehole has been dissolved sufficiently to expose the insoluble roof and floor material. Once this point is reached, the only trona surfaces available for the solvent to react with are the walls (ribs) of the enlarged borehole. Therefore, meaningful volumes of solution can only be achieved by employing a very large number of very expensive boreholes.

Owing to the limited availability of 'fresh' trona surface area for the solvent to act upon, these methods can also be susceptible to a theorized phenomenon known as 'bicarb blinding' as well. Indeed, because sodium carbonate is more soluble than sodium bicarbonate, there is a tendency for the carbonate to go into solution more easily than the bicarbonate portion of the trona body. Thus, the exposed trona could leach to become less soluble bicarbonate and thereby 'blind' the unexposed trona.

In-situ solution mining methods are now currently employed for mining of remnant mechanically mined trona beds. A recent commercial trona mining technique that Applicants call 'hybrid' solution mining process takes advantage of the remnant voids left behind from mechanical mining to both deposit insoluble materials and other contaminants (collectively called tailings or tails) and to recover sodium value from the aqueous solutions used to carry the tails. Solvay Chemicals, Inc. (SCI), known then as Tenneco Minerals was the first to begin depositing tails, from the refining process back into the mechanically mined voids left behind during normal partial extract operation.

Hybrid solution mining processes are thus necessarily dependent upon the surface area and openings provided by mechanical mining to make them economically feasible and productive. These 'hybrid' mining processes cannot exist in their present form without the necessity of prior mechanical mining in a partial extraction mode. The associated 'remnant trona' left behind provides the volume of exposed trona necessary for meaningful production volumes while the openings left provide the volume needed for both solvent retention and liquor transport.

Even though solution mining of remnant mechanically mined trona is one of the preferred mining methods in terms of both safety and productivity, there are several problems to be addressed, not the least of which is the resource itself. Indeed, in any given mechanical mining operation there is a finite amount of trona that has been previously mechanically mined. When current trona target beds will be completely mechanically mined, the operators will have to start mining other less productive and more hazardous beds.

Also, since trona has relatively low solubility in water, in-situ hybrid solution mining systems make up for the low solubility of trona by introducing large volumes of water to large volumes of exposed trona for relatively long periods of time. Additionally or alternatively, the mining operator may use more aggressive solvents, such as caustic soda, to increase the solubility of trona, but it is generally believed that production cost is likely to become prohibitive at the scales necessary to provide meaningful production volumes.

Economically mechanically minable ore can be considered a valuable resource from another aspect as well. In current hybrid mining systems, the mechanically mined ore is essentially used to boost the total alkalinity (TA) of the 'mine return water' (MRW) solution. MRW typically contains from 12% to 20% TA. Calcined and leached mechanically mined ore is essentially used to raise the MRW alkalinity up to sufficiently high concentrations (+30%) as to be an economic evaporator feed for the monohydrate process. At ambient temperatures MRW becomes fully saturated at around 20% TA. If this liquor is introduced directly to an evaporator, a great deal of water must be boiled away to bring the concentration (and raise the temperature) up to +30% TA where soda ash crystal precipitation begins to take place. By employing both MRW and conventional calcining and leaching of mechanical ore, the MRW is increased in TA, thus making economic, mechanically mined ore a resource of even greater value.

Thus, a dilemma exists for trona mining operators. In order to remain competitive, the operator is encouraged to contain operations in the preferred target bed for as long as possible, but by doing so, the operator will eventually be forced to move a significant and ever growing portion of the operation into thinner beds of lower quality and to use more rigorous mining conditions while the preferred bed is depleting and finally becomes exhausted. Under this scenario, the competitive advantage enjoyed by today's trona operations in the global soda ash market will begin to dwindle over time and will likely end with the closure of the mines while available trona resources, yet to be mined, still remain in the ground. Current hybrid solution mining systems and mechanical mining systems (such as longwall mining) help to dramatically boost recovery of the mineral resource, but they only forestall the inevitable.

In addition to the need of large amount of solvent, limited productivity and probable limitation by 'bicarb blinding' for in-situ solution mining of trona beds, it was realized that in-situ solution mining of trona beds further suffers from decreased liquor quality. Indeed, the liquor may be contaminated with chlorides, sulfates and the like, which are difficult to remove when processing the liquor into sodium-containing chemicals. Not only does chloride contamination pose a problem for solution mining, it also causes severe issues in the downstream processes for refining the saturated solution (liquor).

This contamination can be explained as follows. While trona has relatively low solubility in water, chloride salts of some naturally occurring minerals in the roof shale above the trona, notably sodium chloride, are highly soluble. In fact, sodium chloride will displace the solubility of sodium carbonate and sodium bicarbonate to a significant degree. Due to chloride's high solubility, once chloride is in solution in the liquor, it is economically not feasible to separate it from the desirable solutes. The only way for the chloride salt(s) to leave the processing system is either through liquor purged to waste streams (carrying with it valuable mother liquor solution as well) or through the final product where chloride is a considerable contaminant for customers even at very small levels. In short, chloride contamination (also called 'chloride poisoning') of the pregnant sodium liquor during mining must be avoided.

The need to avoid chloride contamination poses a significant challenge to all in-situ trona solution mining processes, as the 'chloride poisoning' problem is derived from the environment of deposition of the trona beds. In the example of trona Bed 17 in Wyoming, the bed is bounded by a relatively impervious oil shale layer in the floor, and softer, more friable, 'green shale' layers in the roof and upper zones of the trona itself. It is these upper shales that pose the greatest potential for chloride poisoning of the solution mining liquor. Owing to the complicated process of deposition of the trona beds, the roof shales tend to contain significant amounts of chloride laden minerals, as well as other water soluble contaminants. If the roof shales are allowed to come in contact with the liquor in significant volumes (combined with fracturing and jointing) they are quite likely to 'poison' the liquor and render it unsuitable for refining. Therefore, it is desirable to carry out in-situ solution mining in such a way to avoid bringing significant volumes of these undesirable soluble minerals to come into contact with the solvent.

Moreover, the in-situ solution mining methods and systems can lead to wide spans of unsupported roof rock exposed to the solvent liquor. When these 'open roof spans' exceed a critical distance, ranging from only a few feet up to perhaps twenty feet, the roof will fail and fall into the solution-filled void along its entire length. Under these circumstances the roof shales literally soak in the solvent for nearly the full life of the borehole. Thus, chlorides, inorganics, and other soluble minerals will likely leach out of the shales and contaminate the liquor, rendering it useless.

This problem may be avoided, for the most part, in present hybrid solution mining of remnant pillars because the roof is not typically fractured and caved and allowed to soak in the solvent. The remnant pillars employed in this mining process holds the roof up out of the liquor as they are slowly dissolved away. The addition of insoluble tailings materials helps to stabilize a pillar and to avoid complete pillar failure as the pillar grows weaker and crumbles under overburden load during dissolution. Eventually, however, the void area around the pillar remnants is filled with insoluble material to the point where the surface of trona available to the solvent becomes insignificant and production declines until mining is eventually halted.

It is therefore desirable to carry out mining operations in such a way so as to conserve the more desirable trona resources suitable for mechanical mining, while at the same time extracting trona from less desirable beds without the negative impact of increased mining hazards and increased costs.

Ideally, trona should be extracted in such a way so as to minimize or even eliminate the need for mechanical mining in the trona beds, especially in these shallow trona beds which are currently less economically viable, and thus less desirable.

SUMMARY OF THE INVENTION

The present invention addresses one or more of the issues concerning previous in-situ solution mining systems and methods, particularly for in-situ solution mining of trona beds, more particularly for in-situ solution mining of virgin trona beds.

Systems and methods according to the present invention relate to the in situ solution mining of an ore bed containing a desired solute in a manner effective to dissolve the desired solute in a solvent while preventing or limiting contact of the ore roof with the solvent and thereby eliminate the potential contamination by undesirable (inorganic and/or organic) solutes through dissolution of roof material. For example, in the case of trona mining, the method thereby reduces or even eliminates the potential contamination by undesirable chloride and/or solvent-soluble organic compounds.

In the case of mining of trona bed, the in situ solution mining method for trona mining according to the present invention generally uses a solvent in unlined borehole portion (s) positioned in a very large trona bed to dissolve the base of such trona bed in a manner effective to systematically undercut the trona bed making it susceptible to gravitational loading and crushing. The solvent dissolves the crushed trona and carries away dissolved trona which in turn creates a voided space (undercut) for more trona material to move into the voided space and be exposed to the solvent for dissolution. This process creates a large amount of trona surface area needed for meaningful production levels without the requirement of initial mechanical mining. By controlling the flow of solvent in a precise way, the entire trona block is eventually dissolved away from the floor up to the roof or up to proximity of the roof. Applicants thereby define such method as an in situ 'undercut' solution mining method. The undercut formation may travel in a bed with a dip gradient as the mining operation progresses, for example in a retreating mode as the undercut is initially formed down-dip at the base of the ore bed and continues to be formed in the up-dip direction, or in an advancing mode as the undercut is initially formed up-dip at the base of the trona bed, and continues to be formed in the down-dip direction. Since there is a migration of the undercut formation alongside the initial unlined boreholes or portions thereof over time, Applicants thus call this method, a 'traveling' undercut solution mining method.

For the mining of trona bed, the undercut solution mining method not only enables formation of a 'free face' in a trona ore bed and allows gravity to assist in the development of large amount of trona bed surface area for dissolution, but also prevents or minimizes chloride contamination of the liquor which can occur through contact with the roof rock.

A first embodiment according to the present invention relates to a method for in situ undercut solution mining of a subterranean ore bed, the ore bed comprising a desired solute being selected from the group consisting of sodium sesquicarbonate, sodium carbonate, and sodium bicarbonate, said ore bed having a floor and a roof, the method comprising the following steps:

injecting a solvent comprising water through an unlined borehole portion, said unlined borehole portion comprising a downhole end positioned within said ore bed and above said bed floor, said unlined borehole portion being horizontal or being slanted with one of its ends being at a higher elevation than the other end, in order to expose to the solvent an ore region within said unlined borehole portion or adjacent to said downhole end of said unlined borehole portion;

dissolving at least a portion of the desired solute, from said solvent-exposed ore region in a manner effective to form a liquor comprising said dissolved desired solute, and to further form an undercut above the bed floor, said undercut comprising at least a section of said unlined borehole portion which has been eroded by dissolution;

repeating the solvent injection to dissolve additional desired solute from the ore thereby enriching the liquor in desired solute, and further in a manner effective to widen the undercut and to trigger the fracture of unexposed ore disposed above said undercut and the downward movement of fractured ore rubble by gravity into the undercut, while allowing the ore roof to sag but not to break and preventing exposure of said solvent to chloride-containing material located at or above the ore roof so as to minimize chloride contamination of the liquor; and flowing the liquor towards a subterranean collection zone in order to pass said liquor to a terrain location.

A second embodiment according to the present invention relates to a method for in situ undercut solution mining of a subterranean ore bed, the ore bed containing a desired solute, the ore bed comprising a floor, the method comprising the following steps:

a) passing a solvent through a conduit positioned into an unlined borehole portion, the unlined borehole portion having a downhole end positioned within the ore bed, the conduit having a downhole injection zone positioned in the unlined borehole portion at a predetermined distance from the borehole downhole end;

b) injecting the solvent via the downhole injection zone in order to expose, to the solvent, an ore region adjacent to the downhole injection zone;

c) dissolving the desired solute from the exposed ore region in a manner effective to form a liquor comprising dissolved desired solute, the dissolving being effective in forming an undercut above the bed floor;

d) repeating steps (a)-(c) to enlarge the undercut by more dissolution of desired solute from solvent-exposed ore and to trigger the fracture of unexposed ore located above the undercut and the downward movement by gravity of fractured ore rubble into the undercut; and e) flowing the liquor down-dip by gravity towards a subterranean collection zone in order to pass the liquor to a terranean location.

The downward movement of fractured ore rubble by gravity into the undercut would allow the ore roof to sag but not to break thereby preventing exposure of solvent to chloride-containing material located at or above the ore roof so as to minimize contamination of the liquor by dissolved chloride.

The unlined borehole portion may be horizontal or being slanted with one of its ends being at a higher elevation than the other end. The unlined borehole portion is preferably not vertical.

A third embodiment according to the present invention relates to a method for in situ undercut solution mining of a subterranean ore bed, the ore bed containing a desired solute, the ore bed comprising a floor, a roof, two lateral edges horizontally opposite to each other, the method comprising the following steps:

a) passing a solvent through a conduit positioned into an unlined borehole portion, the unlined borehole portion having a downhole end positioned within the ore bed and further positioned at or proximate to one bed lateral edge, the conduit having a downhole injection zone positioned in the unlined borehole portion at a predetermined distance from the borehole downhole end;

b) injecting the solvent via the downhole injection zone in order to expose, to the solvent, an ore region adjacent to the downhole injection zone;

c) dissolving the desired solute from the exposed ore region in a manner effective to form a liquor comprising dissolved desired solute, and to further form an undercut above the bed floor, and to further allow fracture of unexposed ore located above the undercut and the downward movement by gravity of fractured ore rubble into the undercut; and d) collecting the formed liquor in a subterranean collection chamber; and e) passing the collected liquor from the subterranean collection chamber to ground surface.

A fourth embodiment according to the present invention relates to a method a method for in situ undercut solution mining of a subterranean ore bed, wherein the ore bed contains a desired solute (e.g., trona), and further comprises a floor, a roof, two lateral edges horizontally opposite to each other. The method comprises the following steps:

a) passing a solvent through a conduit positioned into an unlined borehole portion the unlined borehole portion having a downhole end positioned within the ore bed, the conduit having a downhole injection zone positioned in the unlined borehole portion at a predetermined distance from the borehole downhole end;

b) injecting the solvent via the downhole injection zone in order to expose, to the solvent, an ore region adjacent to the downhole injection zone;

c) dissolving the desired solute from the exposed ore region in a manner effective to form a liquor comprising dissolved desired solute, and to further form an undercut above the bed floor, and to further allow fracture of unexposed ore located above the undercut and the downward movement by gravity of ore rubble into the undercut; and d) collecting the formed liquor in a subterranean collection zone.

A fifth embodiment according to the present invention relates to a system for in situ undercut solution mining of a subterranean ore bed, the ore bed containing a desired solute, the ore bed comprising a floor, the system comprising:

a plurality of unlined boreholes (or portions thereof) bored through the ore bed from a first borehole end to a second borehole end, wherein the unlined boreholes are longitudinally aligned with the ore bed floor at an elevation above the ore bed floor;

a solvent feeding system;

at least one conduit positioned within each unlined borehole, wherein the conduit has a solvent injection zone in fluid communication with the solvent feeding system, wherein the conduit solvent injection zone is positioned at a predetermined distance from the second borehole end, wherein the conduit solvent injection zone is designed to inject a solvent to an ore region (e.g., at least a portion of the borehole walls) adjacent to the conduit solvent injection zone, wherein the conduit further comprises a means for moving the solvent injection zone alongside the unlined borehole;

a subterranean collection zone in fluid communication with the second ends of the unlined boreholes, wherein the subterranean collection zone is configured to collect a liquor resulting from the dissolution of the desired solute from each solvent-exposed ore region adjacent to each conduit solvent injection zone; and a pumping system in fluid communication with at least a portion of the subterranean collection zone, wherein the pumping system is designed to move at least a portion of the collected liquor to a terranean location.

A sixth embodiment according to the present invention relates to a method for in situ solution mining of an ore bed comprising a desired solute (e.g., mineral values) which uses the system or any of its various embodiments as described above and in the detailed description. An embodiment of the method of use of such system for in situ solution mining of a subterranean ore bed containing a desired solute (e.g., trona), in which the second borehole end may be positioned within a down-dip region or an up-dip region of the ore bed, may comprise the following steps:

a) passing a solvent from the solvent feeding system through said conduits to each conduit injection zone;

b) injecting the solvent via each conduit injection zone in order to expose, to the solvent, the ore regions which are adjacent to the conduit injection zones;

c) dissolving the desired solute from said exposed ore regions in a manner effective to form a liquor comprising dissolved solute, and to further form an undercut above the bed floor, and to further allow fracture of unexposed ore located above said undercut and the downward movement of fractured ore rubble by gravity into the undercut;

e) collecting the formed liquor in the collection zone; and f) moving the collected liquor to ground surface.

Various alternate or additional embodiments of the present invention are as follows.

The injection step may comprise laterally injecting the solvent in order to minimize injection of solvent in a vertical direction.

The method may further comprise: passing the collected liquor from the subterranean collection zone to ground surface, such as by pumping The method may further comprise: carrying out the dissolution of the desired solute under a pressure lower than hydrostatic head pressure. The dissolution of the desired solute may be carried out at hydrostatic head pressure after the undercut is formed.

The method may further comprise: injecting a compressed gas into the undercut while being formed.

The method may be further carried out in a batch mode, wherein the solvent is injected to fill up the unlined borehole portion and the formed undercut; and then the solvent flow is stopped so that the non-moving liquid solvent dissolves the desired solute until the solvent is saturated with desired solute, at which point the liquor is removed from the subterranean collection zone to the surface; and wherein once the undercut cavity is drained, the solvent injection resumes for the dissolution to be repeated.

The method may further comprise: injecting insoluble material in the undercut to form an insoluble deposit in order to alter the flow path of the solvent and/or to prevent solvent flow in at least one region of the undercut.

The method may further comprise: f) terminating at least the injection step and optionally the dissolution step when at least one of the following conditions is met:

i) the collected liquor has a content in desired solute below a minimum acceptable value;

ii) the collected liquor has a content in undesirable solute exceeding a maximum threshold value.

The undesirable solute may be sodium chloride and the collected liquor may contain 5% or less in sodium chloride content.

The method may further comprise: g) moving the injection zone of the conduit to another location within the borehole after performing step (f). Step (g) may be performed when at least one of the following conditions (i) and (ii) are met. Step (g) may be carried out to expose fresh ore to the solvent until the conduit injection zone is at a bed lateral edge opposite to the one when the solvent injection is initiated. Step (g) may be performed by at least one of the following steps: g1) retracting the conduit within the borehole thereby increasing the distance between the conduit extremity and the initial downhole end of the borehole; g2) perforating the conduit body along a pre-selected length moving upstream from the conduit extremity. The retraction step (g1) and perforation step (g2) may be carried out in a direction opposite that of the solvent flow path into the conduit.

The method may further comprise: h) resuming the injection step or resuming steps (b) and (c). Step (h) may be performed when step (g) is completed.

The method may further comprise: carrying out any of the previously described step (e), step (f), step (g), step (h), or any combinations thereof.

Additional embodiments of the solution mining method may comprise a 'traveling' undercut which may be an advancing undercut initiated up-dip and traveling down-dip, or a retreating undercut initiated down-dip and traveling up-dip. Applicants thus call this method as a 'traveling' undercut solution mining process, because the location of where the solvent is injected at the base of the ore is moved over time, the movement being from down-dip to up-dip or vice versa.

For a traveling undercut method, the method may further comprise performing any suitable method for changing the location of solvent injection in order to expose fresh ore to the solvent, such as performing at least one of the previously-described steps (g1) and (g2). Step (h) may be carried out until the location of solvent injection reaches an ore region near or at the up-dip lateral edge of the ore bed.

A seventh embodiment of the present invention relates to a solution counter-reaming method for creating a large cavity within an ore bed containing a mineral solute, and further comprising a roof and a floor. This method may comprise creating a lined portion of a borehole from the surface down up to the ore bed roof at a desired location, preferably within a down-dip region of the ore bed, and further extending the borehole with an unlined portion past the ore bed floor to form a sump in which a downhole pump is installed. The method further comprises drilling a small borehole by directional drilling from the surface to travel more horizontally, above the ore floor, within a region of the ore bed (preferably a down-dip region) until the sump is reached. The method further comprises inserting a conduit inside the small borehole and spraying high-pressure unsaturated solvent in all directions from the downhole end of the conduit to allow dissolution of mineral solute, thereby increasing the size of the borehole (e.g., increased cross-sectional area) and forming a cavity; retracting or perforating the conduit within the unlined borehole portion embedded in the ore bed; and repeating the solvent passing and spraying steps to continue the dissolution of the solute and to enlarge the formed cavity. This enlarged cavity may serve as the collection zone which is employed in some embodiments of the traveling undercut solution mining method and system of the present invention. The ore bed may be a virgin trona bed, and the solvent may comprise water such as an aqueous solution unsaturated in sodium values, or may be water.

The various non-limiting advantages of the present invention are as follows.

- it enables the efficient, safe, and productive extraction of mineral values, and particularly trona values, via in situ traveling undercut solution mining;
- it is particularly useful for the efficient production of mineral values from ore beds with limited vertical extent (not more than 30 feet) but large lateral extent (several thousand feet);
- it improves the overall safety of underground ore mining by removing personnel from the immediate area of ore extraction;
- it exploits the mineral resource at an overall extraction ratio far superior to any known mechanical method;
- it can be employed at very large scales;
- it can be applied, or otherwise adapted, to extract any soluble mineral deposits of a suitable character;
- it reduces or eliminates the need for mechanical mining;
- it can be operated remotely from within the same bed, a different bed, or the surface;
- it is sufficiently flexible as to be adaptable to steep gradients, thick beds, thin beds, and low quality beds;
- it can be adapted for mining at any orientation relative to the strike of the ore bed;
- it can be adapted to horizontal or rolling ore beds;
- it can be applied to beds at depths below surface that would otherwise be considered difficult or impossible to mine by known mechanical means; and/or
- it can be applied to multi-seam applications.

For trona mining in particular, the present invention reduces or eliminates the co-production of insoluble contaminants naturally occurring in trona deposits. Additionally or alternatively, the present invention as applied to trona mining is effective in preventing or reducing contamination of the resultant trona liquor by undesirable minerals and other soluble materials (such as chloride and oil shale components) commonly found in the roof rock above the trona and the shale layers often found in the upper portions of the trona beds.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions or methods do not depart from the spirit and scope of the invention as set forth in the appended claims.

BRIEF DESCRIPTION OF THE DRAWINGS

For a detailed description of the preferred embodiments of the invention, reference will now be made to the accompanying drawings which are provided for example and not limitation, in which.

DEFINITIONS AND NOMENCLATURES

Figure 1:
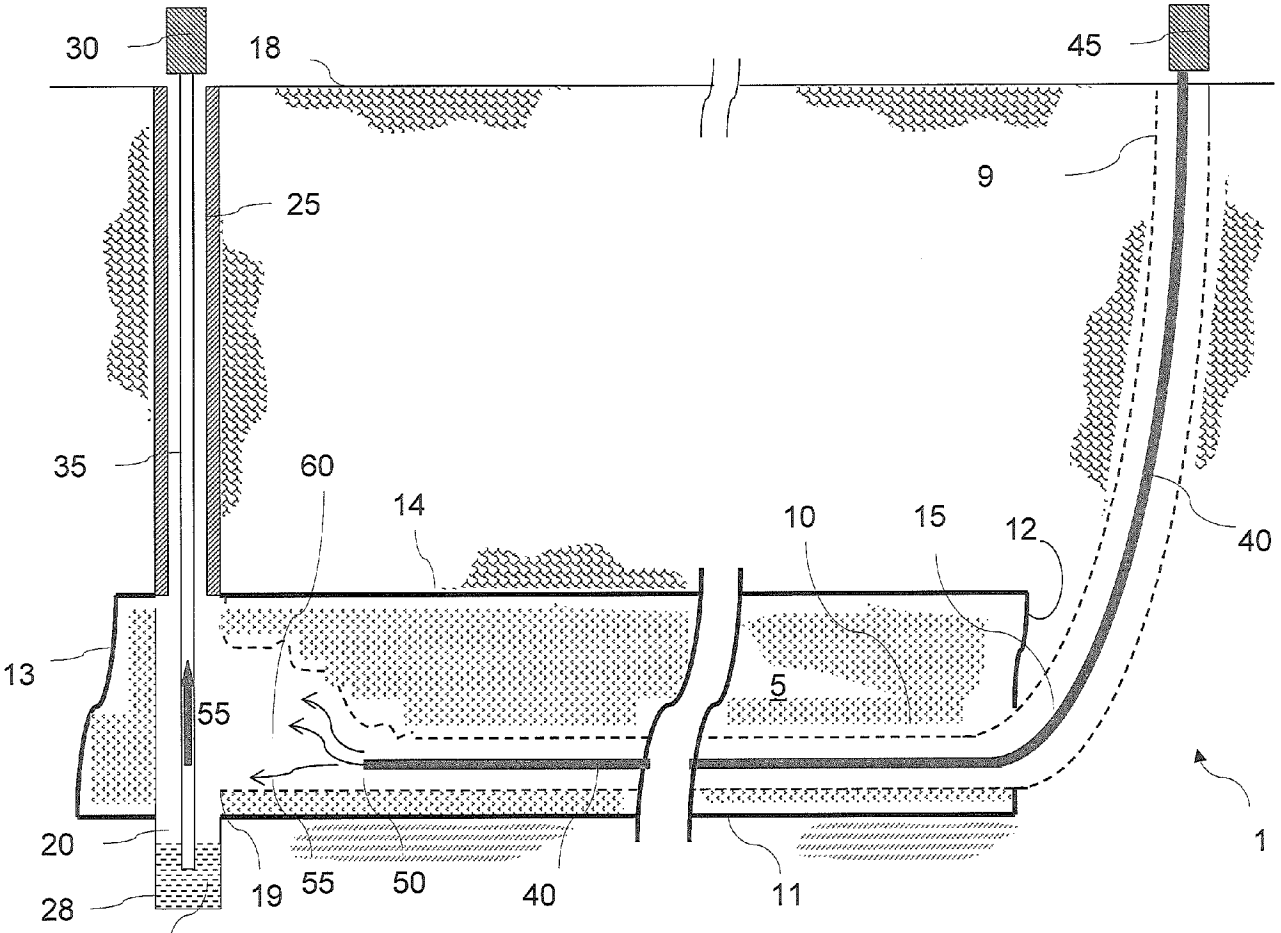
FIG. 1 illustrates a first embodiment of a system according to the present invention, wherein the system comprises a conduit positioned in a straight unlined borehole bored in an ore bed.

For purposes of the present disclosure, certain terms are intended to have the following meanings.

The term 'solvent-exposed' in front of 'trona', 'ore', 'area' or 'region' refers to any ore, trona, area, or region which has been in contact with the solvent during the in-situ solution mining process.

The term 'solute-lean' in front of 'trona', 'ore', 'area' or 'region' refers to any ore, trona, area, or region which has been in contact with the solvent during the in-situ solution mining process and which is leaner in the desired solute.

The term 'unexposed' or 'fresh' in front of 'trona', 'ore', 'area' or 'region' refers to any ore, trona, area, or region which has not been previously exposed to the solvent during the in-situ solution mining process.

The term 'virgin' in front of 'of 'trona', 'ore', 'area', or 'region' refers to any ore, trona, area, or region which has never been mined.

The term 'mined-out' in front of 'trona', 'ore', or 'area' refers to any ore, trona, or area which has been previously mined by a mechanical technique.

The term 'TA' or 'Total Alkali' as used herein refers to the weight percent in solution of sodium carbonate and/or sodium bicarbonate (which latter is conventionally expressed in terms of its equivalent sodium carbonate content). For example, a solution containing 17 weight percent $Na_2CO_3$ and 4 weight percent $NaHCO_3$ would have a TA of 19.5 percent.

The term 'liquor' represents a near-saturated or saturated solution containing solvent and dissolved desired solute (such as dissolved trona).

The term 'pregnant solution' represents the solvent carrying dissolved mineral or a desired solute (such as trona) as the solvent passes through the ore. The pregnant solution may be unsaturated in desired solute, or may be a liquor saturated in desired solute.

DETAILED DESCRIPTION OF THE PREFERRED EMBODIMENTS

Preferred embodiments of the present invention relate to systems and methods for in-situ solution mining, each of which applies a solvent to a subterranean ore comprising a desired solute in such a way to undercut the ore thereby allowing gravitational energy from the overburden to fracture fresh ore into nibbles and to move some of these rubbles of fresh ore into the undercut. This undercut in-situ solution mining indeed uses gravitational energy to induce fracturing, caving, sloughing, and crushing of the fresh ore into the undercut. This technique by ore dissolution causing ore undercutting and by gravitational energy causing caving creates a larger surface area of ore available for solvent exposure which would not otherwise exist using previous in-situ solution mining methods.

The present invention thus provides a means for eliminating or reducing contamination of liquor by the local application of a solvent flow in a specific region of the ore bed to form an undercut at the base of the ore bed and thereby allowing the crumbling and falling of fresh ore (ore rubble) from above this specific region by force of gravity into this undercut. This local application of solvent enables a more controlled crumbling/caving of fresh ore because the ore crumbling/caving is limited to a specific region of the ore bed thus allowing the roof to sag but not to break down.

This undercut mining method according to the present invention can travel to an adjacent region of the ore bed, where the traveling of the undercut may be up-dip with a retreating undercut or down-dip with an advancing undercut.

In some embodiments of the present invention, the unlined boreholes or unlined borehole portions may be horizontal or may be slanted with their first ends being at a higher elevation than their second ends. Each unlined borehole (or a portion thereof) may be near parallel or slanted with respect to the longitudinal axis of the ore bed to be mined. Each unlined borehole portion is preferably not vertical. The plurality of unlined boreholes (or portions thereof) may be on the same plane, such as the same horizontal plane, but not necessarily. The plurality of unlined boreholes (or portions thereof) are preferably, albeit not necessarily, in a parallel arrangement. The plurality of unlined boreholes (or portions thereof) may be perpendicular or parallel to the longitudinal axis of the collection zone.

The unlined boreholes or portions thereof may have an internal diameter of at least from 3 inches (7.6 cm) or at least 4 inches (10.1 cm); and/or at most 50 inches (127 cm) or at most 20 inches (50.8 cm).

The unlined boreholes or portions thereof are positioned within the bed ore but are preferably drilled above the ore bed floor to be spaced at a certain distance above the ore bed floor. The unlined boreholes or portions thereof are preferably positioned within the bottom third of the ore bed thickness.

The unlined borehole portions may be formed by a directional drilling method. The unlined borehole or portion thereof may comprise lateral (directionally drilled) side branches to favor the lateral widening of the undercut during solvent injection and dissolution.

In some embodiments of the present invention, parallel unlined boreholes or portions thereof are initially not in fluid communication with each other until their respective undercuts created from their initial borehole locations by dissolution merge into an undercut slot which allows fluid communication between them.

In alternate embodiments of the present invention, parallel unlined boreholes or portions thereof are initially in fluid communication with each other, by either having lateral side branches intersecting adjacent unlined borehole portion(s), or by having a common borehole end which is connected by unlined curved sections to each of the parallel unlined boreholes.

In alternate or additional embodiments of the present invention where the ore bed has a first lateral edge and a second lateral edge, and where the second lateral edge is horizontally opposite to the first lateral edge, each first borehole end may be located near the first lateral edge of the ore bed, and each second borehole end may be located near the second lateral edge of the ore bed. When the second lateral edge is the down-dip edge of the bed, the second borehole end is preferably the downhole end of the unlined borehole or portion thereof.

For any and all embodiments of the present invention, it should be understood that instruments can be periodically passed down the boreholes and/or conduits to determine how far the undercut has progressed, such as monitoring extent of surface subsidence and rate of subsidence. Directional rods comprising surveying tools may be inserted into cavities and the data may be compared with initial hole survey to determine opening dimension of the undercut.

The solvent feeding system may comprise a manifold, a subterranean cavity near the terranean surface, or a subterranean cavity near the ore bed.

When the solvent injection is carried out by a conduit, the following additional or alternate embodiments may apply. Conduits positioned into unlined borehole portions have a smaller diameter than these unlined borehole portions, such as for example, from 2 to 15 inches (5-38 cm) in diameter or 3 to 10 inches (7.6-25.4 cm) in diameter, or 3 to 7 inches (7.6-17.8 cm) in diameter. The solvent feeding system is hydraulically connected to one extremity of the conduit. The conduit injection zone may be designed to laterally inject the solvent in order to disperse solvent in a substantially horizontal manner and to avoid injection of solvent in a vertical direction. The predetermined distance from each conduit injection zone and each second (downhole) borehole end may be at least 10 feet (3 m), or at least 25 feet (7.6 m), or at least 50 feet (15.2 m), and/or may be at most 750 feet (229 m), or at most 500 feet (152 m), or at most 400 feet (122 m). The downhole injection zone may be a downhole conduit extremity and/or a series of perforations on the conduit body. The downhole injection zone allows for the injection of solvent from the inside of the conduit to the outside of the conduit. The downhole injection zone may comprise a portion of a conduit which is positioned inside an unlined borehole (or an unlined portion thereof) embedded in the ore bed above the ore floor. It is further conceived that, as an actively caving undercut slot is created, a concentric conduit can be mechanically retreated back through the unlined borehole or a portion thereof, or otherwise perforated with a downhole perforating tool in order to expose the solvent to fresh ore (i.e., not previously exposed ore), or any other suitable means or methods for moving the solvent injection zone may be used.

The system may further employ a means for moving the downhole injection zone, which allows the solvent injection to move alongside the borehole over time. The means for moving the downhole injection zone may include a means for retracting the conduit (generally in an intermittent fashion), and/or a perforating tool which allows the (generally intermittent) formation of perforations along a preselected length of the conduit body while the system is in operation.

With respect to any or all embodiments of the present invention, low to moderate working pressures may be utilized to limit the solvent ability to contact the roof of the ore bed. The working pressure may be lower than the head of pressure residing at the location of the conduit injection zone (e.g., second (downhole) conduit extremity). A low to moderate solvent working pressures (below the hydrostatic pressure at the depth at which the undercut is formed) used during undercut formation may also serve to prevent solvent backflow towards the ground surface inside the unlined borehole or portion thereof.

The collection zone may comprise a sump which may be at a lower elevation than the ore bed floor. The sump may be configured to collect the liquor and may be hydraulically connected to a pumping system. The collection zone may be formed by a directional drilling method. The collection zone may be enlarged by mechanical means (e.g., under-reamer) and/or by chemical means (e.g., a solution counter-reaming technique). In some embodiments, the collection zone may be created before the undercut is formed or after the undercut is formed. The collection zone may be positioned near the downhole borehole end or positioned intermediate between the borehole end and the vertical injection point.

With respect to any or all embodiments of the present invention, the ore to which such in-situ undercut solution mining method may be any suitable ore containing desirable mineral solutes. Preferably, the ore contains virgin trona, mined-out trona, or any deposit containing sodium carbonate, more preferably virgin trona. When the ore bed may comprise trona, particularly virgin trona, the desired solute may be sodium values, such as sodium sesquicarbonate, sodium carbonate, and/or sodium bicarbonate. A trona bed may have a thickness of from 5 feet to 30 feet (1.5-9.1 m), or may be shallower with a thickness from 5 to 15 feet (1.5-4.6 m), and may be located at a depth of from 800 to 2000 feet (244-610 m) below the surface.

The liquor collected in the subterranean collection zone is preferably saturated in desired solute. In the case of trona mining, the liquor collected in the subterranean collection zone is preferably saturated in sodium carbonate and/or sodium bicarbonate.

In any or all of the embodiments of the in situ solution mining method and system according to the present invention, the solvent may be water or an aqueous solution comprising a desired solute (e.g., alkali values). The desired solute may be selected from the group consisting of sodium sesquicarbonate, sodium carbonate, sodium bicarbonate, and mixtures thereof. The solvent employed in such in-situ undercut solution mining method may contain or may consist essentially of water or an aqueous solution unsaturated in desired solute. The water in the solvent may originate from natural sources of fresh water, such as from rivers or lakes, or may be a treated water, such as a water stream exiting a wastewater treatment facility. The solvent may be caustic. The aqueous solution in the solvent may contain a soluble compound, such as sodium hydroxide, caustic soda, any other bases, one or more acids, or any combinations of two or more thereof. The solvent may be heated to a predetermined temperature to increase the solubility of one or more desired solutes present in the ore. In the case of trona bed, the solvent may be an aqueous solution containing a base (such as caustic soda), or other compound that can enhance the dissolution of trona in the solvent. The solvent may comprise at least in part an aqueous solution which is unsaturated in the desired solute, for example an unsaturated solution which is recycled from the same solution-mined ore bed which may be undergoing undercut formation and/or from another solution-mined ore bed which may be undergoing undercut formation.

The solvent employed in an in-situ undercut trona solution mining method may comprise or may consist essentially of a weak caustic solution for such solution may have one or more of the following advantages. The dissolution of sodium values with weak caustic solution is more effective, thus requiring less contact time with the trona ore. The use of the weak caustic solution also eliminates the 'bicarb blinding' effect, as it facilitates the in situ conversion of sodium bicarbonate to carbonate (as opposed to performing the conversion ex situ on the surface after extraction). It also allows more dissolution of sodium bicarbonate than would normally be dissolved with water alone, thus providing a boost in production rate. It may further leave in the undercut an insoluble carbonate such as calcium carbonate which may be useful during the mining operation.

It should be noted that the composition of the solvent may be modified during the course of the solution mining operation. For example, in the case of trona mining, water as solvent may be used initially to start the undercut formation, while sodium hydroxide may be added to water at a later time in order to effect for example the conversion of bicarbonate to carbonate during the mining process, hence resulting in greater extraction of desired alkaline values from the trona bed.

The injection of solvent may be performed into two or more parallel unlined borehole portions positioned in the trona bed to allow the formation of two or more parallel undercuts. This injection of solvent into two or more parallel unlined borehole portions may be performed sequentially or simultaneously.

The temperatures of the injected solvent can vary from ambient temperature to 220° F. (104° C.). The solvent temperature may be between 0° F. and 200° F. (17.7-104° C.). A solvent with a temperature between 100 and 220° F. (37.8-104° C.) or between 100 and 150° F. (37.8-65.6° C.) or between 60 and 90° F. (15.6-32.2° C.) may be used. The higher the solvent temperature, the higher the rate of dissolution at and near the point of solvent injection. The solvent temperature may change from its point of injection as it gets exposed to underground ore to eventually approach or match the temperature of the ore when the liquor (or pregnant solution) reaches the collection zone. Because the liquor extracted from the mined area is preferably at saturation and has an equilibrated temperature with the underground ore, the level of saturation in the desired solute defined by such temperature will remain unchanged throughout the undercut formation and production, thus providing a liquor with a constant content in desired solute (e.g., sodium values). In that way, the liquor content in desire solute does not fluctuate over time during the formation and operation of the undercut.

The solvent may be injected in an up-dip direction or in a down-dip direction.

The solvent injection is preferably carried out in a manner effective to initially favor the lateral widening of the undercut and thereafter favor the upward widening of the undercut. In some embodiments, the injection of solvent is performed through a conduit concentrically positioned inside at least a section of the unlined borehole portion.

The solvent flow may vary depending on the size of the undercut, such as the length of its flow path inside the undercut, the desired time of contact with ore to dissolve the desired solute from the free face of the ore, as well as the stage of undercutting whether it be nascent for ongoing formation or mature for ongoing production. For example, the solvent flow rate for each borehole portion may vary from 11 to 228 cubic meters per hour ($m^3$/hr) [50-1000 gallons per minute]; or from 13 to 114 $m^3$/hr (60-500 GPM); or from 16 to 45 $m^3$/hr (70-200 GPM); or from 20 to 25 $m^3$/hr (88-110 GPM).

The dissolution generally leaves a layer of insolubles at the bottom of the formed undercut, such insolubles layer being above the fractured ore and providing a (porous) flow channel in the undercut for the liquor to flow therethrough.

The dissolution of the desired solute may be carried out under a pressure lower than hydrostatic head pressure, or be carried out at hydrostatic head pressure. The pressure may vary depending on the depth of the target ore bed. The dissolution of the desired solute may be carried out under a pressure lower than hydrostatic head pressure (at the depth at which the undercut is formed) during the undercut formation. The dissolution of the desired solute may carried out at hydrostatic head pressure after the undercut is formed, for example during a production phase in which the voided space in the formed undercut containing fractured ore rubble is filled with liquid solvent. The pressure may be at least 0 psig (102 kPa), or at least 300 psig (2170 kPa), or at least 700 psig (5410 kPa). The pressure may be at most 4500 psig (31128 kPa), or at most 1200 psig (8375 kPa), or at most 1100 psig (7686 kPa). The pressure may range from 0 psig to 4500 psig (101-31128 kPa); or from 0 psig to 2000 psig (101-13890 kPa); or from 0 psig to 1200 psig (101-8375 kPa); or from 300 psig to 1200 psig (2170-8375 kPa); or even from 700 to 1100 psig (5410-7686 kPa).

The method may further comprise injecting a compressed gas into the undercut while being formed. The method may further comprise stopping injecting the compressed gas into the undercut which was formed near the floor of the ore bed, then filling out all of the undercut cavity with solvent, and producing a liquor saturated in desired solute.

The method may comprise an undercut formation phase where the undercut cavity is not filled with liquid, followed by a production phase where the undercut cavity is filled with liquid.

The solvent injection may be moved to another virgin ore region when the voided undercut approaches or reaches the ore roof. Indications for moving the solvent injection may be when an unacceptable level of an undesirable solute (contaminant) is detected in the collected liquor, and/or when the level of desired solute in the liquor is insufficient for production of refined products from the collected liquor. For example in the case of trona mining, when the sodium chloride content in the collected liquor exceeds 5% and/or when the TA content is less than 8%, the solvent injection zone may be moved to fresh trona.

It is envisioned that liquor aliquots may be analyzed continuously or intermittently for desired solute content as well as for contaminant levels. For example, in the case of the trona solution mining, liquor aliquots may be analyzed for TA content and chloride content. Rising chloride contents in successive liquor aliquots may be used as an indication that the undercut is approaching the roof rock and that the solvent injection should be moved to expose a new region of fresh trona. The solvent injection may be moved by creating a new injection hole, by changing the location of the downhole extremity of a concentric conduit, or by perforating at least a section of the concentric conduit body.

The solution mining method may be carried out in a continuous mode, in which the solvent is injected and passed through the unlined borehole portion and thereafter through the undercut cavity, so that the moving solvent dissolves the desired solute further cutting the exposed free face of the ore, while at the same time the resulting liquor is removed from a down-dip location of the ore bed to the surface.

The solution mining method may be carried out in a batch mode, which may be termed a 'cut-and-soak' mining method. The solvent injection is initiated to fill up the unlined borehole portion and/or the undercut cavity and then stopped, so that the non-moving solvent dissolves the desired solute further cutting the exposed free face of the ore until the solvent gets saturated with desired solute, at which point the resulting liquor is removed from a down-dip location of the ore bed to the surface. Once the undercut cavity is drained, solvent is injected again and the batch process (filling cavity, stopping solvent flow, dissolution, collection) is repeated. The injection point may need to be moved to another ore location such as a location downward or upward from the previously-used injection point depending on whether the undercut formation is advancing or retreating. In this manner, this 'cut-and-soak' mining method may be operated in cascade in several adjacent fresh ore regions over time. The operation in cascade may be initiated up-dip and the injection point is moved down-dip over time. The solvent injection may be terminated when the down-dip edge of the undercut reaches the down-dip edge of the ore bed.

With respect to any or all embodiments of the present invention, a periodic (or intermittent or continuous) injection of insoluble materials (such as tailings) concurrently with the solvent may be carried out. The injection of insoluble materials may comprise: periodically mixing a specified amount of insoluble material with the solvent and injecting the combined mixture directly into the unlined borehole portion or a conduit concentrically positioned inside it; or injecting insolubles (e.g., tails or tailings) through a second conduit (other than the primary solvent conduit) which is inserted in each unlined borehole portion. Such injection of insoluble materials may form islands of insoluble material that would shift the solvent flow to fresh ore (e.g., virgin trona) and/or would form some support for the downward-moving roof. In this manner, a support system of insoluble material may be constructed to halt the roof movement to a desired point while flow channels created by dissolution of the solute in the ore region surrounding the insoluble material would allow for movement of the pregnant solution through this region of the ore. Deposits of insoluble materials (such as tailings) may also be employed to block certain flow pathways, especially those which may short-circuit passing over (or bypass) fresh ore, such as observed with the phenomenon of 'channeling' described later.

It is to be understood that, either due to the nature of the roof rock or through the way in which this process will gradually allow the roof to sag and lay down without much fracturing, liquor contamination from roof material may not be a major issue. Should this be the case, Applicants believe that the system can be operated much more aggressively in terms of solvent flow rates, undercut retreating or advancing rates, and the volume of ore rubble in production.

It is believed that, due to the dynamic nature of the in situ solution mining of the present invention, the solution mining of a trona bed using the traveling undercut method will not be hindered by the so-called 'bicarb blinding' effect, because there is a continual replenishment of fresh trona in the undercut for dissolution of sodium values and production of liquor.

For any or all embodiments of the present invention, some underground gas may be released when part of the overburden susceptible to gravitational loading and crushing cracks and falls into the undercut. This released underground gas may contain methane. Indeed, in the case of trona mining, even though the trona itself contains very little carbonaceous material and therefore liberates very little methane, a trona bed is generally underlain by a methane-bearing oil shale which liberates methane during mining. When such underground gas release occurs during undercut expansion, purges of the released gas may be performed periodically to remove the gas and relief pressure so as to prevent pressure buildup and/or to minimize safety concerns. It is recommended to stop solvent flow downhole during such gas purge. Purge of released gas may be effected by passage to the surface via the already-formed boreholes used for solvent injection, preferably through an injection borehole positioned up-dip (since gas moves upwards). Alternatively, the purge of released gas may be effected by one or more secondary purge wells. The downhole section of the one or more secondary purge wells is preferably in fluid communication with the upper part of the undercut, thus allowing fluid communication with the ore being mined and the purge well. To achieve such communication, the purge well downhole section may be drilled though the shale layer and the ore roof.

The invention will now be described with reference to the drawings.

FIG. 1 is a cross-sectional view in a schematic form of a system 1 for carrying out the in-situ solution mining of an ore bed 5, such as a trona bed. The ore bed 5 comprises a floor 11, a first lateral edge 12, a second lateral edge 13, and a roof 14.

The floor 11 is vertically opposite to the roof 14. The second lateral edge 12 is horizontally opposite to the first lateral edge 13.

Figure 2:
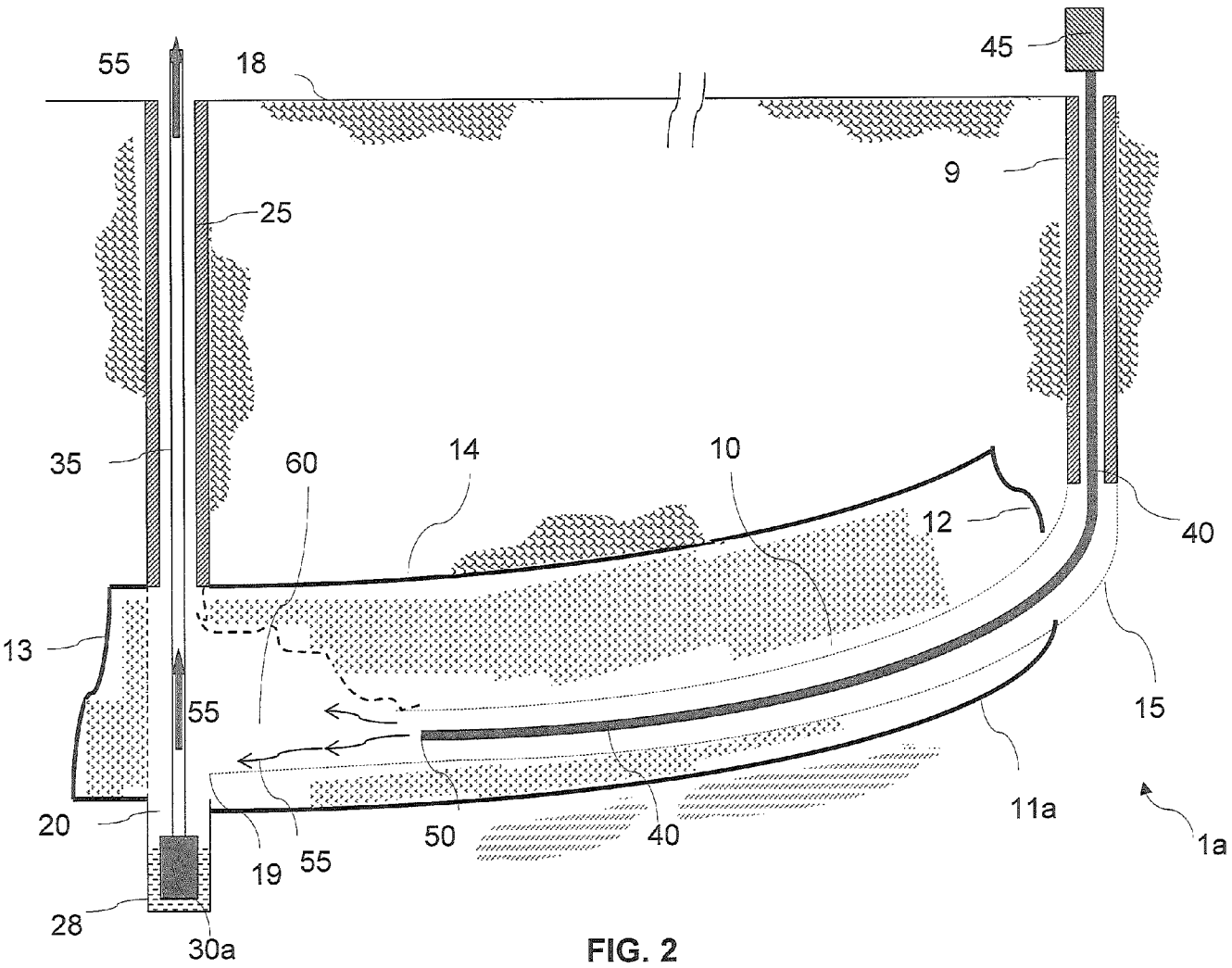
FIG. 2 illustrates a second embodiment of a system according to the present invention, wherein the system comprises a conduit positioned in a slanted unlined borehole bored in an ore bed.

To construct the system 1, a first directional borehole 9 is drilled to a predefined elevation above the floor 11 of the ore bed before directional borehole drilling commences. The first directional borehole 9 may be slanted (as illustrated in FIG. 1) or may extend substantially vertical (as shown in FIG. 2). The drilling continues in a different direction to form a second directional borehole 10 within the ore bed 5 and substantially horizontal to the bed floor 11. The second directional borehole 10 is drilled, generally down dip, for example to a region where a collection zone 20 may be already present or created.

The second directional borehole 10 is preferably longitudinally aligned with the ore bed floor 11 at a depth above but proximate to the ore bed floor 11. Generally, the positioning of borehole 10 is within the bottom third of the thickness of the ore bed 5 (defined as the vertical distance on average between the roof 14 and floor 11 along the entire ore bed length). The second directional borehole 10 may extend substantially horizontal (as illustrated in FIG. 1) or be slanted (as illustrated in FIG. 2). The second directional borehole 10 has a first end being located near or at the first lateral edge 12 of the ore bed 5. The second directional borehole 10 has a second end 19 which may be located near or at the second lateral edge 13 of the ore bed, although not necessarily. The second end 19 is preferably the downhole end of the borehole. The second directional borehole 10 is hydraulically connected to the collection zone 20, via its second end 19. The fluid communication of the borehole 10 with the collection zone 20 to may allow fluid to exit the borehole 10 via the second end 19 and directly enter the collection zone 20.

In order to maintain the integrity of the borehole 10 where it passes through the ore bed, a solution of fully saturated liquor should be used during the drilling process to remove cuttings from the borehole 10. In the case of trona, the use of unsaturated aqueous drilling fluid is not recommended as an unsaturated solution will erode the borehole 10 as it is being drilled causing instability and potential caving of the borehole 10 that may render this borehole ineffective.

Although a series of bores is described above for completion of boreholes 9 and 10 via radius 15, the drilling step is generally performed with one continuous drilling operation. As such, the boreholes 9 and 10 may represent in practice two portions of a continuous drillhole, one portion thereof having a more vertical alignment, and another portion thereof having a more horizontal alignment.

It should also be understood that, should the length of the ore exceed that what is feasible with directional drilling techniques, another vertical borehole may be drilled and then directionally drilled horizontally up-dip to meet with the second end 19 of the borehole 10 in order to extend the borehole length beyond what is feasible with the initially-drilled borehole 10.

Figure 3:
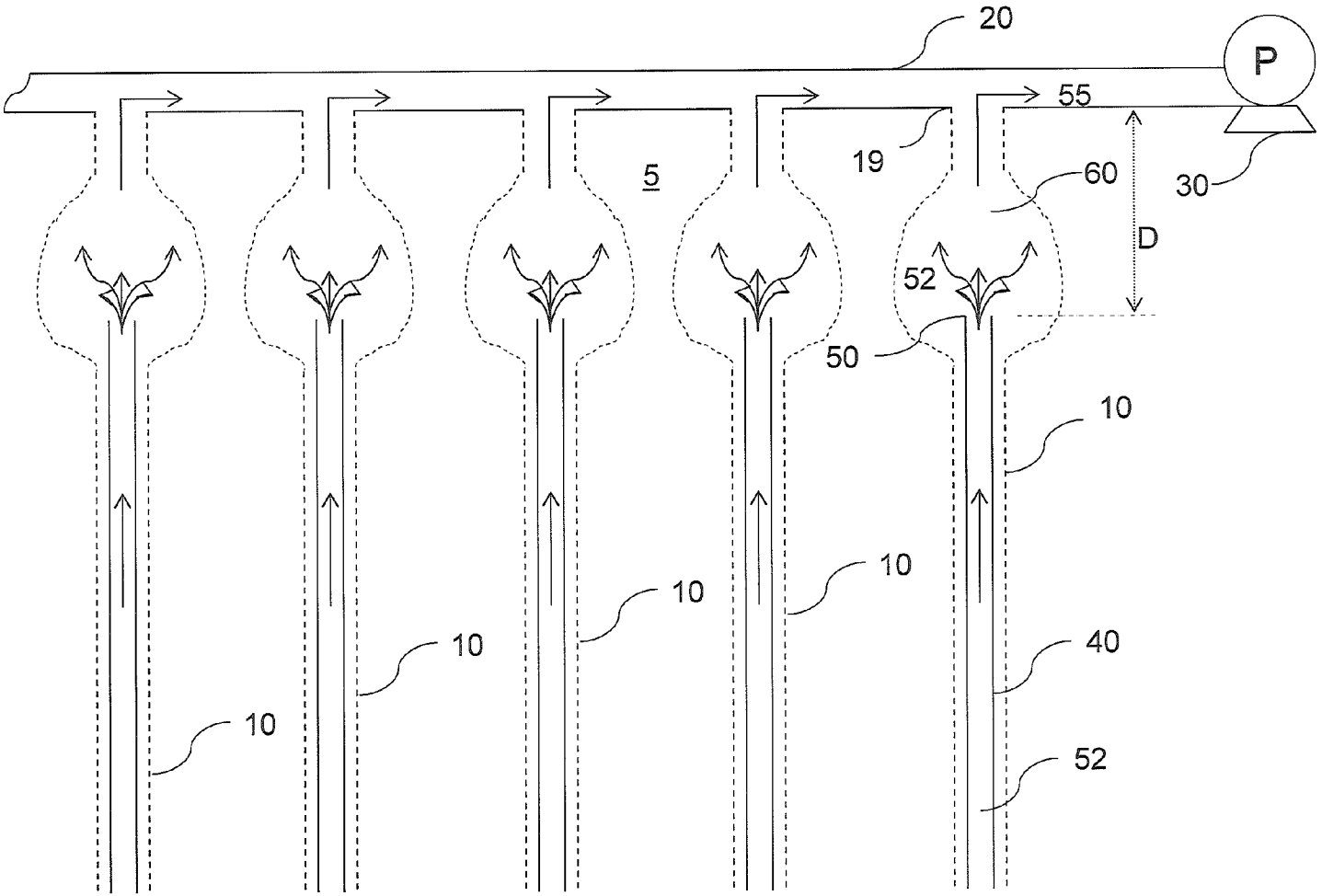
FIG. 3 illustrates a third embodiment of a system and its operation according to the present invention, wherein the system comprises a plurality of parallel boreholes, and wherein the operation creates a plurality of voided zones.

Although FIG. 1 illustrates a single continuous string of boreholes 9 and 10 via radius 15, it is to be understood that a plurality of drilling operations from several locations of the terranean surface 18 to one or more subterranean locations adjacent to or close to the first lateral edge 12 of ore bed 5 can generate a plurality of these boreholes. FIG. 3 for example illustrates a plan view of an arrangement of a plurality of boreholes 10 which are substantially parallel to each other and perpendicular to the longitudinal axis of the collection zone 20. Preferably but not necessarily, this plurality of boreholes are crossing the ore bed therethough from one lateral edge to the opposite lateral edge of the ore bed 5.

Referring back to FIG. 1, a third directional borehole 25 is drilled from the terranean surface 18 to a predetermined subterranean location, generally in the ore bed 5. It may be desirable for the predetermined subterranean location to be adjacent or in proximity to the second lateral edge 13 of the ore bed 5. The third directional borehole 25 may extend from the terranean surface 18 to this subterranean location in a substantially vertical manner (as illustrated) or with a slant (not illustrated).

The first directional borehole 9 and the third directional borehole 25 may be lined or left bare, but preferably are lined with casing to prevent erosion of these more vertically-aligned boreholes. The second directional borehole 10 is not lined, as most of (or all of) this borehole 10 is embedded in the ore, and it is intended for this borehole to be eroded by dissolution during the in situ solution mining.

The subterranean location to where the third directional borehole 25 extends may be an already existing cavity, in instances for example where the trona bed may be located next to an already-mined area where cavities from mechanical mining have been formed.

Generally however, the collection zone 20 is created to connect the subterranean end of the third directional borehole 25 to the second end 19 of the borehole 10. The formation of the collection zone 20 may be by mechanical means (such as direction drilling) and optionally by chemical means (such as solution mining with a progressive and localized application of solvent within the ore bed).

For creating the collection zone 20 by mechanical means, it is envisioned that a fourth directional borehole (not shown) extending the third directional borehole 25 may be drilled towards the second end 19 of the borehole 10, preferably substantially horizontal but not necessarily, until the end 19 of the borehole 10 is encountered. Once the fourth directional borehole meets borehole 10, the directional drilling can continue, preferably alongside and in close proximity to the second lateral edge 13 of the ore 5, so that the fourth directional borehole is substantially horizontal and parallel to the lateral edge 13 of the ore bed 5. Such drilling is preferably done within the ore bed 5. The fourth directional borehole can be enlarged to create an elongated cavity, thereby creating the collection zone 20 which is longitudinally aligned with at least a portion of (or preferably all of) the lateral edge 13 of the ore 5 at a depth generally proximate to or below the ore bed floor 11. It is envisioned that, as illustrated in FIG. 1, the roof of the collection zone 20 may extend vertically up to the roof of the ore 5. Alternatively, several smaller and interconnected horizontal boreholes may be substituted in lieu of a single cavity of larger diameter to serve as the collection zone.

The collection zone 20 may be formed by multiple interconnected boreholes or by a single large borehole.

Figure 8:
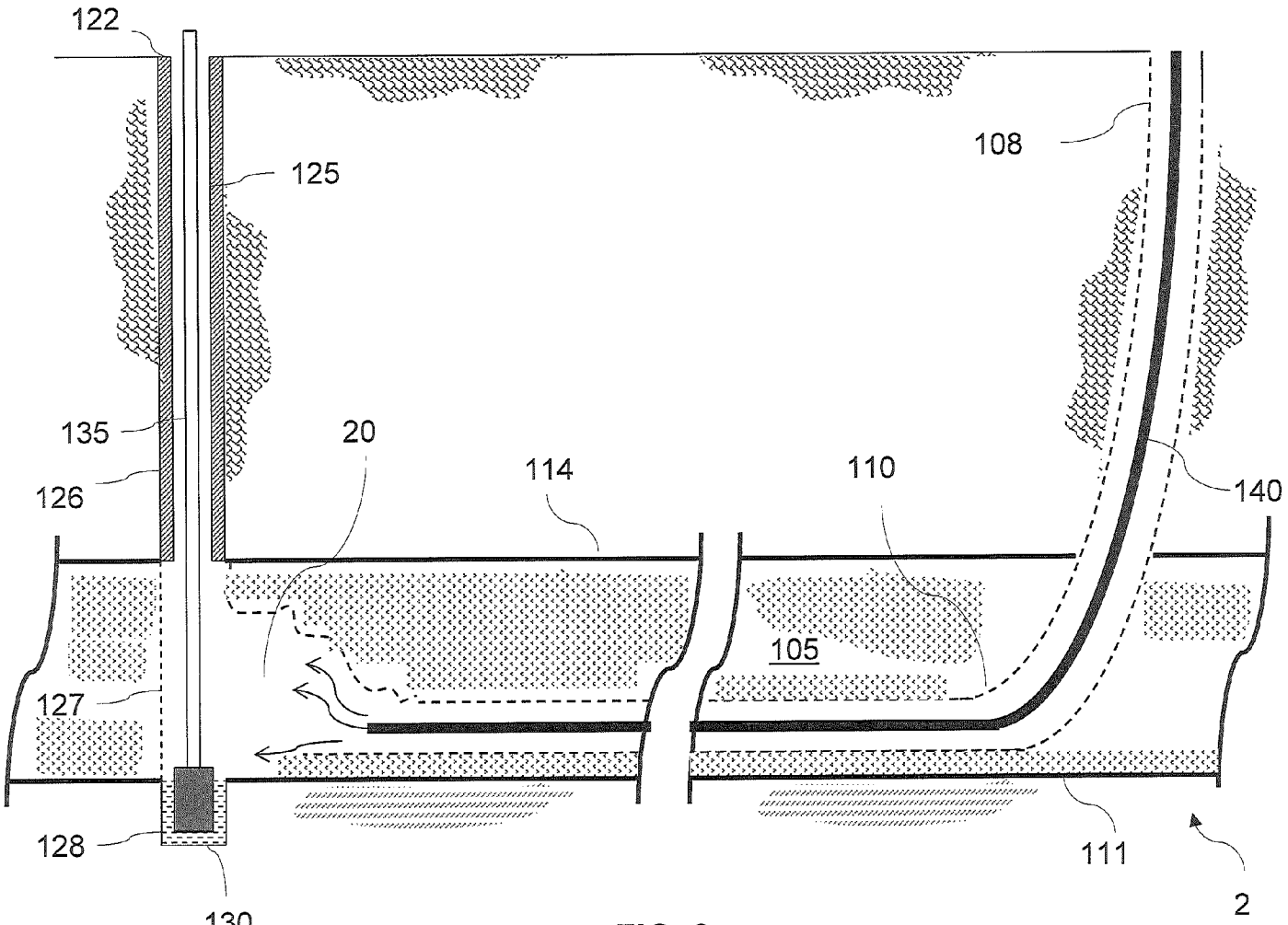
FIG. 8 illustrates an eighth embodiment of a system and its operation for in situ solution mining according to the present invention, wherein a solution counter-reaming technique is employed to create a large cavity into a ore bed comprising a mineral solute.

A mechanical under-reamer or a chemical counter-reaming technique may be employed to form such an enlarged cavity. For example, it is envisioned that, for enlarging the collection zone 20, the chemical counter-reaming technique may comprise spraying high-pressure unsaturated solvent from the end of a conduit positioned within a small borehole which has been drilled within a down-dip region of the ore bed, the spraying allowing dissolution of solutes within the sprayed ore thereby increasing the size of the borehole (e.g., increased cross-sectional area), and then retracting the conduit to continue the dissolution process until a sufficiently large cavity is formed and can serve as the collection zone 20. FIG. 8 illustrates a counter-reaming system to perform this technique, and will be described in greater detail later.

A region of the collection zone 20 may have a lower elevation (greater depth) than the ore floor 11. For example, the collection zone 20 may be a subterranean cavity which contains a sump 28 as shown in FIG. 1 (or sump 128 as shown in FIG. 8 described later) with a lower elevation (greater depth) where fluid exiting the borehole 10 can collect.

The collection zone 20 may also extend a certain distance past the lateral edge 13 of the ore bed 5, so that this recessed portion of the collection zone 20 may be set aside from the ore bed 5. This recessed portion may contain the sump 28 which lies at a greater depth (i.e., lower elevation) than the rest of the collection zone 20, so as to allow liquor to pool.

The collection zone 20 may have a tunnel shape (such as substantially cylindrical in form) or any ovoid shape. The collection zone 20 generally has a cross-sectional area greater than that of the third directional borehole 25.

A pumping system 30 is installed so that the liquor 55 can be pumped to the surface for recovery of the alkali values. Suitable pumping system 30 can be installed at either end of a return pipe 35 which is positioned within the inside of the third borehole 25. This pumping system 30 might be a 'terranean' system from the surface (as illustrated in FIG. 1) or an 'in-mine' system at bed level (as illustrated in FIG. 2).

The return pipe 35 may be extended into the collection zone 20. The return pipe 35 may be extended into the recessed region (e.g., sump 28) of the collection zone 20. The pumping system 30 can be connected to the return pipe 35 to allow the liquor 55 (e.g., a solvent enriched in total alkali values) to be pumped to the terranean surface 18 for recovery of the desired solute (e.g., one or more alkali values).

A conduit 40 is inserted inside the boreholes 9 and 10. The conduit 40 may be inserted while the boreholes 9 and 10 are drilled, or may be inserted after drilling is complete. The conduit 40 may comprise a tubing string, where tubes are connected end-to-end to each other in a series in a somewhat seamless fashion. The conduit 40 may comprise or consist of a coiled tubing, where the conduit 40 is a seamless flexible single tubular unit. The conduit 40 may be made of any suitable material, such as for example steel or any suitable polymeric material (e.g., high-density polyethylene).

The conduit 40 has a first conduit extremity which is hydraulically connected to a solvent feeding system or zone 45, as shown in FIG. 1. The first conduit extremity may be positioned in proximity to the terranean end of the borehole 9, if the solvent feeding system or zone 45 is located at the surface.

The conduit 40 comprises a solvent injection zone in fluid communication with the solvent feeding system (or zone) 45. The conduit solvent injection zone is positioned at a predetermined distance from the second borehole end 19, and the conduit solvent injection zone is designed to inject a solvent to a borehole region adjacent to the conduit solvent injection zone. The conduit injection zone is preferably, albeit not necessarily, designed to laterally inject the solvent in order to avoid injection of solvent in a vertical direction. Low to moderate working pressures may be utilized to limit the solvent ability to contact the roof of the ore bed, that is to say, the working pressure is lower than the head of pressure residing at the location of the conduit injection zone. Low to moderate working pressures would also serve to prevent solvent backflow towards the surface inside the borehole.

The downhole injection zone may be a downhole conduit extremity (such as extremity 50) and/or a series of perforations on the conduit body. The downhole injection zone allows for the injection of solvent from the inside of the conduit to the outside of the conduit. The downhole injection zone may comprise a portion of a conduit which is positioned inside a borehole (or an unlined portion thereof) embedded in the ore bed above the ore floor.

In FIG. 1, the conduit 40 has a second extremity 50 which serves as or contains the solvent injection zone, and which is positioned at a predetermined distance from the second borehole end 19, and is designed to inject a solvent to the ore area in the vicinity of the second conduit extremity 50. The predetermined distance between the second conduit extremity 50 and the second (downhole) end 19 of the borehole 10 may be at least 10 feet, or at least 25 feet, or at least 50 feet. The predetermined distance may be at most 750 feet, or at most 500 feet, or at most 400 feet.

The system 1 may employ a means for moving the downhole injection zone, which allows the solvent injection to move alongside the borehole 10 over time. The means for moving the downhole injection zone may include a means for retracting the conduit and/or a perforating tool which allows the formation of perforations along a preselected length of the conduit body while the system is in operation. The means for retracting and the perforating tool are generally used in an intermittent fashion, whenever there is a need to move the location of solvent injection.

The second conduit extremity 50 may have any variety of means for injecting solvent, such as open pipe end, nozzles, apertures of various shapes such as elongated horizontal slits, and the like. It is to be noted that the second conduit extremity 50 may be directionally perforated, or otherwise altered, to direct the solvent in such a way so as to enhance dissolution laterally (in a horizontal manner) and avoid dissolution in a vertical manner. The second extremity 50 of the conduit 40 may have any suitable injection system which is designed to laterally inject the solvent in order to avoid application of solvent in a vertical direction.

In some embodiments of the present invention, the conduit 40 has the ability to be retracted or retreated back within the borehole 10 (and also within the borehole 9) in order to increase the distance between the second conduit extremity 50 and the second end 19 of the borehole 10. The retraction may be carried out by mechanical means.

In additional or alternate embodiments of the present invention, the conduit 40 has the ability to be perforated alongside the conduit body over a preselected length starting from the second conduit extremity 50 all the way back towards its first extremity. The perforating step may be performed in order to expose fresh ore in the region which is now adjacent to the perforated conduit body. The perforation of the conduit 40 allows passage of solvent from the interior of the conduit 40 to the exterior of the conduit 40.

The perforation of the conduit 40 may be carried out by positioning a perforating tool in the interior of the conduit, and operating the perforating tool to perforating the conduit body over a preselected length. The perforating tool can be moved back (i.e. towards the first conduit extremity) inside the conduit 40, so as to allow several perforations events to take place over the course of the mining operation. The perforating tool may be hydraulically actuated to perforate the conduit body. The perforation of the conduit 40 may also be carried out solely on the lateral sides of the conduit's body, so as to create perforations along one or more horizontal planes on the conduit lateral sides. This lateral perforating step is carried out to allow passage of solvent in a preferential lateral way through the formed perforations.

It should be understood that any suitable means for changing the location of solvent injection is contemplated in the present invention, and is not limited to the use of a retractable conduit or a downhole perforation tool.

The solvent feeding system 45 may be an 'in-mine' or subterranean solvent feeding system or zone located near seam level (not illustrated) or a 'terranean' solvent feeding system or zone located near the terranean end of borehole 9 (as illustrated in FIG. 1). For a subterranean position, the solvent feeding system or zone 45 may be a subterranean cavity which is hydraulically connected to the first extremity of the conduit 40. Alternatively, for either a subterranean or terranean position, the solvent feeding system or zone 45 may be a pump (shown in terranean position in FIG. 1) which is hydraulically connected to the first extremity of the conduit 40.

Regarding the operation of the system 1 of FIG. 1, the injection and solution mining process begins with the injection of the solvent via the solvent feeding system 45 into the conduit 40 for the solvent to flow therethrough under a predetermined low to moderate working pressure toward the second conduit extremity 50 (e.g., a working pressure which is lower than the head of water pressure at the second conduit extremity 50). Once the solvent exits conduit 40 via the second conduit extremity 50 and enters the unlined borehole 10, the desired solute present in the ore (e.g., trona) in this borehole region which is exposed to the solvent begins to dissolve. As the solvent gets impregnated with dissolved material, the solution gets heavy so that the pregnant solution flows by gravity through the remainder of the borehole 10 towards its second end 19. While the pregnant solution travels towards the borehole (downhole) end 19, more desired solute within this borehole region get exposed to the solvent and hence dissolves, further saturating the pregnant solution to form a liquor saturated or near-saturated with the desired solute (e.g., saturated or near-saturated with total alkali, in the case of trona ore). Once the pregnant solution is saturated, there is no longer dissolution of the desired solute.

Liquor 55 exiting the borehole 10 via borehole end 19 flows into the collection zone 20 where it gets pooled (for example in sump 28) and is then pumped out to the surface by the pumping system 30 via the return pipe 35. Liquor 55 which is either saturated or near saturated exits the mine for further processing, such as processing of its TA values in the case of trona.

Because of the mineral dissolution (e.g., trona) taking place in the vicinity of the second conduit extremity 50 of the conduit 40 all the way down to the borehole end 19, this solvent-exposed region of the ore bed 5 will increase in cross-sectional area. The dissolution of mineral (e.g., trona) from the solvent-exposed ore region is not only effective in forming a near-saturated or saturated liquor, but also is effective in forming a voided zone 60 (also called an 'undercut' or a 'free face') as shown in plan view in FIG. 3 for example. Under the force of gravity, fracture of higher-elevation virgin ore can take place above the undercut, and this fractured unexposed ore can move downward by gravity into this undercut. When ore cave-in occurs in the undercut, the pregnant unsaturated solution can dissolve more desired solute (e.g., trona) which is present in the caved-in virgin ore.

FIG. 2 illustrates another cross-sectional view in a schematic form of a variant system 1*a* for carrying out the in-situ solution mining of the ore bed 5, which is mostly similar in design and in operation to system 1 in FIG. 1. One of the differences in the system 1*a* is as follows: after the first directional borehole 9 is drilled vertically to a predefined subterranean location above the ore floor 11*a*, the second directional borehole drilling commences but not in a horizontal plane. The second directional borehole 10 is instead drilled substantially aligned with the undulating ore floor 11*a*, from an up-dip position to a down-dip position. The ore bed may dip at a grade of about 0.4% to 10%. In the case of a trona bed, the bed may dip for example at a grade of from about 0.4% to 2% or of from about 1% to 2%. In this system 1*a*, because the first lateral edge 12 of the ore 5 is up-dip (generally at a higher elevation than the second lateral edge 13 of the ore 5), the first end of the borehole 10 is also up-dip (e.g., at a higher elevation than the second end 19 of the borehole 10).

Additionally, the system 1*a* differs from the system 1 of FIG. 1 in that the pumping system 30*a* is positioned in a subterranean cavity in close proximity to or within the collection zone 20. For example, the uptake line of the pumping system 30*a* may be submerged into the sump 28, and the exit line of the pumping system 30*a* is hydraulically connected to the pipe 35 for return of the liquor 55 to the surface.

However, it should be noted that any of these pumping systems 30, 30*a* can be used interchangeably or in combination in any and all of the embodiments of the present invention. The selection of the pumping system is largely linked to the ore bed configuration and maintenance issues; for example the selection may be dictated by the size of the subterranean cavity available to the mining operator.

The operation of the system 1*a* of FIG. 2 generally proceeds in the same manner as previously described for the system 1 of FIG. 1, except for the previously noted difference in the pumping step which takes place near or within the collection zone 20, rather than at the terranean surface as described in FIG. 1.

It is envisioned in the context of the present invention that directional drilling in the ore bed, followed by controlled dissolution of the surrounding ore, could be used to 'mine' the large cavities required to facilitate liquor flow, pumping, and other applications necessary for operation. This would allow the development and operation of the system from a location far removed from the solution mining area itself, (perhaps a mechanically mined seam above the solution target bed, or even the surface). This has great advantages for both the safety of mine personnel and operating costs. Furthermore, remote operation can also lessen the impact due to uncertainties related to the mechanics of rock-mass response under the stresses of large-scale solution mining.

FIG. 3 illustrates a plan view of a system according to the present invention, in which the system comprises a plurality of boreholes 10, and a conduit 40 positioned within each borehole 10. Each conduit has a downhole injection zone (second extremity 50) able to inject solvent 52 into a downhole unlined portion of each borehole. The unlined portions of boreholes 10 are positioned in a parallel arrangement. In FIG. 3, the downhole unlined portions of boreholes 10 are aligned substantially parallel alongside the entire length of the ore bed from one lateral edge to the opposite lateral edge, and are substantially perpendicular to the longitudinal axis (not shown) of the collection zone 20. The term 'substantially' is used for borehole positioning, as it is meant to include some variation (within 10%) of the actual direction of the boreholes. Indeed, even though spatial determination for drilling can be quite accurate, it is expected than spatial variation may occur, and as such, a variance up to 10 degrees or less in the alignment of some portions of the boreholes is expected. However, in general, it is preferred that the overall longitudinal axes of the boreholes 10 are parallel to each other.

The spacing of these boreholes may be from 10 to 1000 feet apart or any suitable distance which can be determined by any technique known to one having ordinary skill in the art, including experimentation, testing and numerical modeling. The selection of the boreholes spacing will be dependent at least in part from at least one or more of the following: the composition of the ore, the solvent composition and temperature, the dissolution rate, the ore bed dip, or the presence (or not) of undesirable solutes in the roof material.

The downhole unlined portion of boreholes 10 preferably terminate in the collection zone 20 near or at the second edge of the ore bed within a pre-selected distance (e.g., 1 to 20 feet or 1 to 10 feet) from the ore floor. Each downhole end 19 of the boreholes 10 are hydraulically connected to the collection zone 20, and allow the liquor 55 to exit each borehole 10. Liquor 55 is pooled in the collection zone 20 and is then pumped out to the surface by the pumping system 30. As stated previously, the pumping system 30 may be a terranean or subterranean system.

The boreholes 10 may have a diameter ranging from 3 to 50 inches in diameter.

Conduits 40 positioned into these boreholes 10 have a smaller diameter than the boreholes 10, such as for example, from 2 to 15 inches in diameter, or from 3 to 10 inches in diameter, or from 3 to 7 inches in diameter. The extremities 50 of these conduits 40 are positioned at some predetermined distance D short of the borehole ends 19. The distance D at the start of the mining operation may vary from 10 to 750 feet, or from 50 to 400 feet.

A solvent feeding system (not shown in FIG. 3) may include a manifold to deliver solvent to each individual conduit 40, so that the flow and pressure of the solvent in each individual conduit 40 can be controlled.

The solvent 52, such as for example water or an aqueous solution unsaturated in desired solute (such as containing sodium carbonate, bicarbonate, and/or hydroxide), is then passed through the conduits 40. In a preferred manner, the pressure of the solvent 52 in the conduits 40 can be controlled in a manner effective to allow the solvent to exit the conduits at fairly low head of pressure. One should control the flow and pressure through the conduits 40 to ensure that the liquor 55 exiting the boreholes 10 into the collection zone 20 is fully saturated. The temperatures of the injected solvent 52 can vary from ambient temperature to 104° C. (220° F.). The higher the solvent temperature, the higher the rate of dissolution at and near the point of solvent injection.

For example, in the case of trona ore, hot water e.g., near 100° F. (37.8° C.) and/or a caustic soda aqueous solution may be used initially as the solvent to ensure saturation. Indeed, water heated to above ambient temperatures, e.g., ca. 100-110° F. (38.8-43.3° C.), will come to saturation fairly quickly when exposed to trona. Alternatively, caustic soda aqueous solution may be used to ensure saturation. As the pregnant liquor cools through contact with the trona, decahydrate will precipitate and thus will ensure that the pregnant solution is completely saturated at ambient temperature. This will further ensure that the solution will not act to dissolve or otherwise damage permanent structures developed in the trona bed. In this scenario, one can protect the collection zone 20 and the pumping system 30.

Referring back to FIG. 3, in the operation of this system, the solvent 52 flows through the conduits 40, preferably at low head pressure, to eventually exit the conduits 40 at extremities 50. The solvent immediately comes in contact with the ore (e.g., trona) in the borehole region adjacent to and in the vicinity of each extremity 50 at which point dissolution of desired solute in the solvent begins to occur. It is conceivable that the conduits 40 might be directionally perforated, or otherwise altered, to direct solvent in such a way so as to enhance dissolution laterally away, toward the neighboring conduits 40. As the desired solute or mineral (e.g., trona) near each extremity 50 of the conduits 40 is dissolved, the pregnant solution approaches saturation to form the liquor 55. The flow rate and temperature of the solvent 52 should be controlled to ensure saturation of the liquor 55 before collection in the zone 20. In alternate embodiments of the undercut method where the undercut might feed directly to a sump (not shown in FIG. 3), without or with the use of a collection zone, it is still not desirable to deliver unsaturated solvent to the sump.

Additionally, as dissolution takes place, several voided zones 60 (also called 'nascent' undercuts) are created by dissolution around each conduit extremity 50. It is preferred that the nascent undercuts 60 remain shallow in vertical extent (not more than 1 to 2 feet), but should be quite broad in lateral extent (e.g., a few hundred feet in width and a few thousands feet in length).

In instances where the roof material over the ore bed does not contain highly-soluble mineral contaminants or contains solely minerals of much lower solubility than the desired solute, the method could be operated at much higher pressures (e.g., static head pressure) and high flow rates of solvent.

Figure 4:
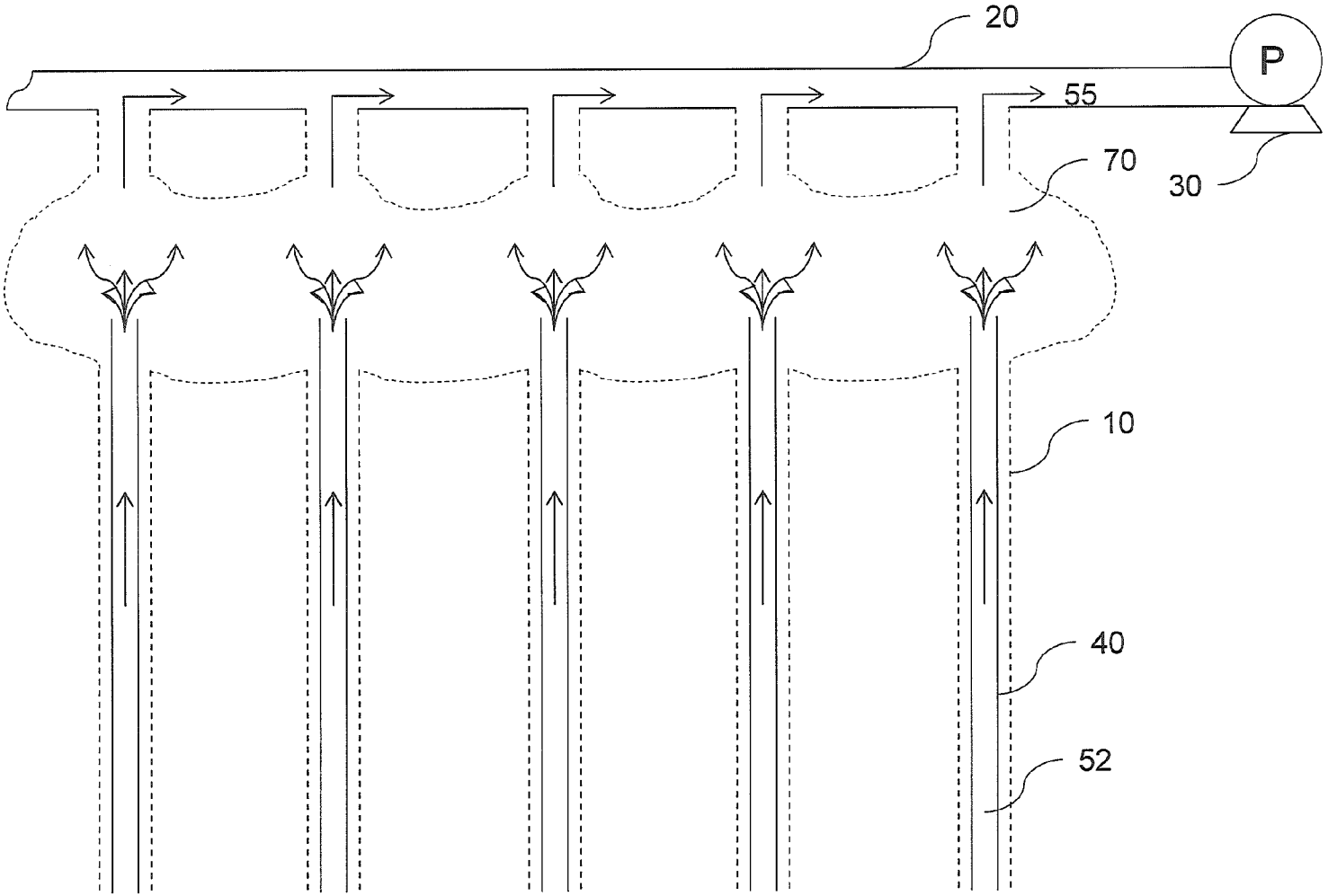
FIG. 4 illustrates a fourth embodiment of a system and its operation according to the present invention, wherein the system comprises a plurality of parallel boreholes, and wherein the operation creates a voided slot (undercut) which connects the plurality of voided zones.

The solution mining process continues until the nascent undercuts 60 around each conduit extremity 50 increase in circumference sufficiently for the nascent undercuts 60 to connect. In some embodiments, as illustrated in FIG. 4, in which the boreholes are positioned at optimal distance, the dissolved voided zones 60 connect to form a shallow undercut 'slot' 70 near or at the floor of the ore bed of sufficient horizontal span that the unexposed ore located overhead begins to slough off into the undercut slot 70. Additionally, the roof will eventually sag down as well, but the sagged roof cannot travel any further downward than the ore rubbles below the roof will allow.

It may be necessary to move the solvent injection zone, when the voided undercut approaches or reaches the ore roof. In practice, this may occur when an unacceptable level of an undesirable solute (contaminant) is detected in the collected liquor 55, and/or when the level of desired solute in the liquor is insufficient for production of refined products from the collected liquor, such as for example in the case of trona mining, when the sodium chloride content exceeds 5% and/or when the TA content is less than 8%.

Figure 5C:
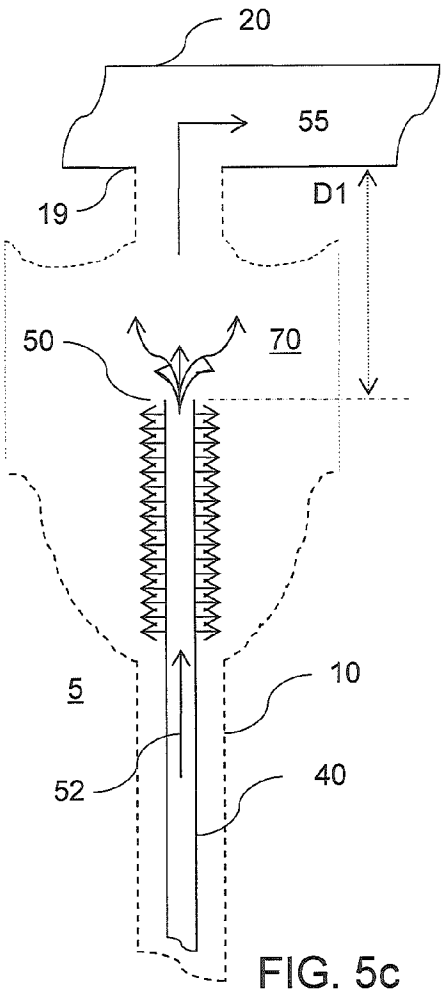
FIGS. 5*a*, 5*b*, 5*c* illustrates in a fifth embodiment various operation modes for in situ traveling undercut solution ore mining employing a retreating undercut according to the present invention, in which an undercut is created in a down-dip region of the trona bed as illustrated in FIG. 5*a*; wherein the injection zone is moved, either by retreating the solvent conduit in the borehole as illustrated in FIG. 5*b* and/or by forming perforations along a preselected length of the solvent conduit as illustrated in FIG. 5*c;*
Figure 5B:
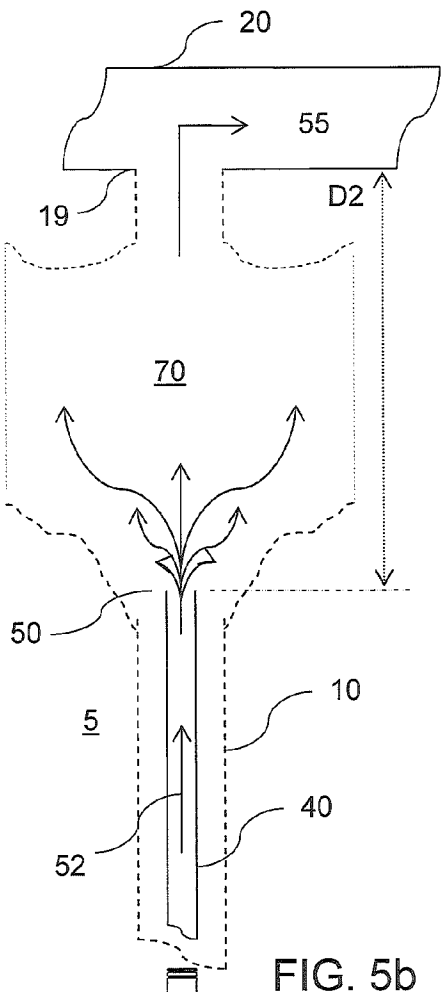
Figure 5A:
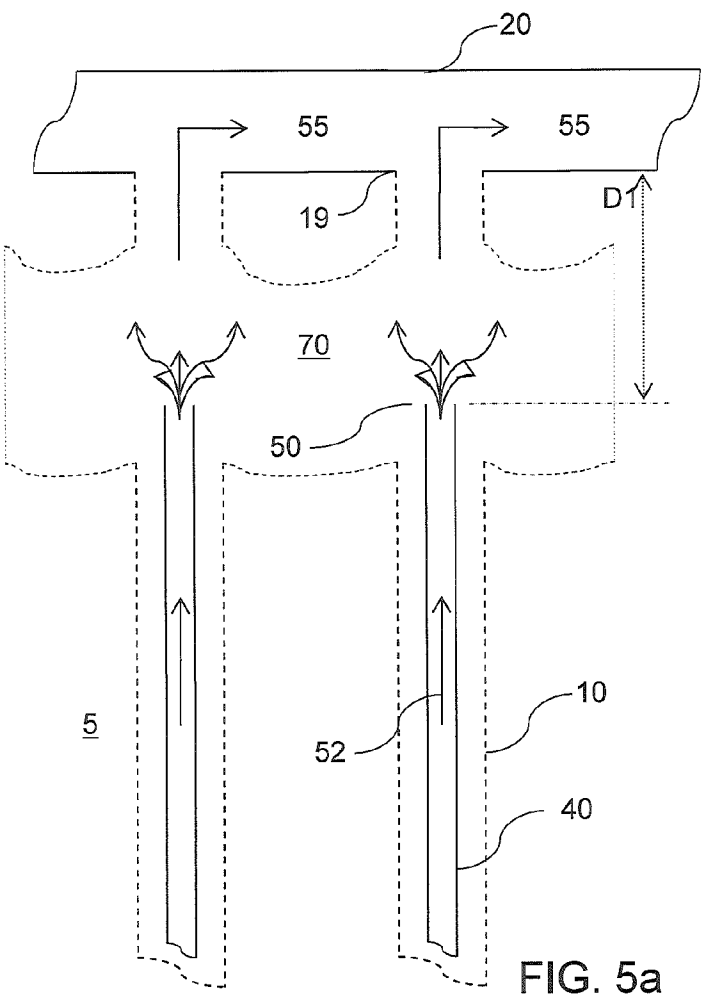

FIG. 5*a-c* illustrate non-limiting examples of suitable means for moving the location of solvent injection; however any suitable means for changing the location of solvent injection is contemplated in the present invention. In FIG. 5*a*, as described previously in FIG. 4, an undercut slot 70 is created in a down-dip region at the base of the ore bed 5, and expands laterally and vertically in volume, generally until it reaches the roof of the ore bed. To move the solvent injection zone, the conduits may be retreated back inside the borehole until the distance from the second extremity 50 to the borehole end 19 is increased from D1 to D2 as illustrated in FIG. 5*b* and/or can be perforated along a preselected length of its body as illustrated in FIG. 5*c*. The conduit partial retraction and/or the conduit localized perforation allows for exposure of solvent to fresh ore so that the process of undercut formation gets repeated.

Figure 6:
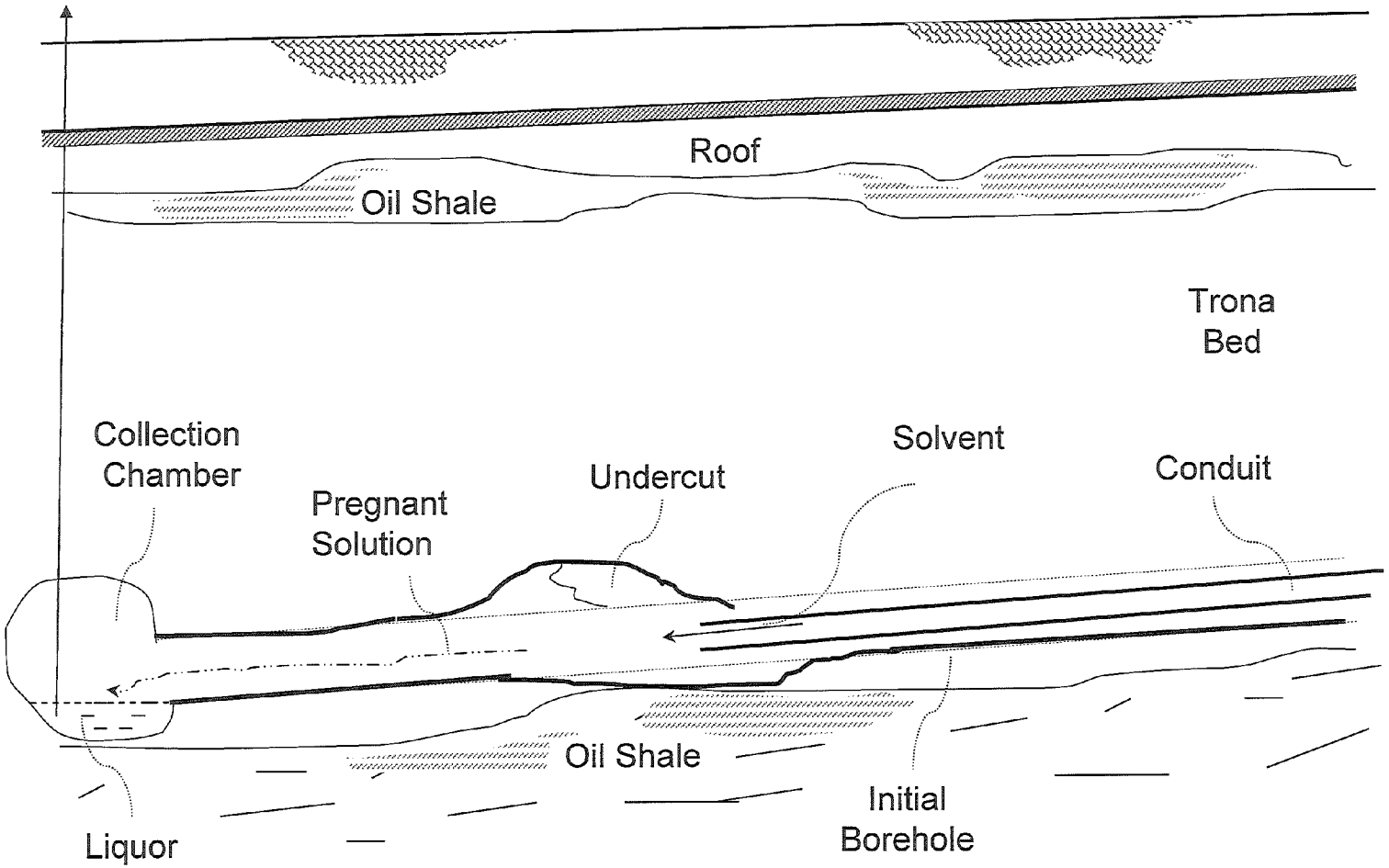
FIG. 6 illustrates a sixth embodiment of a system and its operation for in situ solution trona mining according to the present invention, wherein the operation creates a nascent undercut formation at the base of the trona bed.

FIG. 6 illustrates a retreating undercut system and its operation in solution trona mining. There is a nascent formation of an undercut created at the base of the trona bed by dissolution of trona ore. High running pressures will tend to erode the voided undercut slot vertically with the negative impact of potentially exposing the roof rock in an undesirable way, and also allowing unsaturated liquor to reach the collection zone. It is preferred for unsaturated solvent not to reach the collection zone.

Figure 7:
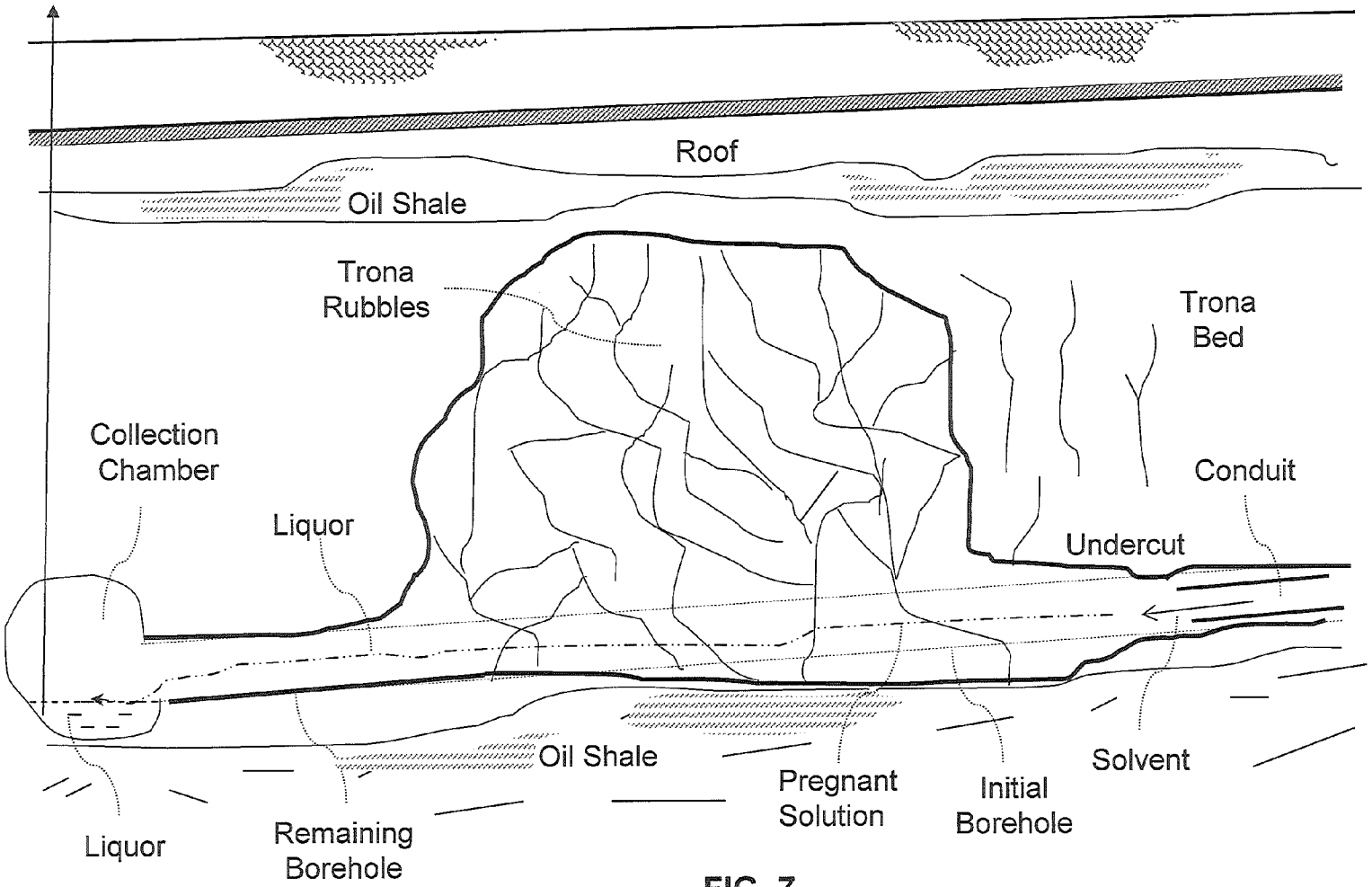
FIG. 7 illustrates a seventh embodiment of a system and its operation for in situ retreating undercut solution trona mining according to the present invention, in which the retreating undercut has progressed in an up-dip location of the borehole by the retraction of the conduit into the borehole.

FIG. 7 illustrates a progressed retreating undercut formation at the base of a trona ore. Over a certain period of time, there is formed a significantly large voided area (undercut slot) which is vertically positioned above the trona bed and which reaches (but preferably does not touch) the roof rock and/or the shale oil layer. The conduit is retracted from its initial downhole position to a more upstream position (that is to say, in a direction opposite that of the solvent flow path in the conduit), thereby increasing the distance between the second conduit extremity and the collection zone, in order to expose fresh trona to the solvent alongside the borehole at this more upstream location for the undercut technique to be repeated.

The retraction may occur when at least one of the following conditions is met: (i) the collected liquor contains an amount of the desired solute below a threshold value (that is to say, the undercut slot is very lean or depleted in trona); and/or (ii) the collected liquor contains an amount of the undesirable solute above a threshold value (that is to say, the undercut slot has contact with the roof rock and/or the shale oil layer). For the example of trona mining, the collected liquor may have a threshold value in TA of from 8 to 21%, and may contain sodium chloride as undesirable solute in the amount of 0-5%, 5% being the threshold value. A sodium chloride content of more than 5% in NaCl in the collected liquor would be indicative that the solvent is in contact with contaminated material near the roof, and that the conduit should be moved to a region of virgin trona. For the assessment of the undercut progression, successive liquor aliquots taken intermittently over a certain time period may be analyzed for contaminant content and/or desired solute content. An increasing contaminant (e.g., chloride) content and/or a decreasing content in desired solute (e.g., TA) in these successive liquor aliquots may be used, individually or in combination, as an indicator that the conduits which deliver the solvent should be retracted back into fresh trona. In preferred embodiments, when the chloride content in the liquor exceeds the maximum allowable amount (e.g., threshold value of 5% for sodium chloride) of this contaminant to ensure proper downstream processing, the solvent injection location is then moved to another (generally adjacent) virgin ore region. In alternative or additional embodiments, when the TA content in the liquor falls below the minimum allowable amount (e.g., a threshold value of 8% TA) of this desired solute to ensure economic and/or efficient downstream processing, the solvent injection location is then moved to another virgin ore region (generally adjacent to the one just mined) to expose fresh ore at the base of the bed.

According to further embodiments of the present invention, it is envisioned that enlarged cavities originating from a near horizontal borehole will be desirable for use in the present invention as a collection zone. It is further conceived that this could be accomplished in a soluble mineral bed through the use of high pressure solvent employed in a designed and controlled fashion.

For example, FIG. 8 illustrates an elevation view of a system 2, which can be used for forming and enlarging a horizontal unlined portion of a borehole 110 within a trona bed 105 which can serve as the collection zone 20 (as described above in the context of FIG. 1-7).

A vertical borehole 125 is drilled to penetrate the trona bed 105 at a desired location. The desired location is preferably within a down-dip region of the trona bed 105, such as for example a trona region proximate to the down-dip lateral edge of the trona bed 105 (for example, one face of this region may touch a part of the down-dip lateral edge, or may be a few feet away from this edge). A portion 126 of the borehole 125 is cased or suitably lined from the collar 122 to down the top 114 of the trona bed 105. The borehole 125 is further extended with an unlined portion 127 past the trona bed floor 111 to form a sump 128 in which a downhole pump is installed. A conduit 135 is positioned within the borehole 125 and is hydraulically connected the downhole pump 130 in the sump area 128 at the bottom of the borehole 125.

A directionally drilled borehole 108 is bored either vertically or slanted (as shown) from the surface and then directionally drilled in a more horizontal path to form borehole portion 110 through the trona bed 105 at a location where a large cavity (e.g., the collection zone 20) is desired. The borehole portion 110 is terminated at the sump 128 where the downhole pump 130 is located. The borehole 108 is preferably lined from the surface down to the top 114 of the trona bed 105, but left unlined in borehole portion 110 along the remainder of its length from that location all the way to the sump 128. Once the borehole 108 is completed, the drill string is withdrawn.

A solvent counter-reaming tool (not shown) is installed on the downhole end of the drill string. The counter-reaming tool and drill string are then reinserted down the borehole 108 until the tool is proximate to the termination of the borehole 108 near the sump 128. Solvent is then pumped down the drill string at the desired flow and pressure in such a manner that the solvent exiting the tool is sprayed into the borehole 108 in a desired pattern. The solvent spray dissolves away mineral from the area around the tool. The resultant pregnant solution flows in the sump 128 and pumped out to the surface with the pump 130.

As mineral is dissolved by the solvent spray which exits the counter-reaming tool, the quantity of solution and concentration of mineral solute pumped to the surface are monitored. Using this information it is possible to calculate how much volume of mineral has been dissolved away.

When the desired amount of mineral has been dissolved from around the tool, the drill string 140 may be retracted back at a predetermined distance and the solvent pumping and spraying steps are repeated until the operation creates an enlarged cavity of a sufficiently increased cross-section along the borehole portion 110 which is embedded into the ore bed 105 from the sump 128 up to the point where it no longer embedded in the bed 105.

Alternatively, instead of using the retreating solvent counter-reaming tool when the desired amount of mineral has been dissolved from around the initial solvent spray, the drill string 140 may be perforated along a preselected length via a downhole perforating tool to create more spray holes to spray solvent on trona alongside the portion 110 of borehole 108 and repeating the dissolution to erode and enlarge the portion 110 of the borehole 108, to create a large cavity which can serve as the collection zone 20 as illustrated in FIG. 1-7.

FIGS. 9, 10, 11*a-b*, 12*a-b*, 13*a-b*, 14*a-c*, 15*a-d*, 16*a-c*, and 17*a-g* illustrate various systems and methods for solution mining of an ore bed (e.g., trona bed) employing an advancing undercut formation.

Figure 9:
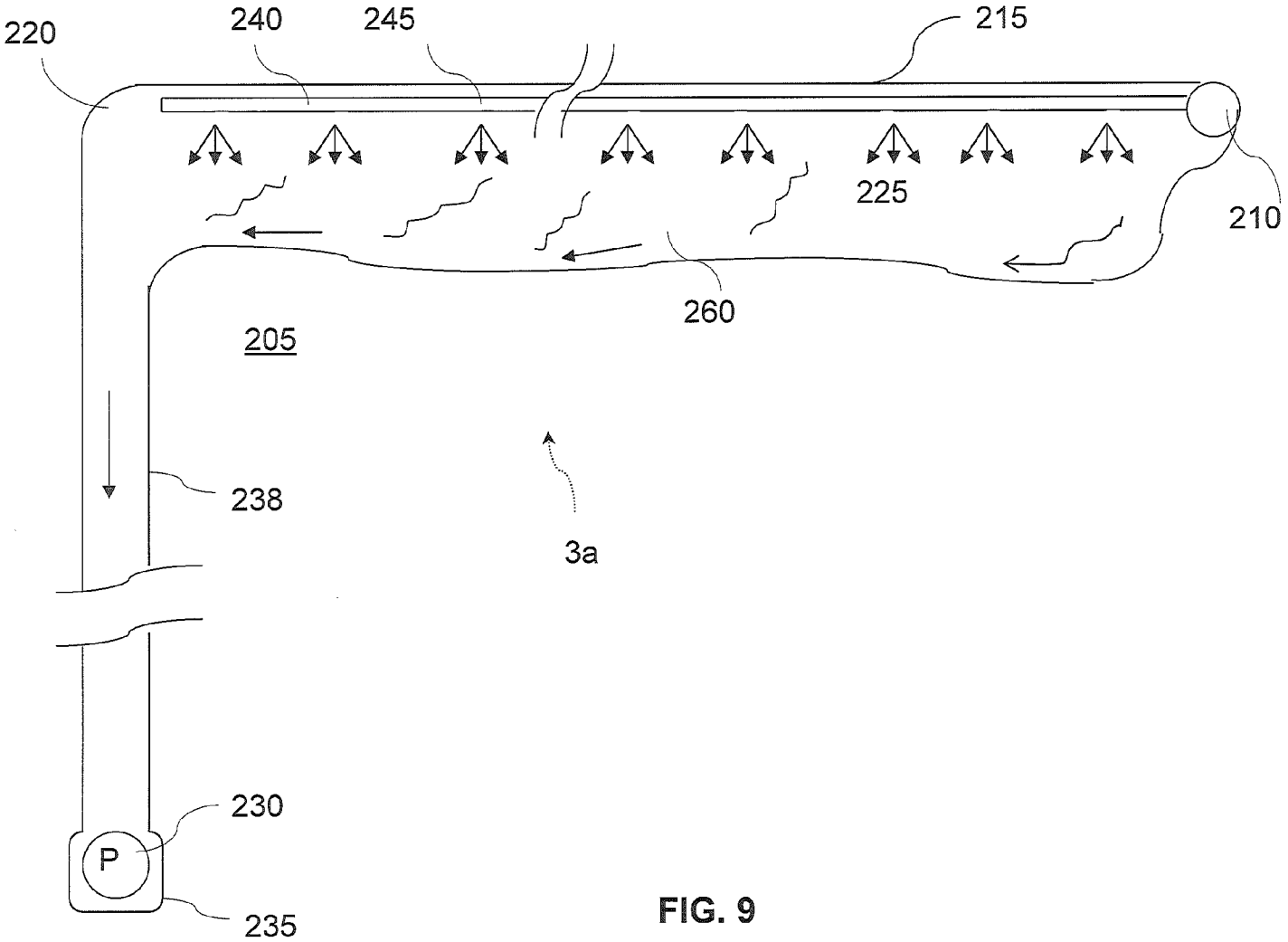
FIG. 9 illustrates a ninth embodiment of a system and its operation for in situ solution trona mining employing an advancing undercut according to the present invention.

FIG. 9 is a plan view of a system 3*a* which comprises an ore bed 205, a borehole 210 with unlined portion 215 and downhole end 220, a solvent 225, return drillhole 235 with a portion 238, a pump 230, a conduit 240 with apertures 245, and an undercut 260. The borehole 210 is drilled vertically to penetrate the trona bed 205 at a desired location. The desired location is preferably within an up-dip region of the trona bed 205, such as for example a trona region proximate to the up-dip lateral edge of the trona bed 205. A portion of the borehole 210 is cased or suitably lined from the surface to down the top of the trona bed 205. The borehole 210 is further extended with the horizontal unlined portion 215 directionally drilled within the trona bed above the bed floor, preferably alongside the up-dip lateral edge of the bed. Portion 215 of borehole 210 is preferably horizontal, but may also have a grade with the downhole end 220 preferably being down-grade.

The return drillhole 235 is drilled vertically to penetrate the trona bed 205 at a desired location, which is preferably within a down-dip region of the trona bed 205, such as for example a trona location proximate to the down-dip lateral edge of the trona bed 205. A portion of the drillhole 235 is cased or suitably lined from the surface to down the top of the trona bed 205. The drillhole 235 is further extended vertically with an unlined portion past the trona bed floor to form a sump in which a downhole pump 230 is installed. Another portion 238 of drillhole 235 is then directionally drilled into a more horizontal path through bed 205 until it meets the downhole end 220 of the borehole 210 to hydraulically connect the borehole end 220 with the sump area where the return pump 230 is located. Drillhole portion 238 is preferably unlined.

A conduit 240 is positioned within the borehole 210. The conduit 240 comprises along the portion of its length that is surrounded by the unlined portion 215 of borehole 210, apertures 245 configured for spraying a solvent, preferably in a lateral and down-dip direction. The apertures 245 are sized in such a manner to evenly distribute the solvent along the length of conduit 240 which is inserted in the borehole portion 215.

Solvent is then pumped down the conduit 240 at the desired flow and pressure in such a manner that the solvent exiting the apertures is sprayed onto the ore within the unlined borehole portion 215 in a desired pattern. The solvent spray dissolves away desired solute (trona) from this exposed ore region around the apertures, in a manner effective to form a liquor comprising dissolved solute, which then flows towards borehole end 220, passes through the drillhole portion 238 and collects into the sump, where it may be pumped to the surface via the pumping system 230.

The dissolution is also effective in forming the undercut 260 at the footwall of the borehole portion 215 at the floor of the ore bed 205. Due to the formation of this voided undercut and the pressure from the overburden, fracture of unexposed ore located above this undercut occurs and the ore ruble so created moves downward by gravity into the undercut 260. The solute in the ore rubble fallen into the undercut is exposed to the solvent and dissolves away. This solution mining process continues as the undercut 260 travels down-dip as dissolution progresses, and until the voided area reaches the ore roof.

Figure 10:
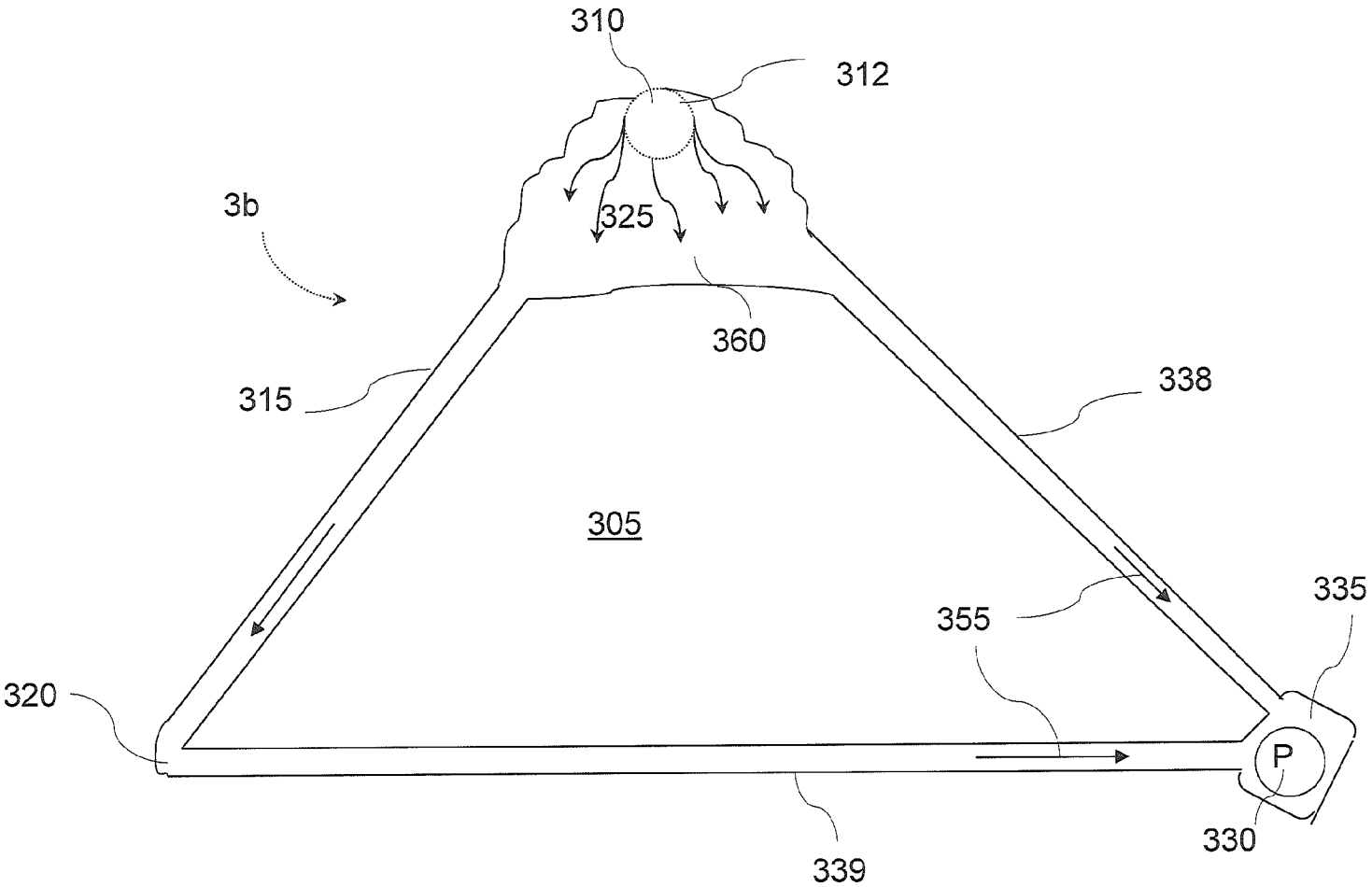
FIG. 10 illustrates a tenth embodiment of a system and its operation for in situ solution trona mining employing an advancing undercut according to the present invention.

FIG. 10 is a plan view of a system 3*b* which comprises a trona bed 305, a borehole 210 with one unlined portions 315 with a downhole end 320, a solvent 325, a return drillhole 335 with an unlined portion 338, a pump 330, and an undercut 360. Contrary to FIG. 9, the system 3*b* does not comprise a conduit for delivering a solvent to the ore bed.

The borehole 310 is drilled vertically to penetrate the trona bed 305 at a desired location 312. The desired location is preferably within an up-dip region of the trona bed 305, such as for example a trona region proximate to the up-dip lateral edge of the trona bed 305. The desired location 312 is within the bed, but slightly above the bed floor. The borehole 310 is cased or suitably lined from the surface to down the top of the trona bed 205. The borehole 310 is further extended with the horizontal unlined portion 315 directionally drilled within the trona bed above the bed floor. Unlined portion 315 of borehole 310 is preferably horizontal, but may also have a grade with its downhole end 320 preferably being down-grade.

The return drillhole 335 is drilled vertically to penetrate the trona bed 305 at a desired location, which is preferably within a down-dip region of the trona bed 305, such as for example a trona location proximate to the down-dip lateral edge of the trona bed 305. A portion of the drillhole 335 is cased or suitably lined from the surface to down the top of the trona bed 305. The drillhole 335 is further extended vertically with an unlined portion past the trona bed floor to form a sump in which a downhole pump 330 is installed. A portion 338 of drillhole 335 is then directionally drilled from the sump area into a horizontal path until it meets the downhole location 312 of the borehole 310 to hydraulically connect this location 312 of borehole 310 to the sump area. Another portion 339 of drillhole 335 is directionally drilled from the sump area into a horizontal path until it meets the downhole end 220 of the borehole 210 to hydraulically connect the borehole end 320 with the sump area. Portions 338 and 339 drilled into the ore are preferably unlined for allowing their erosion by dissolution.

No conduit is positioned within the borehole 310. Solvent is then pumped down the borehole 310 at the desired flow and pressure in such a manner that the solvent exiting at location 312 is contacting the ore. The solvent dissolves away solute (sodium values) from this exposed ore region around location 312, in a manner effective to form a liquor 355 comprising dissolved desired solute (sodium values), which then flows towards the sump area via unlined borehole portions 315 and 339, and/or via unlined portion 338. The collected liquor is pumped to the surface via the pumping system 330.

The dissolution is also effective in forming the undercut 360 at the footwall of the borehole location 312 at the base of the ore bed 305. Due to the formation of this voided undercut and the pressure from the overburden, fracture of unexposed ore located above this undercut occurs and the ore rubble so created moves downward by gravity into the undercut 360. The desired solute in the ore rubble fallen into the undercut is exposed to the solvent and dissolves away. This solution mining process continues as the undercut 360 travels down-dip as dissolution progresses, and until the voided area reaches the ore roof, and the desired solute in the ore bed region delimited by unlined borehole portions 315, 338 and 339 is entirely dissolved away.

FIG. 11*a-b*, 12*a-b* and 13*a-b* are elevation and plan views of a system 4 which comprises a trona bed 405 with a dip gradient, a plurality of first boreholes 435 and a plurality of second boreholes 410 with concentric casings and an unlined portion 415 aligned with the bed floor. The operation of such system 4 has several main phases of development: the drilling phase, the formation of an undercut initiated up-dip and traveling down-dip under static head pressure as described in relation to FIG. 11*a-b* and 12*a-b*, followed by a production phase as described in relation to FIG. 13*a-b* where a solution flows through the large undercut which crosses over the entire length of the target ore bed and creates a liquor which is collected and removed to the surface.

Figure 11A:
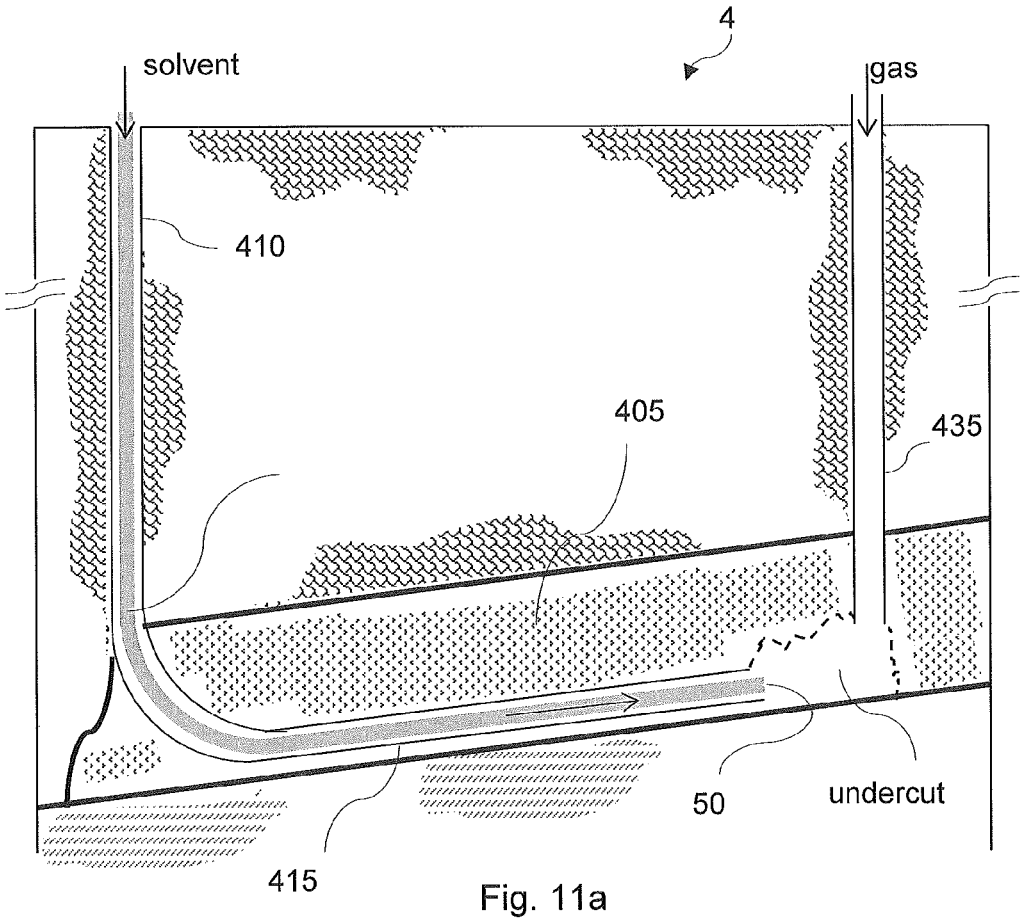
FIG. 11*a* and 11*b* illustrate an elevation view and a plan view of an eleventh embodiment according to the present invention, wherein the formation of an advancing undercut in an up-dip unlined portion of a borehole directionally drilled through an ore bed is initiated with the use of a concentric conduit positioned in a borehole and with an up-dip gas injection.
Figure 11B:
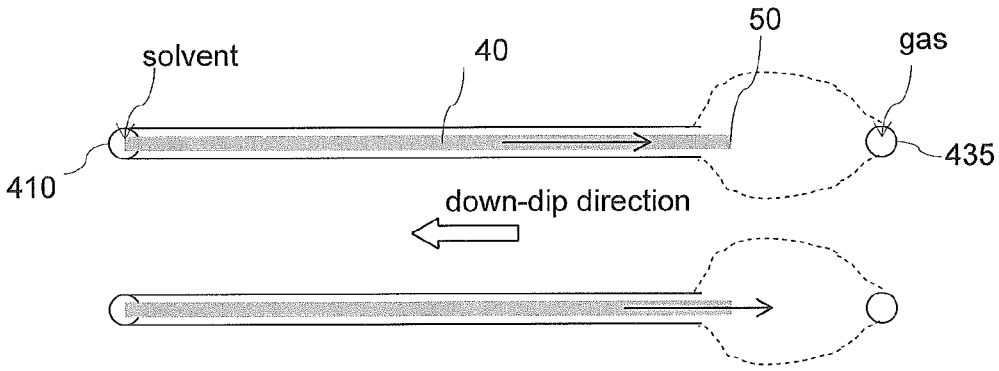

Referring to FIG. 11*a-b*, the plurality of first boreholes 435 are directionally drilled from an up-dip region of the bed 405 with single casings from the top of the bed 405 to approach or reach the floor of the bed. A same amount of second directional boreholes 410 are drilled from a down-dip part of the bed 405 with two concentric casings (an outer casing from surface to top of bed and an inner conduit 40 positioned inside each borehole 410) such that each downhole end of the boreholes 410 intercepts within the trona one of the previously drilled first boreholes 435.

To initiate the formation of the advancing undercut, a solvent (water or an aqueous solution containing sodium carbonate and/or sodium hydroxide) is injected in each inner conduit 40 positioned concentrically in the directionally drilled second boreholes 410 for the injected solvent to come in contact with fresh trona region adjacent to the downhole extremity 50 of each conduit 40. The solution is then collected in the outer casing and pushed to the surface.

By continuing injection and collection of the solvent as described above, the undercut is then being formed by dissolution of trona from solvent-exposed trona regions. At the same time as solvent flow is initiated, a compressed gas (such as comprising air, methane, nitrogen, or any suitable gas which is inert under mining conditions) is injected in each vertical first borehole 435 into the nascent undercut cavity. This gas injection allows the undercut formation to be carried out under static head pressure which is determined by the depth of the targeted bed 405, as a gas blanket forms at the top of the undercut formation. In this manner, the gas blanket protects the roof from dissolving and forces the dissolution in the horizontal direction rather than vertical.

Figure 12A:
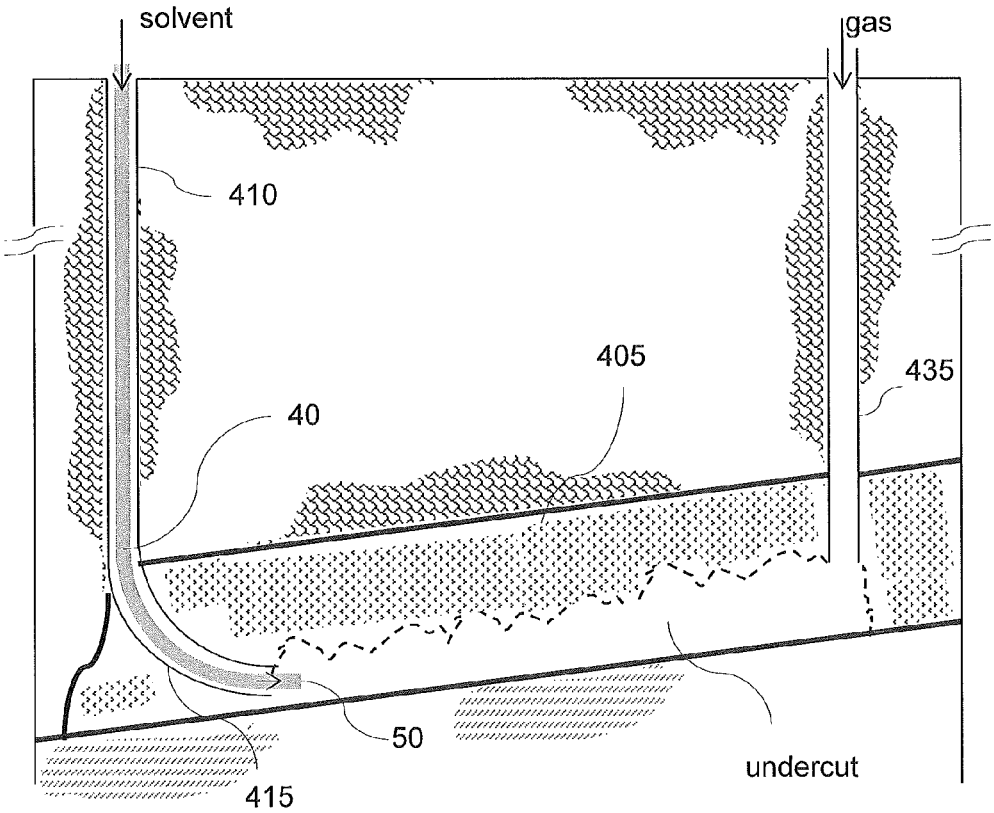
FIGS. 12*a* and 12*b* illustrate an elevation view and a plan view of the progression of the advancing undercut formation with gas injection as shown in FIG. 11*a-b;*
Figure 12B:
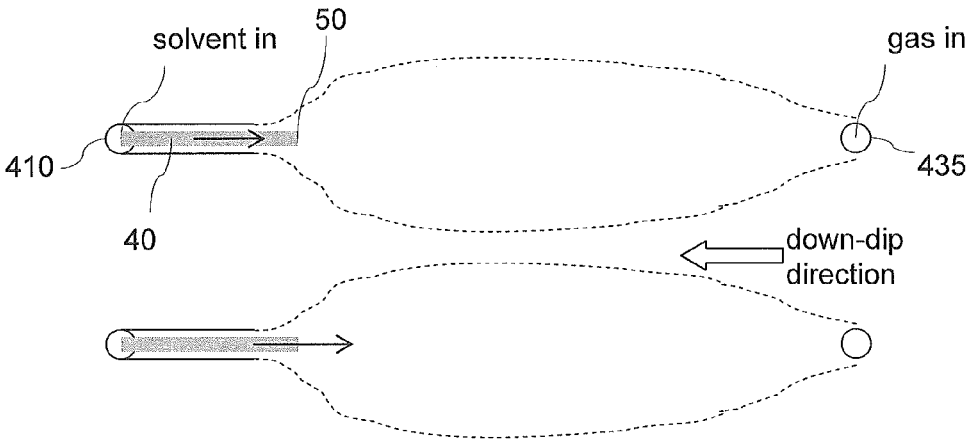

To advance the undercut formation, the concentric conduits 40 can be retracted in the down-dip direction within the unlined portions 415 of boreholes 410 as shown in FIGS. 12*a* and 12*b* in order for the undercut to grow towards the down-dip edge of the bed 405. The gas blanket is maintained in order to protect the roof while the undercut is allowed to develop further down-dip.

If methane is present in the ore bed and released, the released methane will mix with the gas blanket. In the case of downhole injection of air, periodical purges of the gas mixture may be performed to remove the methane. It is recommended to stop solvent flow downhole during the methane purge. The undercut is considered complete once the concentric conduits 40 are pulled all the way to the down-dip end of the unlined portions 415 of boreholes 410. However, there should be some remaining trona in order to drill a collection well 420 (illustrated in FIG. 13*a*). The solvent injection through conduits 40 is terminated when the undercut space is completely formed at the base of the trona bed 405.

Figure 13A:
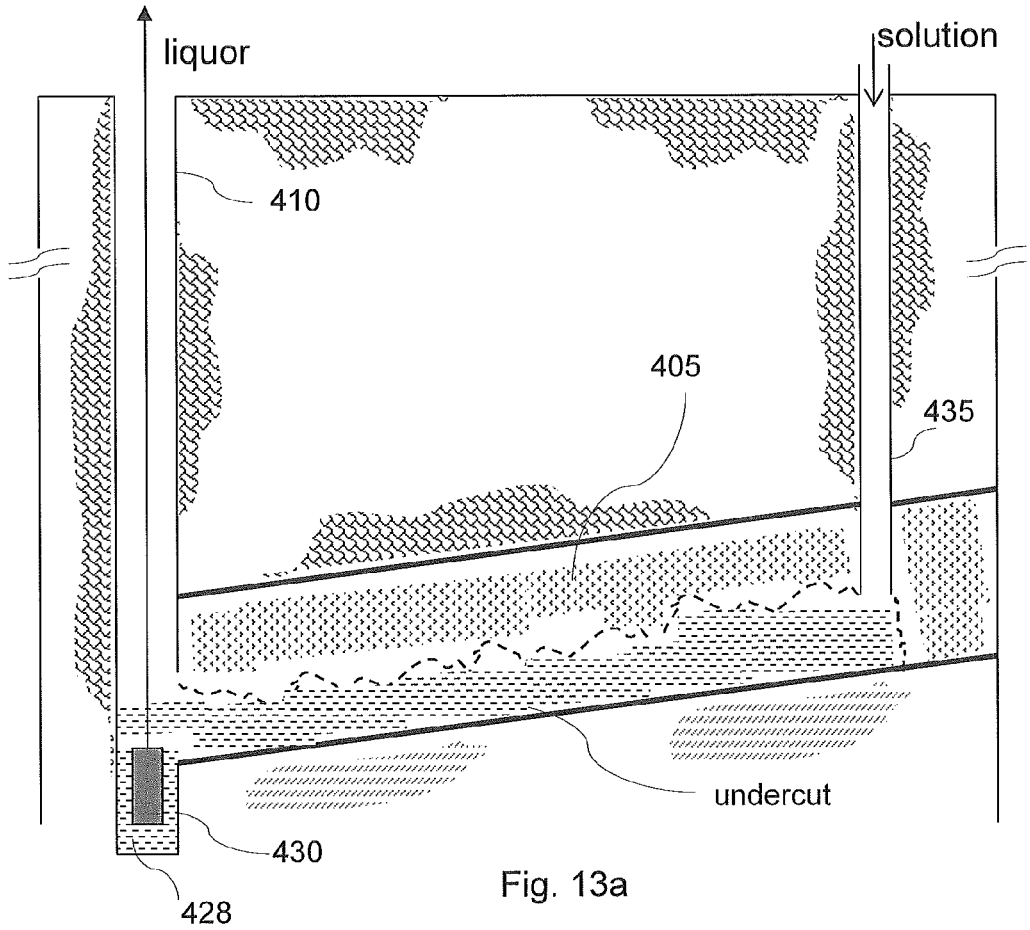
FIGS. 13*a* and 13*b* illustrate an elevation view and a plan view during the production phase without gas injection of the solution mining system using the undercut formed as shown in FIG. 12*a-b;*

To start production, a directional well is then drilled at or near the bottom of the bed 405 to intercept (generally but not necessarily perpendicularly) the horizontal portions 415 of boreholes 410 at their downhole ends to form the collection well 420. A vertical sump well is drilled to intercept the horizontal portion of the collection well 420 to form a sump 428, preferably being at the lowest down-dip location of the bed 405. A sump pump 430 is installed at the bottom of the sump 428 as illustrated in FIG. 13*a*.

Figure 13B:
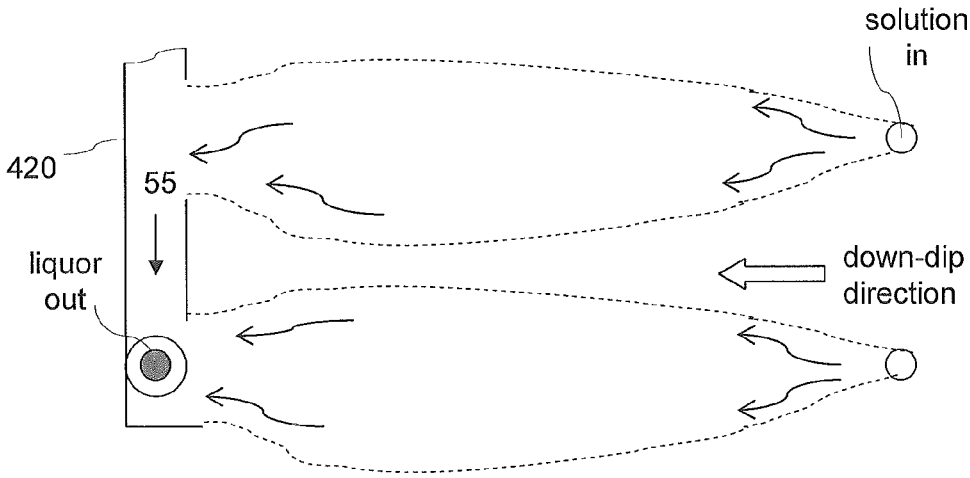

After the collection well 420 and sump 428 are created, the gas blanket is removed, and after all the cavities in the undercut are filled with solvent, the production of soluble ore by solution mining is started. A solution is injected through the plurality of boreholes 435 in the up-dip region of the bed 405, as shown in FIG. 13*a-b*. The solution is preferably water or a solution unsaturated in desired solute (i.e., sodium values) which may be circulated from other systems which are undergoing undercut formation. The solution gets impregnated with dissolved sodium values as it flows downward in each individual undercut formation, is collected in the collection well 420, directed to the sump pump 430 and pumped to the surface as a solution saturated in sodium carbonate/bicarbonate. This production phase is preferably performed at low pressure and not under static head pressure. The dissolution during the production phase will be carried out both in the horizontal and vertical directions since the gas blanket is no longer present. The undercutting makes the ore susceptible to gravitational loading and crushing, so that unexposed ore falls into the undercut by gravity resulting in exposure of fresh ore to the solution for dissolution and vertical expansion of the undercut. Eventually all the individual undercuts will connect to form an undercut slot as previously described in reference to FIG. 4. The production phase should continue until all the accessible desired solute is dissolved from the ore. At a point when the solution exiting the system 4 is well below saturation in desired solute (e.g., sodium carbonate/bicarbonate) and/or contains too high of a content in contaminant(s) (e.g., chloride), the solution mining is terminated by stopping the solution flow.

Figure 14A:
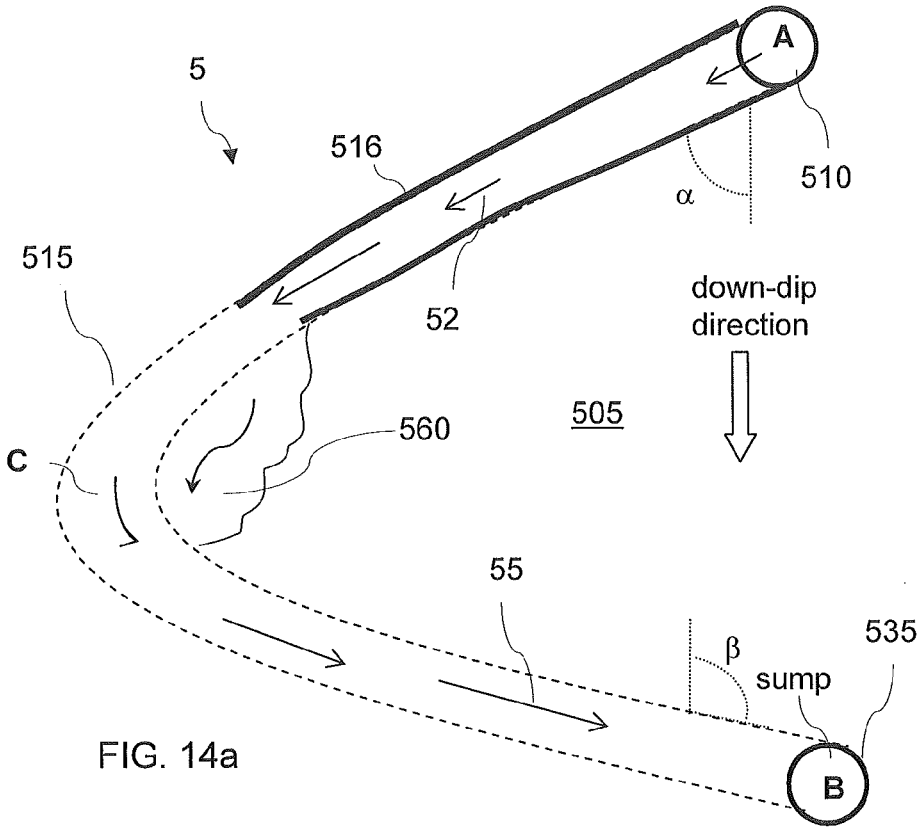
FIG. 14*a-c* illustrate a twelfth embodiment of a system and its operation for in situ solution trona mining employing an advancing undercut according to the present invention.
Figure 14B:
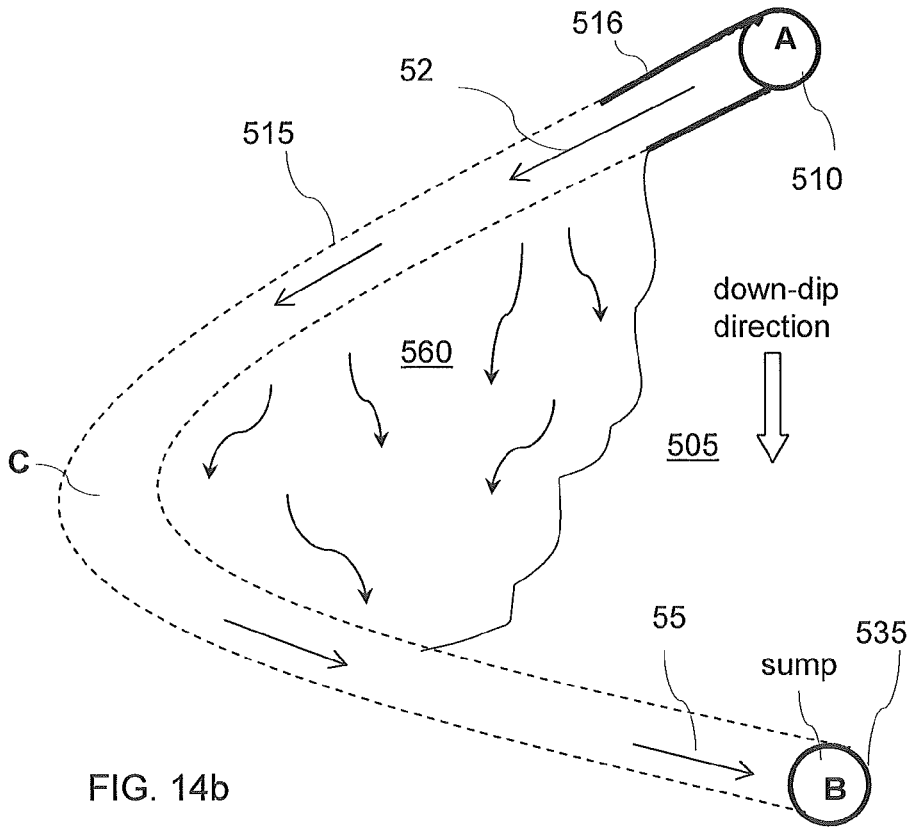
Figure 14C:
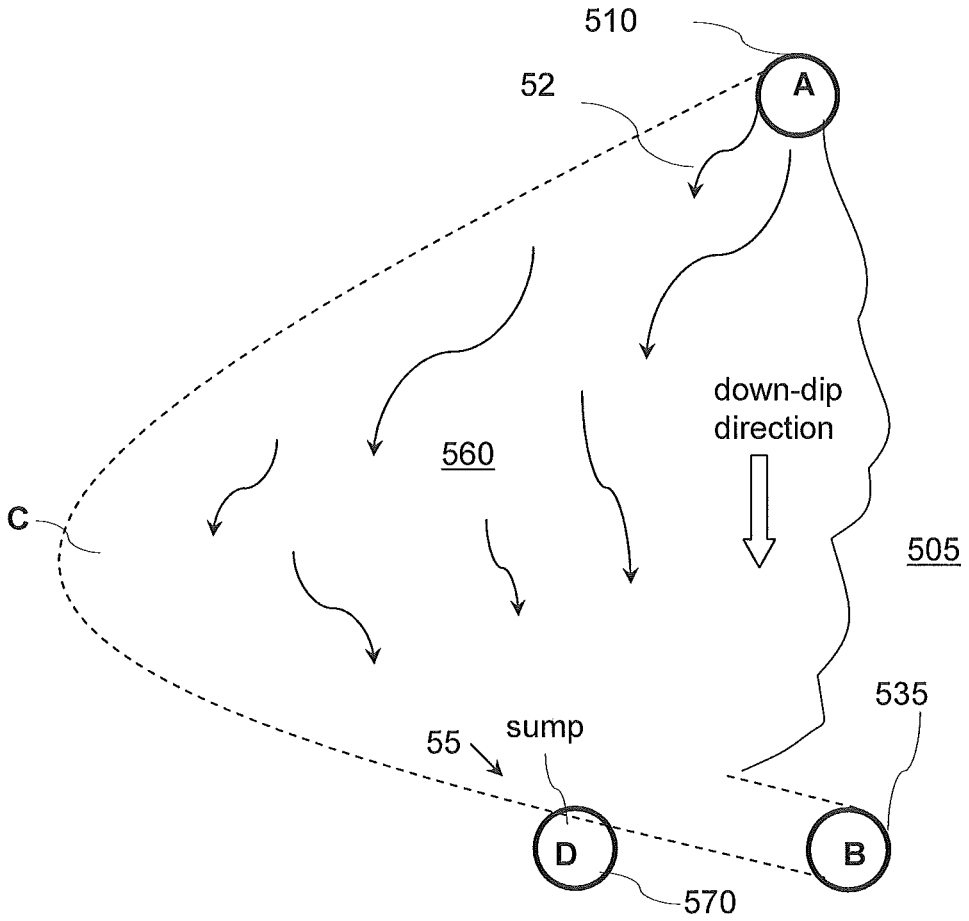

FIG. 14*a-c* illustrate in a plan view the development of a solution mining system 5 which comprises a virgin section of a trona bed 505 with a dip gradient and two directional boreholes 510 and 535. The virgin section of a trona bed will go through various development phases described hereinafter during its life cycle. Since the length of a cycle can be considerable such as several years, it is recommended to have a plurality of bed sections in various phases of development.

Referring to FIG. 14*a*, during the drilling phase, two directional boreholes with single casings are drilled, one (510) at an up-dip location 'A' and the other one (535) at a down-dip location 'B', at first vertically and then in a more horizontal fashion, at an angle $\alpha$ for borehole 510 and an angle $\beta$ for borehole 535 with respect to the direction of dip gradient. The angle $\alpha$ is generally between 10 and 85 degrees, and the angle $\beta$ is generally between 95 and 170 degrees. The two boreholes 510 and 535 connect at a point C generally although not necessarily positioned about mid-dip and laterally-spaced from points A and B so that points A, B, C define a triangular shape with an area of from about 0.5 to 5 square kilometers. A sump is created at the bottom of the vertical portion of the down-dip borehole 535 at location B, and a sump pump is installed in the sump. The casing 516 in the somewhat horizontal portion of the up-dip borehole 510 is pulled at a predetermined distance which is least 5 feet, or least 10 feet, or at least 20 feet from the connection point 'C' to create an unlined borehole portion 515. The casing of the down-dip borehole 535 is removed all the way to the sump (at point 'B'). The vertical portions of boreholes 510 and 535 are preferably lined with casings so as to prevent their erosion during undercut formation and production phases.

Solvent 52 (e.g., water or an unsaturated solution comprising sodium carbonate, bicarbonate and/or hydroxide) is injected at a temperature between ambient temperature and 220° F. (104° C.) in the up-dip borehole 510 for it to flow into unlined borehole portion 515 and to expose fresh trona ore and dissolve some trona, thus forming a voided area called undercut 560. As the solvent impregnated by dissolved trona flows towards the sump, it forms a liquor 55, which is collected in the sump of the down-dip borehole 535. The sump pump removes this liquor to the surface. This undercut formation phase is not performed under static head pressure. The dissolution first proceeds along the edge of the connection (point 'C') and its spreading is dictated by saturation and gravity. The flow rate and temperature of the solvent 52 should be controlled so as to ensure saturation of the pregnant solution as it reaches the sump. If unsaturated solution reaches the sump, this may create unwanted dissolution patterns and probable short-circuiting pathways and lower overall recovery rates. The undercut formation is considered complete once the casing 516 of the up-dip borehole 510 is pulled all the way up to the beginning of the vertical portion of the borehole 510, so as to maximize the undercut area. For the production phase, a vertical collection well 570 may be drilled at the lowest down-dip part of the bed (e.g., point 'D' in FIG. 14*c*) and in fluid communication with the undercut cavity 560, and a second sump pump is installed at the bottom of this well. The undercut cavity 560 is filled with solution (preferably a solution circulated from other series of boreholes with undercut still in formation) which is injected through the up-dip borehole 510. The solution is collected through the collection well 570 and then pumped to the surface via the second sump pump as a solution saturated in sodium values (carbonate and/or bicarbonate). This production phase is not performed under static head pressure, but rather is performed below static head pressure. The dissolution of trona occurs both in the horizontal and vertical directions. The production phase continue until the exiting solution no longer is saturated in sodium carbonate/bicarbonate, which is indicative that the trona is almost exhausted from this undercut 560. It is expected that the extraction rate would be around 80-90% by using this method.

Figure 15A:
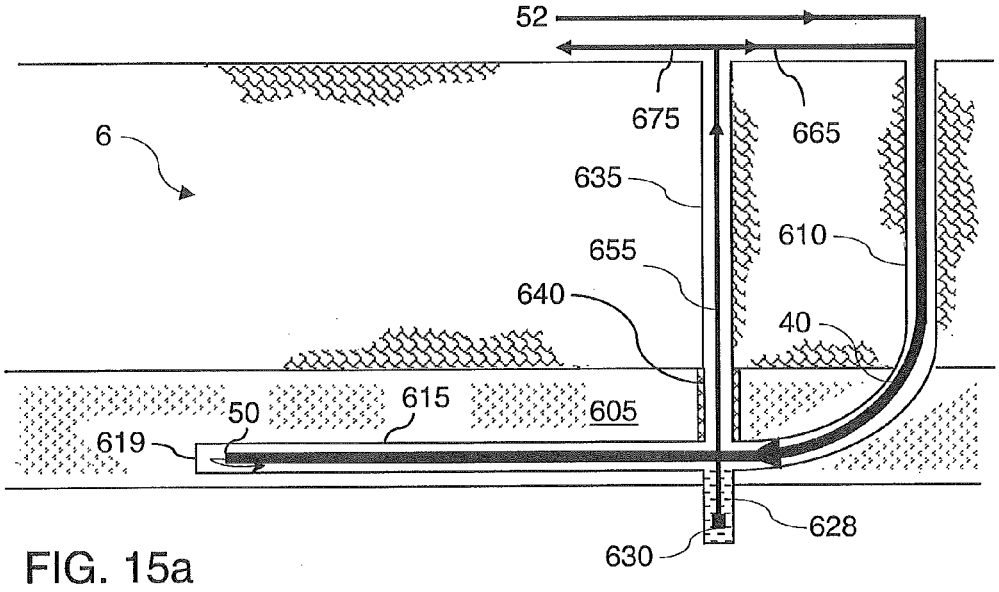
FIG. 15*a-d* illustrate a thirteenth embodiment of a system and its operation for in situ solution trona mining employing a plurality of parallel undercuts according to the present invention.

FIG. 15*a* illustrates in a plan view a solution mining system 6 which comprises a virgin section of a trona bed 605 with or without a dip gradient, a directional borehole 610, and a vertical borehole 635. In its initial development, the vertical borehole 635 is drilled through the trona bed and terminates underneath the floor of the trona bed 605 to a sump 628 where a sump pump 630 with a discharge pipe to the surface is installed. Borehole 635 comprises a steel casing with a fiberglass section 640 positioned through the trona bed 605. The borehole 610 is first drilled vertically and provided with a steel casing until it approaches the roof of the bed 605 at which point borehole 610 is then directionally drilled to curve well into the bed 605 to intersect a portion of the fiberglass casing of the borehole 635. The drilling is continued above and near the floor of the bed 605 to create a generally horizontal unlined portion 615 with a downhole end 619.

A conduit 40 is then inserted into the borehole 610 so that its downhole extremity 50 approaches the downhole end 619 of unlined borehole portion 615. The downhole conduit extremity 50, which serves as or contains the solvent injection zone, is positioned at a predetermined distance from the downhole borehole end 619, and is designed to inject the solvent to the ore region in the vicinity of the downhole conduit extremity 50, generally to at least a section of the ore-containing walls of the unlined borehole portion 615. The predetermined distance between the downhole conduit extremity 50 and the downhole end 619 of unlined borehole portion 615 may be at least 10 feet, or at least 25 feet, or at least 50 feet. The predetermined distance may be at most 750 feet, or at most 500 feet, or at most 400 feet.

FIG. 15*a* is similar to FIG. 1 in its design, except that, contrary to FIG. 1 in which the return borehole 35 is located near the downhole end 19 of the borehole 10, the return borehole 635 is not located near the downhole end 619 of the borehole 610, but rather in FIG. 15*a*, the return borehole 635 is closer in distance to the vertical portion (injection point) of injection borehole 610 than its downhole end 619.

For undercut formation, solvent 52 is injected though the conduit 40 and exists the conduit extremity 50 to contact virgin trona, some of which is dissolved. The solvent is then forced to turn around at the borehole downhole end 619. As the solvent passes though the horizontal unlined borehole portion 615 towards the sump 628, it dissolves more and more virgin trona and forms a pregnant solution, which is collected in the sump 628. As the trona which serves as walls of unlined borehole portion 615 dissolves, the circumference of this unlined borehole portion 615 is enlarged so as to form an undercut alongside at least a section of the borehole portion 615 which has been eroded by dissolution over a distance from the downhole end 619 of borehole 610 to the sump 628. To move the solvent injection to fresh trona so as to further enlarge the undercut (e.g., increasing its length), the conduit 40 is retracted within the unlined borehole portion 615 so that the conduit downhole extremity 50 is pulled away from the downhole end 619 of borehole 610. This first phase of undercut formation (Phase 1) is illustrated in plan view in FIG. 15*b*.

The pregnant solution exiting the sump 628 may be saturated, but in most instances the solution is unsaturated in sodium carbonate. This pregnant solution is removed from the sump 628 generally by downhole pump 630 via line 655, where a portion of such pregnant solution (line 675) may be processed for recovery of the sodium values while another portion (line 665) may be recycled to the undercut development by re-injection though conduit 40.

Figure 15B:
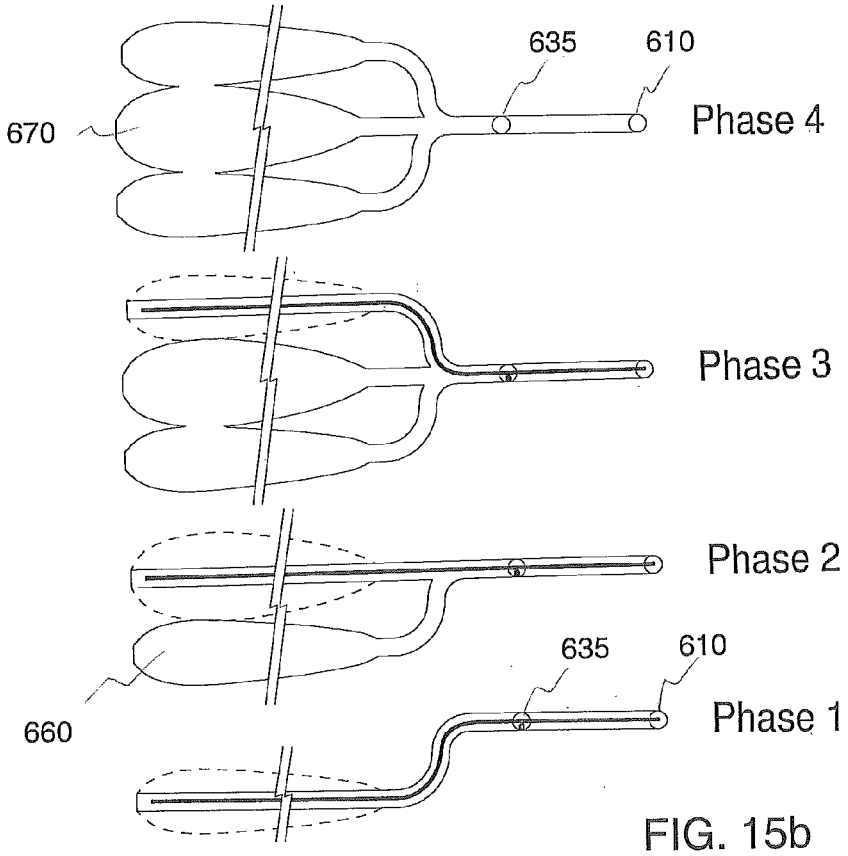

As illustrated in FIG. 15*b*, other phases of undercut development can be carried out alongside the first formed undercut 660 to create a first set of parallel undercut cavities. These additional phases are initiated by directionally drilling within the trona bed other unlined borehole portion(s) from main borehole 610 connected via curved sections to this common main borehole, the new unlined borehole portion(s) being parallel to the longitudinal axis of the first undercut 660. The dissolution process of the unlined borehole portion(s) is repeated until the resulting parallel widened undercut cavities eventually merge to create an undercut slot 670 near the floor of the bed. The combined developed undercut areas may comprise a length of 1000 to 3000 feet (304-914 meters), preferably 2000-3000 feet (610-914 meters), with a width of 200 to 300 feet (61-91 meters).

Figure 15C:
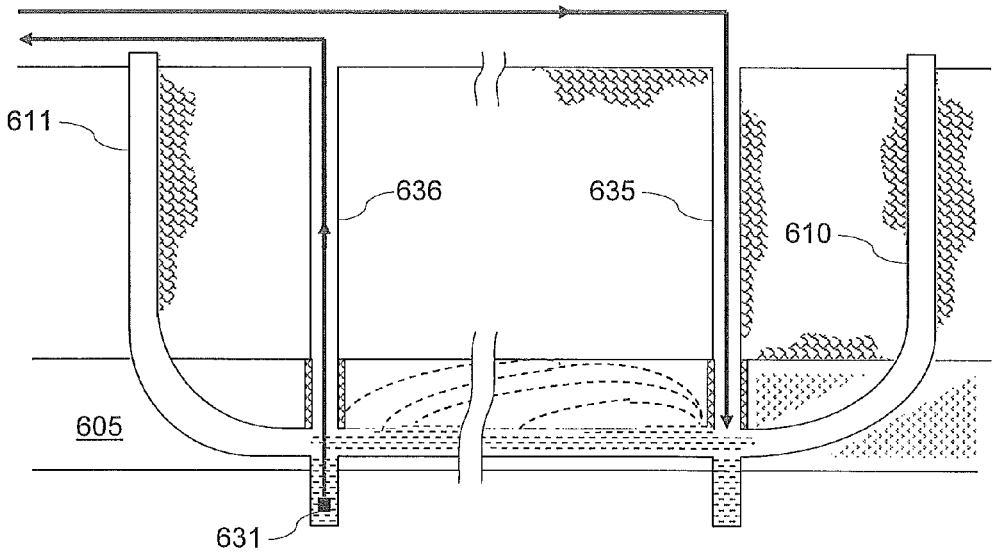
Figure 15D:
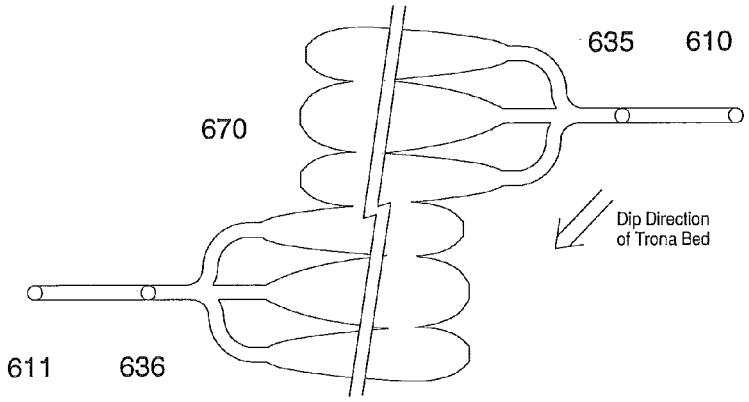

One or more sets of parallel undercut cavities with similar borehole design may be created. This would allow for the lateral expansion of undercut formation near the floor of the trona bed. As illustrated in FIG. 15*d* in plan view, a second set of parallel undercut cavities may be developed but as a mirror image of the first set. The second set is preferably created with the use of directionally drilled borehole 611 and vertical borehole 636 as illustrated in FIG. 15*c* (similarly as for the first set with boreholes 610 and 635). The second set is preferably down dip to the first set, for a bed with a dip gradient. Preferably, the two independently formed sets of cavities are in fluid communication (that is to say, these sets of parallel undercut cavities eventually merge), so as to allow fluid to pass from one to the other, such as from the up-dip set to the down-dip set. The combined developed area may comprise a length of 1000 to 3000 feet (304-914 meters), preferably 2000-3000 feet (610-914 meters) with a width of 400 to 600 feet (122-183 meters).

The production mode of the undercut slot 670 is carried out by the hydrostatic injection of solvent through the up-dip borehole 635 and withdrawal of pregnant solution through down-dip borehole 636 via a second sump pump 631, as illustrated by the elevation view in FIG. 15*c*. During this production mode, the operation favors the enlargement of the undercut slot 670 vertically so that upper portions of the trona bed at higher elevations begin to fracture and cave allowing for more trona (in the form of rubble) to be contacted with solvent and to be dissolved, for ultimately dissolving the trona bed from floor to roof. A given water level may be maintained in boreholes 635 and 636 to more effectively solution mine out the upper portions of the trona bed. A variation in the water level in these boreholes 635 and 636 would allow to vary the hydrostatic pressure if desired.

For undercut development and production modes in this embodiment, the solvent may be water or an unsaturated solution comprising sodium carbonate, bicarbonate and/or hydroxide. A solvent temperature between 0° F. and 220° F. (17.7-104° C.) may be used. However for undercut development in such embodiment, it is preferred to use a warm solvent with a temperature of about 100-220° F. (37.8-104° C.) or of about 100-150° F. (37.8-65.6° C.) and at low pressure (such as pressure of about 0 psig or 101 kPa). For production mode, it is preferred to use a solvent with a temperature of about 60-90° F. (15.6-32.2° C.) and at static pressure, such as head pressure of about 300 to 1200 psig (2170-8375 kPa) or about 700-1100 psig (4928-7686 kPa).

Figure 16A:
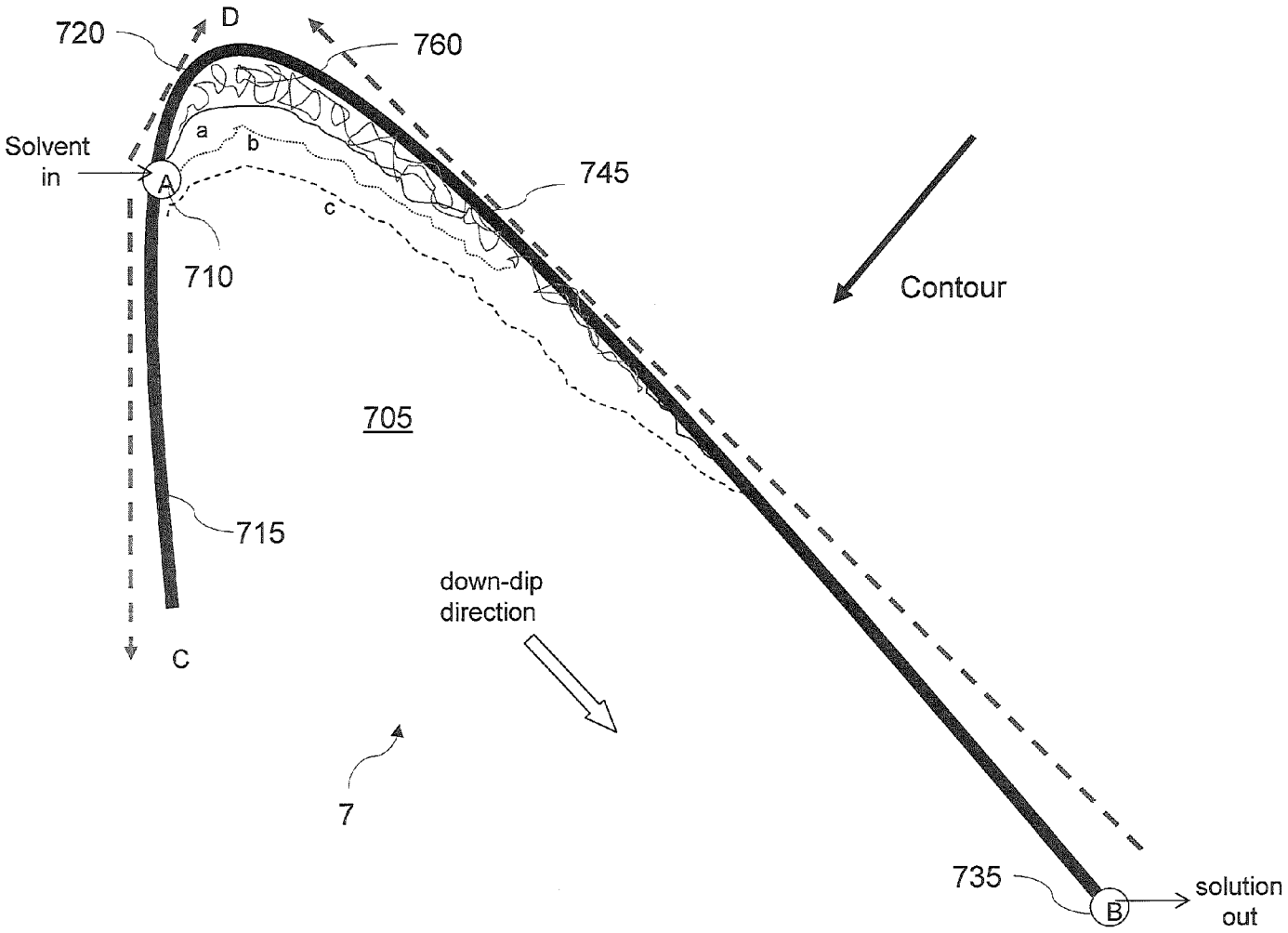
FIG. 16*a-c* illustrate a fourteenth embodiment of a system and its operation for in situ solution trona mining employing an advancing undercut according to the present invention.
Figure 16B:
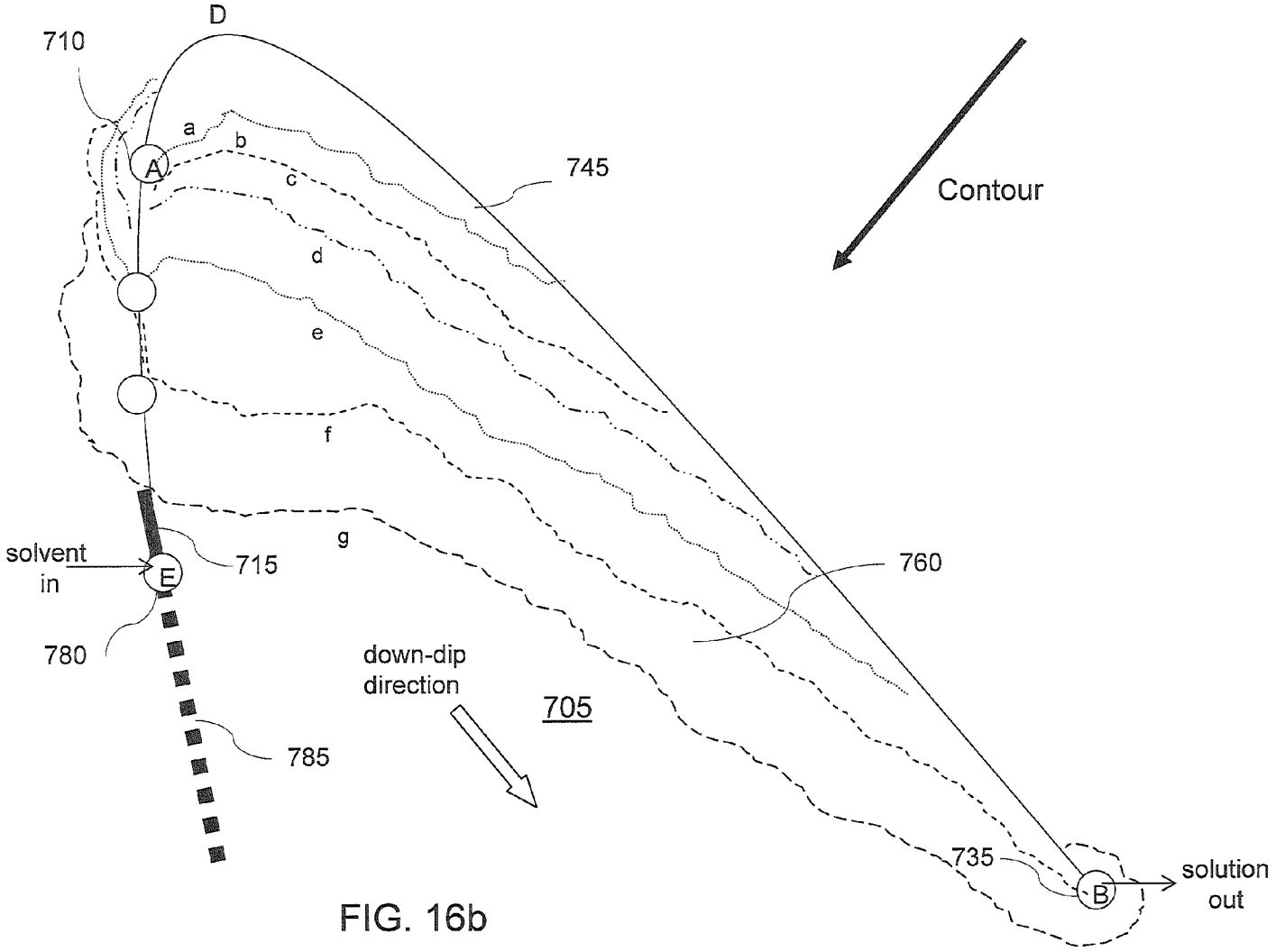
Figure 16C:
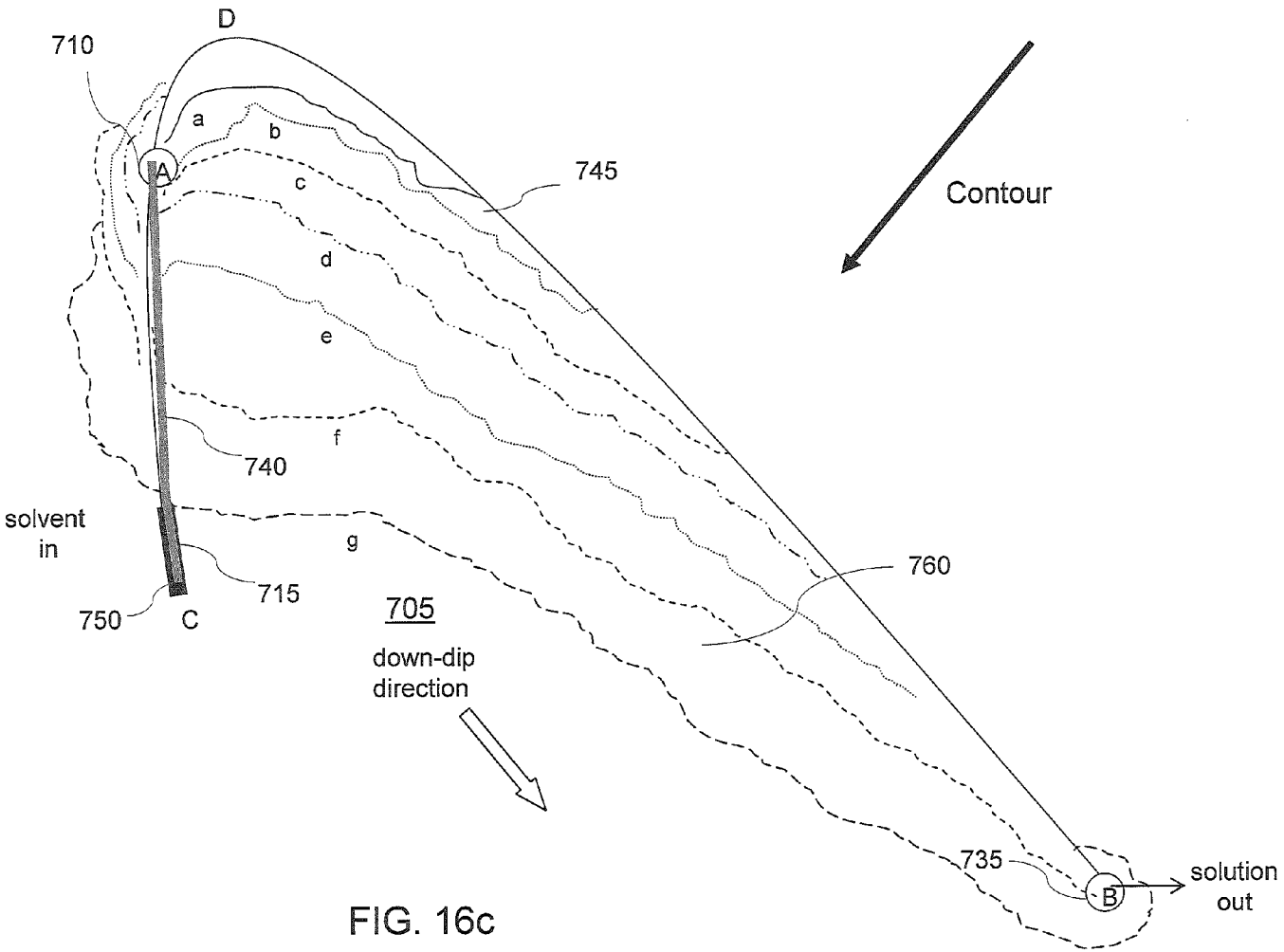

FIG. 16*a-c* provide yet another embodiment of a solution mining system and method utilizing the formation of an advancing undercut. FIG. 16*a* illustrates in a plan view of a system 7 which comprises a virgin section of a trona bed 705 with a dip gradient, a first directional borehole 710, and a second directional borehole 735.

In its initial development, the borehole 710 is drilled vertically in an up-dip region of the trona ore from the surface (with surface location A) through the trona bed 705 being mined down to floor depth and then is directionally drilled toward point C (down-dip from point A) along the floor of the trona bed 705 but not reaching the down-dip lateral edge of the bed. This first horizontal portion 715 of borehole 710 is unlined and may be about 0.5 to 2 kilometers in length, or about 1-1.6 km. Borehole 710 is further directionally drilled toward point D (up-dip from point A) at floor depth for any desired distance, to from a second horizontal unlined portion 720 of borehole 710 of about 0.1 to 0.5 kilometer in length, or about 0.4 km (¼ mile). This step impacts the size of the area to be mined and helps with saturation control.

The borehole 735 is drilled vertically in a down-dip region of the trona bed from the surface (with surface location B) through the trona bed 705 being mined down to floor depth and then is directionally drilled toward point D (which is up-dip from point B) along the floor of the trona bed 705. This horizontal portion 745 of borehole 735 is unlined and may be from 1 to 6 kilometers in length, or from about 3 to 5 km long. The surface location B of borehole 735 should be selected so that it is more down-dip than surface location C, and it is laterally-spaced from surface locations A, C and D with respect to the direction of the strike of the bed (which is perpendicular to the bed dip).

For the formation of an undercut, borehole 710 is employed for the injection of solvent, while borehole 735 is employed for the withdrawal of a saturated solution (liquor). Because the unlined portion 715 of borehole 710 is slanted down-dip from point B to point C, the solvent injected into borehole 710 fills up this unlined portion 715 which then overflows into the up-dip unlined portion 720 of borehole 710 towards point D where trona exposed to the solvent starts to dissolve. It is recommended for the solvent containing dissolved trona to be well below saturation at the point D where unlined borehole portions 720 and 745 connect. The trona region down-dip of point D gets exposed to the solvent and the dissolution of the solvent-exposed trona creates an undercut 760. This unsaturated solution then flows downward in the unlined portion 745 of borehole 735 towards the downhole end of the vertical portion of borehole 735 (with surface location point B), getting enriched in dissolved trona to finally reach saturation as it approaches point B or preferably when it arrives at point B.

At the dissolution continues down dip of point D, the undercut 760 widens downward from point D as well as on either side of unlined portion 715 of borehole 710, and its down-dip edge advances towards the C-B line as illustrated by the progression of curves a, b, c in FIG. 16*a*, and curves d to g in FIG. 16*b*.

To expand the undercut formation along the unlined portion 715 of borehole 710, the solvent injection point may be moved down dip. For example as illustrated in FIG. 16*b*, a borehole 780 with surface location E is drilled vertically to intersect unlined portion 715 of borehole 710. The borehole 780 is preferably cased down to the roof of the trona bed 705 but then left unlined through the trona bed down to the floor. The location E is preferably selected to be down-dip from the point on the portion 715 intersecting with the down-dip edge of the undercut (in this case, represented by curve g). The solvent injection is then performed through this borehole 780, and the dissolution of trona proceeds as previously described for the undercut to continue its down-dip advance. Optionally a directionally drilled unlined portion 785 (shown in dashed line) of borehole 780 may be added to continue the progression of the undercut formation in this region of the trona bed.

Another option for the solvent injection point to be moved down-dip is illustrated in FIG. 16*c* and is carried out by inserting a conduit 740 into the borehole 710 and into its remaining downhole unlined portion 715, so that the downhole extremity 750 of the conduit 740 is effective in injecting the solvent downward towards point C within this remaining unlined portion 715, and the dissolution of trona proceeds as previously described.

Such solution mining method may be carried out in a continuous mode in which the solvent is injected through the undercut cavity, so that the moving solvent dissolves the desired solute further cutting the exposed free face of the ore, while at the same time the saturated solution is removed from a down-dip location of the ore bed to the surface. The solvent injection in the continuous mode may be terminated when the down-dip edge of the undercut reaches the down-dip edge of the ore bed.

However, it is also envisioned that the solution mining method may be carried out in a batch mode, which may be termed a 'cut-and-soak' mining method. In such case, the solvent injection is first injected at point A until the solvent fills the unlined borehole portions 715, 720 and 745 and/or the nascent undercut cavity 760 and thereafter the solvent flow is stopped to let the non-moving solvent dissolve in place the exposed trona further cutting the trona free face until the pregnant solution gets saturated with sodium values. When the pregnant solution reaches saturation, the resulting saturated liquor is removed from the down-dip location at point B to the surface. Once the undercut cavity is drained, more solvent can be injected and the batch process is repeated. The solvent injection may be moved when the down-dip edge of the undercut reaches the downhole injection point. In this manner, this 'cut-and-soak' mining method may be operated in cascade in several adjacent fresh ore regions over time. The operation in cascade may be initiated up-dip and the injection point is moved down-dip over time. The solvent injection may be terminated when the down-dip edge of the undercut reaches the down-dip edge of the ore bed.

Flow rates and temperature of the solvent can be controlled to mine the desired path through the ore. This system 7 and its operation for solution mining can be used to slowly form an undercut at the base of the trona bed or to quickly mine the entire bed when roof contamination is not a concern. Indeed a fast development of the undercut will cause more rapid breakage and caving of upper material and put more significant stress of the trona bed roof. Thus when there is no shale bed topping a trona bed and hence little risk of chloride contamination, the undercut development can be expedited and high flow rates can be used. A temperature in the range of 100-220° F. (37.8-104° C.) at the injection point will favor the rapid dissolution of trona in the vicinity of the injection point, and as the pregnant solution cools down, the rate of dissolution decreases when the solution travels downward in the unlined borehole portion 745 towards point B.

FIG. 17*a-g* provide yet another embodiment of a solution mining system 8 and method utilizing the formation of an advancing undercut in a virgin section of a trona bed 805 with a dip gradient.

Initially three (3) parallel boreholes are drilled from the surface. Two boreholes A, B whose surface locations A and B are up-dip, and the third borehole C whose surface location C is down-dip and spaced laterally intermediate to the other two holes is drilled from the opposite direction. The holes depicted as 'A' and 'B' will be used for solvent injection points, while the hole depicted as 'C' will be used for solution extraction point from the mined area.

Figure 17A:
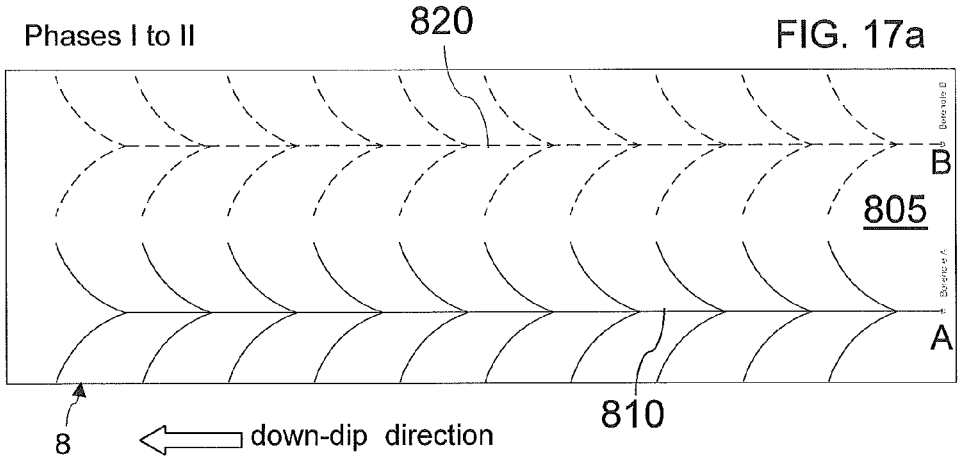
FIG. 17*a-g* illustrate a fifteenth embodiment of a system and its operation for in situ solution trona mining employing an advancing undercut according to the present invention.

In its initial development illustrated in FIG. 17*a*, the borehole A is drilled vertically in an up-dip region of the trona ore from the surface (with surface location A) through the trona bed 805 being mined and to floor depth and then is directionally drilled toward the down-dip bed edge alongside the floor of the trona bed 805 to form portion 810. After this initial drilling, the drill bit is retreated into the horizontal portion 810 towards downhole location A, and a series of lateral drillings is carried out to form branches of the main horizontal portion 810. A directional survey of the primary portion 810 and each of the side branches is performed to ensure proper drilling placement.

The second phase also illustrated in FIG. 17*a* comprises the directional drilling of a parallel borehole B as described above in an up-dip region of the trona ore from the surface (with surface location B) through the trona bed 805 being mined and to floor depth and then is directionally drilled toward the down-dip bed edge alongside the floor of the trona bed 805 to form a horizontal portion 820 and then side branches from this main horizontal portion 820. The horizontal borehole portions 810, 820 are parallel to each other and distanced from each other by several hundred feet (e.g., spacing of from 30 to 122 m) and may be several thousand feet long, e.g., from about 0.5 to 5 kilometers in length, or about 1 mile (1.6 km). The disposition of these horizontal portions 810, 820 is generally within the lower portion of the bed, preferably from the floor to approximately the bottom third of the bed depth. This disposition is dependent on the shale bands located within the bed.

Figure 17B:
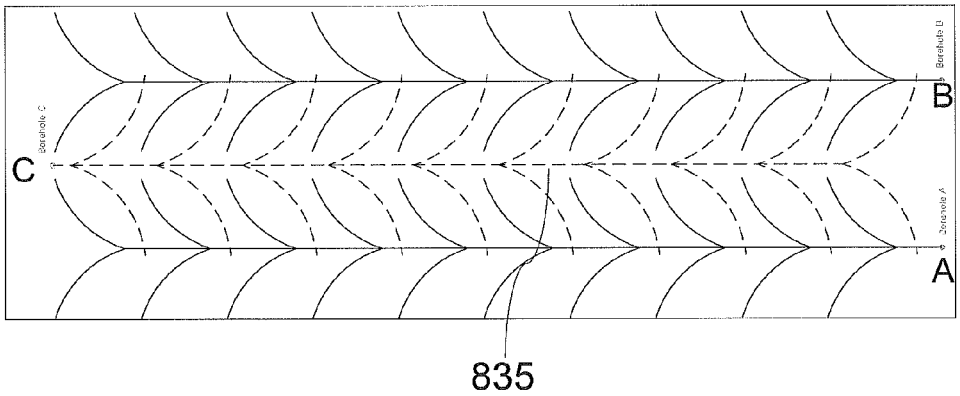

The third phase illustrated in FIG. 17*b* comprises the directional drilling of another parallel borehole C. The borehole C is initially vertically drilled in the opposite direction than boreholes A, B in a down-dip region of the trona ore from the surface (with surface location C) through the trona bed 805 being mined and to floor depth and then is directionally drilled toward the up-dip bed edge alongside the floor of the trona bed 805 to form a horizontal portion 835 and then side branches from this main horizontal portion 835, each of these branches of portion 835 intersecting the main horizontal portions 810, 820 of boreholes A, B. The horizontal portion 835 is positioned between portions 810, 820 and parallel to them. These unlined portions are distanced from each other by several hundred feet and may be several thousand feet long, e.g., about 1 to 5 kilometers in length, or about 1.6 km (1 mile). The disposition of the horizontal portion 835 is generally within the lower portion of the bed, preferably from the floor to approximately the bottom third of the bed depth.

Following completion of the drilling phases I, II and III and directional survey, the drill strings and bits are removed from the borehole portions 810, 820, 835. The casing generally remains in the vertical portion of these boreholes A, B, C to prevent hole collapse and contamination of the areas between the surface and the bed roof. Initial resulting surface elevations may be measured. This completes the drilling stage.

Subsequent development phases IV to VII as shown in FIG. 17*c-f* provide the undercut formation stage, during which the progression of the undercut formation may be monitored by using cameras and logging techniques to determine its size. The solution mining of multiple branches from a main horizontal unlined borehole portion allows the development of interconnecting multiple undercuts in such as way as to produce a large block of undercut which is quite large in extent but not in depth, as the lateral formation of such undercut is favored by the system illustrated in FIG. 17*b*.

Figure 17C:
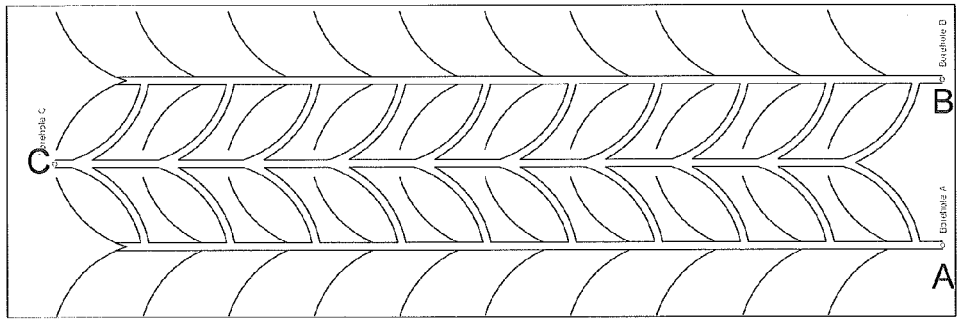

Phase IV illustrated in FIG. 17*c* initiates the formation of the undercut, where solvent injection and fluid circulation are started. The solvent (water or unsaturated solution) is injected in either or both of two unlined boreholes A, B where it then contacts and dissolves trona forming the walls of the horizontal borehole portions 810, 820, thus enlarging them. This generates greater flow area and exposes a greater perimeter or contact surface of the trona. The undercut begins forming by utilizing the natural tendency of the shale beds to restrict the dissolution of the trona, resulting in dissolving the trona surfaces in the lower region of the bed. A pregnant solution flows through the unlined portions 810 and 820 and the side branches connecting portions 810 and 820 to 835 dissolving along the way more trona to finally flow into unlined portion 835. A saturated solution is collected at the downhole end of the third borehole C, to be passed to surface via a downhole pump.

The system may be operated under pressure allowing the surrounding rock to maintain or exert a pressure to the local strata minimizing any local ground pressures. The pressure on the surrounding rock may be exerted by liquid, or exerted by gas by utilizing injection of air or some natural ground gas in the undercut cavity. The temperature, flow rates of the solvent and the density of the resulting solution are monitored to obtain the saturation of the return solution.

Overall this method does not retain any drill piping into the various borehole horizontal portions and branches created by directional drilling, but the cavity development and placement may be effectively provided to desired areas through the use of tailings to direct flows and varying flow rates, temperature and saturation levels of the injected solvent. The tailings may also act to form a barrier from the shale floor and contaminants falling from the upper areas of the bed, keeping liquid from contamination by the shale layer. The solvent thus may include tailings which then deposit on the bottom face of the undercut. Deposited tailings change flow paths through damming effects and direct the solvent flow to inward cavities created by directional drilling.

Figure 17D:
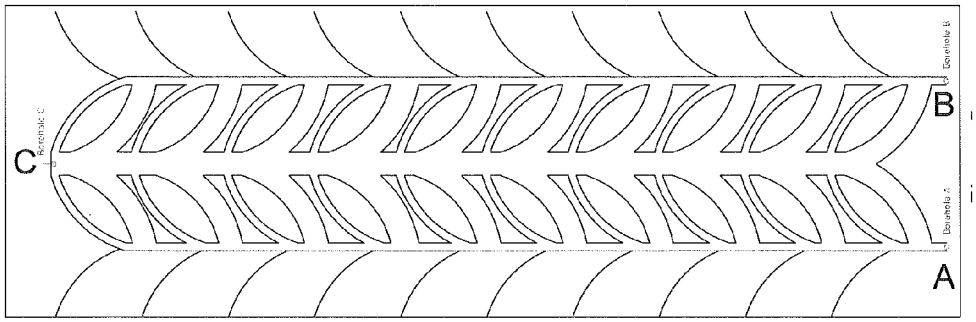
Figure 17E:
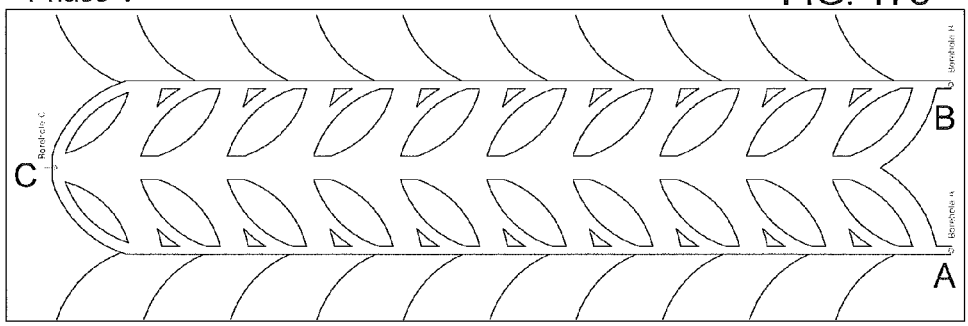
Figure 17F:
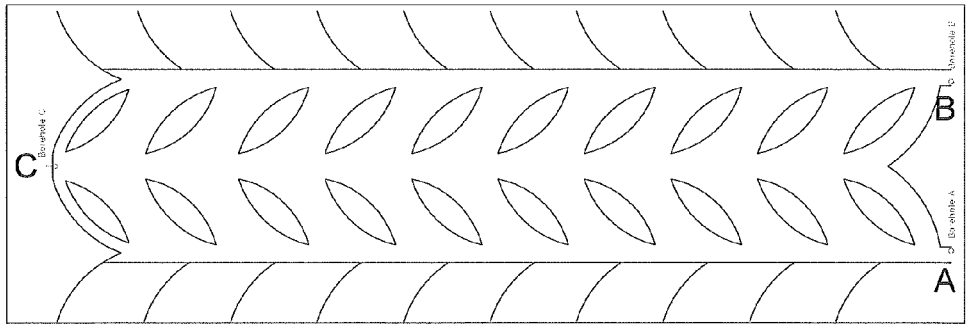
Figure 17G:
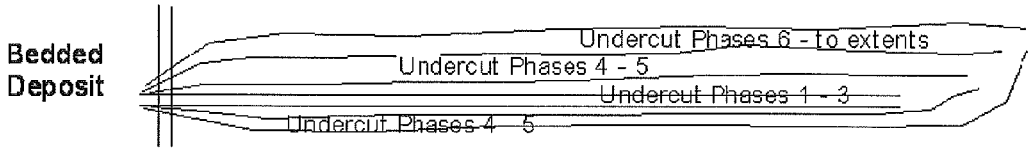

During Phase V as shown in FIG. 17*d*, the undercut formation has progressed as trona continues to create a larger cavity in and around the main horizontal borehole portions 810, 820 and their respective side branches, as well as around the main horizontal return borehole portion 835 and its side branches. High flow rates and low solvent temperature minimize the dissolution of the trona near the injection points and enable undercut to develop at areas alongside the unlined borehole portions 810, 820 and/or near the return borehole portion 835, so that erosion by dissolution of the walls of unlined portions occurs all the way down toward the return borehole C. During phase VI as shown in FIG. 17*e*, the undercut and secondary areas extended beyond the initial unlined borehole portions are becoming more developed. The use of tailings can be carried out to cover fallen shale bed parts and organic contamination from floors. The tailings mixed with solvent, settle and form a blanket keeping the unsaturated and saturated fluids from contacting the caved shale. During phase VII as shown in FIG. 17*f*, the undercut develops vertically as lower regions of the bed have been dissolved and part of the trona overburden cracks and falls into the undercut. Surface subsidence monitoring can be used to determine extents and impacts of pillar erosion (pillars here being defined as the non-eroded ore regions between boreholes).

FIG. 17 *g* illustrates the vertical progression of the undercut formation, where in Phases IV and V, the immediate lower and upper regions of trona surrounding the initial borehole portions 810, 820 are dissolving away. During subsequent undercut formation phases VI to VII, however, as solvent starts eroding trona on the upper face of the undercut, the undercut is further enlarged upwards.

In yet another embodiment of the present invention, the solution mining method for trona ore uses the layer of insoluble rock that is deposited in the formed undercut by the dissolution of trona. This layer of insoluble separates the floor and ceiling of the undercut cavity, while mechanically supporting the cavity ceiling, the latter one being the bottom interface for the trona rubble and the ore above it. Such insoluble layer gets thicker as more and more of the trona overburden get dissolved, and provides, through its porosity, a channel through which the liquid can pass through from an up-dip to a down-dip location.

In practice a trona bed undergoing an undercut formation may comprise several zones in various stages of development. These zones may comprise parallel stripes of trona bed across the width of the bed extending from the upper part (up-dip) to the lower part (down-dip). Such zones may comprise:

- a zone not yet in operation, where the trona ore is intact, except for the plurality of boreholes that feed the solvent to the next stripe;
- a preparation zone, where the solvent is first put in contact with the trona, and where the plurality of dissolution areas (unlined boreholes) get wider until they finally merge laterally as one wide undercut slot as large as the width of the bed;
- a transition zone, where the liquid flows freely under the gravity provided by the slope of the bed floor, as described above, without any further dissolution of the trona rubble;
- a production zone, where the liquid fills the entire thickness of the insoluble layer, reaches the ceiling of this insoluble layer and dissolves the floor of the trona rubble, until the solution is fully saturated with sodium values (sodium carbonate/sodium bicarbonate). At the end of this zone, the complete dissolution of this pure trona region (exclusive of the top part which is no longer pure enough and too concentrated in impurities such as halides or sulfates) can be achieved; and
- a depleted zone where the saturated solution is transported to the collection zone at the bottom of the ore bed.

Regarding the preparation zone, the solvent flows in that zone under gravity, except for the very first meters from the injection point, when the solvent velocity is still too large to enable a gravity-driven flow pattern. As soon as the diameter of the undercut cavity gets bigger than about 20 inches, the area available for the liquid flow will get large enough that the upper portion of the undercut cavity will no longer be filled with liquid. This means that the cavity can only extend downward (where it will be limited by the floor of the trona layer) and sideways. The more the undercut cavity extends to the sides, the more cross-sectional area is made available for the solvent flow, so that the thickness of the liquid layer will keep decreasing, and so will the breadth of the lateral dissolution zone of the trona, carving roughly with time a kind of triangular shape. At the bottom of the cavity, the insoluble material will slowly start to accumulate as the speed of the liquid will be smaller and smaller and prevent any transport of insolubles with the liquid.

When the lateral extent of the undercut cavity will become too big to support the cavity roof, the roof at or near the center will start to yield by gravitational load and collapse in the cavity. The liquid will thus be mainly pushed to the sides, enabling the continuation of the lateral carving of the cavity, which in turn will cause more collapse of the overburden trona to occur in the center of it. A small part of the liquid will however keep flowing in the shallow space filled with the insoluble material, at the bottom of the collapsed area in the undercut center. This liquid will resume some dissolution at the center and thus achieve the formation of the (laterally continuous) transition zone downwards the preparation zone.

The more the undercut cavity extends laterally, the more liquid will flow into the broader collapsed central area of it, and the less liquid will be available for the lateral dissolution of the undercut cavity. For a given feed flow rate of solvent, there should be a maximum possible lateral extension of the undercut cavity, and that limitation will define the distance between consecutive horizontal drillings across the bed, in order to enable a junction between adjacent undercut zones. Such distance will depend on the local structure of the trona bed and in particular of its rate of sodium values dissolution. Generally, the rate of trona dissolution in hot water is about 0.5 to 1 cm per hour without any agitation of liquid. For example, for an unlined borehole circumference to get from 4 inches to 20 inches in diameter, a contact time of a little more than one day is necessary. As the dissolution in the operation zone keeps progressing and the borehole injection travels at an average speed of 1.2 m/day, the initial length of the cavity before the top portion of the cavity will no longer be exposed to liquid should be no more than 1 meter. After such distance, the directional lateral dissolution of the undercut cavity will take place.

Regarding the production zone, it has two simultaneous constraints: one to produce saturated solution and the other to dissolve the entire thickness of the useable trona. Two operating parameters can be defined independently to achieve either of such constraints: the flow rate of the solvent and the length of this production zone (counted as the distance up to bottom from the interface with the transition zone and the interface with the depleted zone). The position of this interface with the depleted zone is set by the development across time of the operation. For example if the bed contains 4 millions tons of trona and a production of 1 million metric tons of soda ash per year is expected, that interface may move upward by 1.2 meter per day in the course of two years of operations for such bed. The position of this interface with the transition zone can be adjusted by controlling the level of liquid in the collection zone located downward from the undercut cavity. Over that liquid level, the liquid flows under gravity and cannot reach the floor of the trona rubble, while below that liquid level, the cavity is flooded and the liquid can resume trona dissolution.

While the dissolution speed by using water may be satisfactory for the diameter growth in the first meters of the various injection points (0.5 to 1 cm/hr), it may not be sufficient for a fast development of the lateral expansion of the undercut cavities and to cause their merging at an acceptable distance downward of the injection points. Additionally the use of water for the trona dissolution will yield, at some distance in the production zone, a bicarbonate saturated solution that will later evolve by further trona dissolution into more dissolution of carbonate, but precipitation of bicarbonate that may plug the dissolution free face. For either or both of these reasons, it may be recommended to use a caustic solution (such as containing 29 gNaOH/kg) that will both enhance the efficiency of the preparation zone and prevent plugging in the production zone. A further improvement would be to inject in the trona bed to be mined a diluted caustic solution—2.6 or 2.7%—in order to cause bicarbonate precipitation and to prevent the plugging of the dissolution interface just at the end of the production zone, and further any possibility to dissolve unwanted salts in the depleted zone.

A phenomenon termed 'channeling' in ore beds may occur in the system according to the present invention. A 'channeling' event describes the tendency of the solvent to find and maintain a path through an area of ore insolubles (e.g., trona rubble). Once a channel is created, it may result in low or near zero dissolution rates of the surrounding ore, as the solvent bypasses solute-containing ore and fails to expose the solute to the solvent. It is expected however that the ore sloughing/crushing process which occurs in the present solution mining method will, in itself, most likely prevent, or at the very least, disrupt the channeling phenomenon.

With respect to any or all embodiments of the present invention, in the case of the occurrence of such channeling phenomenon during solution mining, one of the possible remedies might be achieved effectively by periodically fluctuating the pressures and/or flows of the solvent through an unlined borehole portion or a conduit concentrically positioned therein. In this way, unsaturated solvent would be forced from the bypass channels and fresh ore would be exposed to the solvent.

Another possible remedy might be achieved effectively by introducing insoluble tailings in order to alter the flow path of these so-formed bypass channels and expose the solvent to fresh ore. It is envisioned that tailings could be injected periodically, in an intermittent manner, or in a continuous manner.

With respect to any or all embodiments of the present invention, it is envisioned that the periodic injection of insoluble materials (such as tailings) along with the solvent may have the effect of forming islands of material that would both shift the solvent flow to fresh ore (e.g., fresh trona) and/or would form some support for the downward moving roof material. In this manner it is conceivable that a support system of insoluble material would be intentionally constructed to halt the roof movement to a desirable point while the channels created by dissolution of the solutes in the ore surrounding the insoluble material would allow for movement of the pregnant solution through this region of the ore. The periodic injection of insoluble materials may be carried out by periodically mixing a specified amount of insoluble material with the solvent and injecting the combined mixture directly into the unlined borehole portion or the conduit concentrically positioned therein, or through the insertion of a second conduit in each borehole to facilitate the intermittent flow of insoluble material.

This problem of bypass channeling may also be addressed by the installation of a weir near the sump which would result in an impoundment of the liquor within the active dissolution region. The contact zone of the unsaturated solvent could be adjusted by adjusting the height of the weir and therefore the 'shoreline' of the pooled liquor.

Applicants envision that this solution mining method using undercut formation, ore caving, and undercut traveling could be appropriately adjusted to orient the unlined boreholes (or portions thereof) across the strike of the ore bed. Indeed, with appropriate adjustments, the method can be carried out with undercut traveling in any direction relative to the trona bed's dip including being carried out in an essentially flat deposit. The undercut traveling may be up-dip (such as illustrated in FIGS. 1 and 2), or may be down-dip (such as illustrated in FIG. 11*a*-12*a*).

The present invention having been generally described, the following Example is given as a particular embodiment of the invention and to demonstrate the practice and advantages thereof. It is understood that the example is given by way of illustration and is not intended to limit the specification or the claims to follow in any manner.

EXAMPLE

Here is described a predictive example of how the in situ traveling undercut method according to the present invention may be carried out on a trona bed under some depth of significant overburden cover. The trona bed is located about 1500 feet below the surface, and contains virgin trona (that is say, a trona bed not previously mined). The trona bed may range in thickness from only a few feet up to several tens of feet (e.g., from 5 to 30 feet, or 5-15 feet). In this example the trona bed thickness is 10 feet. For this example, the target area is square with 2500 feet for each side, or one quarter square mile. The target trona zone is 10 feet thick by 2500 feet in length and width, dipping to the south at 1% slope. This volume represents approximately 4 million tons of in-place trona.

Applicants believe that the aerial limitations of this method are only defined by the capabilities of the machines required to layout and operate the solution mining system. Applicants cannot conceive of any geotechnical nor hydraulic related limitation to the aerial extent or shape of the extraction target area. In most practical cases, the trona bed may dip at a grade of about 0.4% to 1.5% or from 1 to 1.5%, but the Applicants believe that the method can be adapted to horizontal or rolling beds as well.

A tunnel (collection zone) of fairly large diameter (e.g., from 2 to 10 feet) is created, thereby traversing the entire 2500 feet of the southern most edge of the target area and extending onward to the west by from about 200 to 300 feet. A pumping system is then located at the western end of this tunnel. A second tunnel is provided on the northern edge of the trona bed. This second tunnel does not necessarily have to be in the same seam as the target trona bed. Indeed, Applicants conceive that the second tunnel could actually be at the surface. The second tunnel in this example is a means for feeding solvent and it provides access to a manifold to direct solvent to conduits positioned inside unlined boreholes. This manifold can be alternatively in another seam or on the surface.

Using directional drilling techniques, unlined borehole portions are directionally drilled parallel to each other through the trona bed approximately 1 to 2 feet above the bed floor in a north-south orientation (up-dip to down-dip), substantially perpendicular to the first and second tunnels' longitudinal axes. These unlined borehole portions generally have a smaller diameter than the first and second tunnels; for example, these holes may be 3 to 4 inches in diameter. Thus the ¼ square mile bed of trona which is 10 feet thick is penetrated by 24 boreholes substantially parallel to the bed floor and which are connected at one end to the second lateral tunnel (solvent feeding zone) on the northern (up-dip) boundary and terminate at the other end to the first lateral tunnel (liquor collection zone) on the southern (down-dip) boundary.

The spacing of these unlined borehole portions is about 100 feet apart, although they may be from 10 to 200 feet apart or more depending upon the optimal pattern for undercut formation determined by experimentation, testing, and numerical modeling.

Conduits are positioned into these unlined borehole portions. Conduits have a smaller diameter than the boreholes such as for example, 2 to 4 inches diameter. The downhole extremities of these conduits are positioned at some predetermined distance short of the first southern (down-dip) tunnel (collection zone). Initially, this predetermined distance may vary from 10 to 750 feet, such as for example 100 feet. The solvent manifold may be installed on the northern (up-dip) termination of these conduits in such a way that the flow and pressure of the solvent in each individual pipe can be controlled. A solvent (water or an aqueous solution) is then pumped into the conduits through the manifold. The solvent flows through the conduits from the surface to their downhole extremities at low head of pressure. The solvent immediately comes in contact with the trona contained in the unlined borehole walls at which point dissolution of the trona begins to occur. As trona near the extremities of the conduits is dissolved, the pregnant solution becomes saturated and exits into the first lateral tunnel (collection zone). This process continues until the dissolved out void area around each conduit extremity increases in circumference sufficiently for the voids at the end of each conduit to connect and form a shallow undercut 'slot' at the base of the trona bed of sufficient span that the overburden trona begins to slough off into the undercut slot. Additionally, the bed roof eventually sags down, but it cannot travel any further downward than the trona rubble will allow. As an actively caving undercut slot is created, the undercut slot becomes sufficiently large that the operation of the in situ mining system is allowed to run in steady state, as the process of dissolution, trona sloughing/crushing, and downward roof movement continues until the solvent begins to come into close proximity to the bed roof. At this point, the solvent flow and injection may be stopped in order to move the solvent injection location. For example, the conduits can be mechanically retreated back through the unlined borehole portions or otherwise perforated with a downhole tool in order to expose the solvent to new fresh trona regions, and then the steps of solvent injection, dissolution, trona sloughing/crushing, and downward roof movement are repeated.

The undercut span, solvent flow, duration, and distance can be adjusted such that, when the conduits may be retracted or perforated to a new location within the unlined borehole portions, the solute will reach full saturation in the pregnant solution before the solvent approaches the ore region in proximity of the roof rock and/or oil shale, where it is then desirable to stop dissolution. Chloride contamination of the so formed liquor is thereby prevented, if desired.

A production of 1 million metric ton per year of soda ash from such trona bed of 0.25 square mile would require the injection of a total flow rate of roughly 500 cubic meters per hour ($m^3/h$) of solvent and the extraction of roughly 600 $m^3/h$ of trona-loaded solution. That is to say, that with a pattern of 24 injection points and unlined parallel boreholes, the solvent flow rate per injection point will be from about 20 to about 25 $m^3/h$. If the diameter of the unlined boreholes is 4 inches, the initial velocity of solvent would be 0.7 m/s. When all expanded boreholes connect laterally, the flow rate would become 0.75 $m^3/h$ m for each 'linear meter' in width of the progression of the liquid downwards in the bed. When a layer of 0.25 meter of trona is being dissolved, about 2 centimeters (cm) of insoluble may be left over (with an assay of 92%), possibly creating an insoluble layer of 3 cm in thickness and 33% porosity, hence creating a tortuous flow channel for the liquid of 1 cm high. The speed for the liquid would then be about 2 cm/s. If the hydraulic diameters of these channels in which the liquid flows through such insoluble layer is 2 mm, a slope of 0.4% of the floor would be sufficient to enable a free flowing liquid to move through that zone by gravity.

If the liquor contamination occurring via dissolution of roof rock minerals is not a serious issue (in instances where the roof rock minerals do not contain contaminating solutes such as chloride), the operation of the in situ mining system can be carried out more aggressively in terms of the conduit travel distances or the extent of conduit body perforations and solvent flow rates. This process would continue until the entire ¼ mile square trona bed is extracted.

Depending upon the capability of the drilling and pumping equipment used, it is expected that this system and method of the present invention can be employed to extract several square miles of trona in one continuous operation over several years.

Accordingly, the scope of protection is not limited by the description and the Example set out above, but is only limited by the claims which follow, that scope including all equivalents of the subject matter of the claims. Each and every claim is incorporated into the specification as an embodiment of the present invention. Thus, the claims are a further description and are an addition to the preferred embodiments of the present invention.

While preferred embodiments of this invention have been shown and described, modifications thereof can be made by one skilled in the art without departing from the spirit or teaching of this invention. The embodiments described herein are exemplary only and are not limiting. Many variations and modifications of systems and methods are possible and are within the scope of the invention. Accordingly, the scope of protection is not limited to the embodiments described herein, but is only limited by the claims that follow, the scope of which shall include all equivalents of the subject matter of the claims.

The invention claimed is:

1. A method for in situ undercut solution mining of a subterranean ore bed, said ore bed comprising a desired solute being selected from the group consisting of sodium sesquicarbonate, sodium carbonate, and sodium bicarbonate, said ore bed having a floor and a roof, the method comprising the following steps:

injecting a solvent comprising water through an unlined borehole portion, said unlined borehole portion comprising a downhole end positioned within said ore bed and above said bed floor, said unlined borehole portion being horizontal or being slanted with one of its ends being at a higher elevation than the other end, in order to expose to the solvent an ore region within said unlined borehole portion or adjacent to said downhole end of said unlined borehole portion;

dissolving at least a portion of the desired solute, from said solvent-exposed ore region in a manner effective to form a liquor comprising said dissolved desired solute, and to further form an undercut above the bed floor, said undercut comprising at least a section of said unlined borehole portion which has been eroded by dissolution;

repeating the solvent injection to dissolve additional desired solute from the ore thereby enriching the liquor in desired solute, and further in a manner effective to widen the undercut and to trigger the fracture of unexposed ore located above said undercut and the downward movement of fractured ore rubble by gravity into the undercut, while allowing the ore roof to sag but not to break so as to minimize chloride contamination of the liquor by preventing exposure of said solvent to chloride-containing material located at or above the ore roof; and flowing the liquor towards a subterranean collection zone in order to pass said liquor to a terranean location.

2. The method according to claim 1 wherein the dissolution of the desired solute is carried out under a pressure lower than hydrostatic head pressure.

3. The method according to claim 1 wherein the dissolution of the desired solute is carried out at hydrostatic head pressure after the undercut is formed.

4. The method according to claim 1 wherein the method further comprises injecting a compressed gas into the undercut while being formed.

5. The method according to claim 1 wherein the collection zone is created before the undercut is formed.

6. The method according to claim 1 wherein the collection zone is formed after the undercut is formed.

7. The method according to claim 1 being carried out in a batch mode, wherein the solvent is injected to fill up the unlined borehole portion and the so formed undercut; and then the solvent flow is stopped so that the non-moving solvent dissolves the desired solute until the solvent is saturated with desired solute, at which point the liquor is removed from the subterranean collection zone to the surface; and wherein once the undercut cavity is drained, the solvent injection resumes for the dissolution step to be repeated.

8. The method according to claim 1 wherein the injection of solvent is performed into two or more parallel unlined borehole portions positioned in the ore bed to allow the formation of two or more parallel undercuts.

9. The method according to claim 8 wherein the injection of solvent into two or more parallel unlined borehole portions is performed sequentially.

10. The method according to claim 8 wherein said unlined borehole portions are parallel to the longitudinal axis of the ore bed.

11. The method according to claim 8 wherein the unlined borehole portions are on the same plane.

12. The method according to claim 8 wherein the parallel unlined borehole portions are perpendicular to the longitudinal axis of said collection zone.

13. The method according to claim 8 wherein the parallel unlined borehole portions are parallel to the longitudinal axis of said collection zone.

14. The method according to claim 1 wherein said ore bed has a dip gradient, and the solvent is injected in an up-dip direction.

15. The method according to claim 1 wherein said ore bed has a dip gradient, and the solvent is injected in a down-dip direction.

16. The method according to claim 1 wherein the unlined borehole portion comprises lateral side branches to favor the lateral widening of the undercut.

17. The method according to claim 1 wherein the solvent is water or an aqueous solution unsaturated in desired solute.

18. The method according to claim 1 wherein the liquor collected in the subterranean collection zone is saturated in desired solute.

19. The method according to claim 1 wherein the solvent injection is carried out in a manner effective to initially favor the lateral widening of the undercut and thereafter favor the upward widening of the undercut.

20. The method according to claim 1 wherein the dissolution step leaves a layer of insolubles at the bottom of the formed undercut, said insolubles layer providing a flow channel in said undercut for the liquor to flow therethrough.

21. The method according to claim 1 wherein the method comprises an undercut formation phase where the undercut cavity is not filled with liquid, followed by a production phase where the undercut cavity is filled with liquid.

22. The method according to claim 1 further comprising:

f) terminating at least the injection step when at least one of the following conditions is met:

i) the collected liquor has a content in desired solute below a minimum acceptable value;

ii) the collected liquor has a content in an undesirable solute exceeding a maximum threshold value.

23. The method according to claim 1 wherein said ore bed has a dip gradient, and said borehole downhole end is positioned within a down-dip region of said ore bed.

24. The method according to claim 1 wherein said ore bed has a dip gradient, and said borehole downhole end is positioned within an up-dip region of said ore bed.

25. The method according to claim 1 wherein the injection of solvent is performed through a conduit which is concentrically positioned inside at least a part of the unlined borehole portion.

26. The method according to claim 25, wherein the injection step is carried out via a downhole injection zone of the conduit, and the method further comprises g) moving said injection zone of the conduit to another location within said unlined borehole portion.

27. The method according to claim 26, wherein said injection zone of the conduit is a downhole conduit extremity, and wherein step (g) is carried out to expose fresh ore to the solvent by at least one of the following steps:

g1) retracting the conduit within the unlined borehole portion thereby increasing the distance between the downhole conduit extremity and the downhole end of the unlined borehole portion;

g2) perforating the conduit body along a pre-selected length moving upstream from said conduit extremity.

28. The method according to claim 25 wherein the injection step is carried out via a downhole injection zone of the conduit, and the conduit injection zone is designed to laterally inject the solvent in order to avoid injection of solvent in a vertical direction.

29. The method according to claim 1 wherein the ore bed is a trona bed.

30. The method according to claim 29 wherein the solvent is a caustic solution.

31. The method according to claim 1 wherein the collected liquor contains 5% or less in sodium chloride content.

32. The method according to claim 1 further comprising injecting insoluble material in the undercut to form an insoluble deposit in order to alter the flow path of the solvent and/or to prevent solvent flow in at least one region of the undercut.

* * * * *